US009139885B2

(12) United States Patent
Kawata et al.

(10) Patent No.: US 9,139,885 B2
(45) Date of Patent: Sep. 22, 2015

(54) HIGH-STRENGTH STEEL SHEET AND HIGH-STRENGTH ZINC-COATED STEEL SHEET WHICH HAVE EXCELLENT DUCTILITY AND STRETCH-FLANGEABILITY AND MANUFACTURING METHOD THEREOF

(75) Inventors: Hiroyuki Kawata, Tokyo (JP); Naoki Maruyama, Tokyo (JP); Akinobu Murasato, Tokyo (JP); Naoki Yoshinaga, Tokyo (JP); Chisato Wakabayashi, Tokyo (JP); Noriyuki Suzuki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 13/822,746

(22) PCT Filed: Sep. 16, 2011

(86) PCT No.: PCT/JP2011/071222

§ 371 (c)(1),
(2), (4) Date: Mar. 13, 2013

(87) PCT Pub. No.: WO2012/036269

PCT Pub. Date: Mar. 22, 2012

(65) Prior Publication Data

US 2013/0167980 A1 Jul. 4, 2013

(30) Foreign Application Priority Data

Sep. 16, 2010 (JP) ..... 2010-208329
Sep. 16, 2010 (JP) ..... 2010-208330

(51) Int. Cl.
*C21D 8/02* (2006.01)
*C22C 38/40* (2006.01)

(Continued)

(52) U.S. Cl.
CPC ..... *C21D 8/0205* (2013.01); *C21D 8/0226* (2013.01); *C21D 8/0236* (2013.01);
(Continued)

(58) Field of Classification Search
CPC ..... C21D 8/0205; C22C 38/58
USPC ..... 148/504, 336, 320, 330, 333, 332, 331
See application file for complete search history.

(56) References Cited

U.S. PATENT DOCUMENTS

2003/0196735 A1* 10/2003 Sugiura et al. ..... 148/602
2011/0008647 A1* 1/2011 Azuma et al. ..... 428/659

(Continued)

FOREIGN PATENT DOCUMENTS

CN 1343262 A 4/2002
CN 101646794 A 2/2010

(Continued)

OTHER PUBLICATIONS

International Search Report issued in PCT/JP2011/071222, mailed on Dec. 20, 2011.

(Continued)

*Primary Examiner* — Roy King
*Assistant Examiner* — Jenny Wu
(74) *Attorney, Agent, or Firm* — Birch, Stewart, Kolasch & Birch, LLP

(57) ABSTRACT

This high-strength steel sheet includes by mass percentage: 0.05 to 0.4% of C; 0.1 to 2.5% of Si; 1.0 to 3.5% of Mn; 0.001 to 0.03% of P; 0.0001 to 0.01% of S; 0.001 to 2.5% of Al; 0.0001 to 0.01% of N; 0.0001 to 0.008% of O; and a remainder composed of iron and inevitable impurities, wherein a steel sheet structure contains by volume fraction 10 to 50% of a ferrite phase, 10 to 50% of a tempered martensite phase, and a remaining hard phase, wherein a 98% hardness is 1.5 or more times as high as a 2% hardness in a range from ⅛ to ⅜ of a thickness of the steel sheet, wherein a kurtosis K* of the hardness distribution between the 2% hardness and the 98% hardness is −1.2 to −0.4, and wherein an average crystal grain size in the steel sheet structure is 10 μm or less.

17 Claims, 3 Drawing Sheets

(51) Int. Cl.

| | |
|---|---|
| ***C25D 5/10*** | (2006.01) |
| ***B32B 15/00*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/38*** | (2006.01) |
| ***C23C 2/06*** | (2006.01) |
| ***C23C 2/40*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/34*** | (2006.01) |
| ***C22C 38/58*** | (2006.01) |
| ***C23C 2/02*** | (2006.01) |
| ***C23C 2/28*** | (2006.01) |
| ***C25D 3/22*** | (2006.01) |
| ***C25D 5/36*** | (2006.01) |
| ***C25D 5/50*** | (2006.01) |
| *C25D 3/56* | (2006.01) |

(52) U.S. Cl.

CPC ..... *C21D8/0273* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/34* (2013.01); *C22C 38/38* (2013.01); *C22C 38/40* (2013.01); *C22C 38/58* (2013.01); *C23C 2/02* (2013.01); *C23C 2/06* (2013.01); *C23C 2/28* (2013.01); *C23C 2/40* (2013.01); *C25D 3/22* (2013.01); *C25D 5/36* (2013.01); *C25D 5/50* (2013.01); *C21D 2211/005* (2013.01); *C21D 2211/008* (2013.01); *C25D 3/565* (2013.01)

(56) References Cited

U.S. PATENT DOCUMENTS

| | | | | |
|---|---|---|---|---|
| 2011/0024004 | A1* | 2/2011 | Azuma et al. | 148/533 |
| 2011/0139305 | A1* | 6/2011 | Bettacchini | 144/253.1 |

FOREIGN PATENT DOCUMENTS

| | | | | |
|---|---|---|---|---|
| EP | 1607489 | A1 | | 12/2005 |
| JP | 59-219473 | A | | 12/1984 |
| JP | 2001-192768 | A | | 7/2001 |
| JP | 2004-068050 | A | | 3/2004 |
| JP | 2004-263270 | A | | 9/2004 |
| JP | 2007-009317 | A | | 1/2007 |
| JP | 2007-211334 | A | | 8/2007 |
| JP | 2007-231369 | A | | 9/2007 |
| JP | 2007-302918 | A | | 11/2007 |
| JP | 2007-327098 | A | | 12/2007 |
| JP | 2008-266778 | A | | 11/2008 |
| JP | 2009-084648 | A | | 4/2009 |
| JP | 2009084648 | A | * | 4/2009 |
| JP | 2009-270171 | A | | 11/2009 |
| JP | 2010-065307 | A | | 3/2010 |
| KR | 10-2004-0075971 | A | | 8/2004 |
| WO | WO 2009096344 | A1 | * | 8/2009 |
| WO | WO 2009119751 | A1 | * | 10/2009 |
| WO | WO 2009125874 | A1 | * | 10/2009 |
| WO | WO 2011/062151 | A1 | | 5/2011 |

OTHER PUBLICATIONS

Notice of Allowance dated Aug. 23, 2013 issued in Korean Patent Application No. 10-2013-7006419.

Office Action dated Sep. 29, 2013 issued in Chinese Patent Application No. 201180044334.3.

An extended European Search Report for Appl. No. EP11825267.5 dated Jun. 24, 2014.

* cited by examiner

HIGH-STRENGTH STEEL SHEET AND HIGH-STRENGTH ZINC-COATED STEEL SHEET WHICH HAVE EXCELLENT DUCTILITY AND STRETCH-FLANGEABILITY AND MANUFACTURING METHOD THEREOF

TECHNICAL FIELD

The present invention relates to a high-strength steel sheet and a high-strength zinc-coated steel-sheet which have excellent ductility and stretch-flangeability and a manufacturing method thereof.

Priority is claimed on Japanese Patent Application Nos. 2010-208329 and 2010-208330, filed Sep. 16, 2010, the content of which is incorporated herein by reference.

BACKGROUND ART

In recent years, there has been an increasing demand for a high-strength steel sheet used in a vehicle or the like, and a high-strength cold-rolled steel sheet with a maximum tensile stress of 900 MPa or more is also being used.

Generally, as the strength of a steel sheet is enhanced, ductility and stretch-flangeability are lowered, and workability is degraded. However, a high-strength steel sheet with sufficient workability has been demanded in recent years.

As a conventional technique for enhancing ductility and stretch-flangeability of a high-strength steel sheet, a high-tensile galvanized steel sheet, which has a composition containing by mass percentage, C: 0.05 to 0.20%, Si: 0.3 to 1.8%, Mn: 1.0 to 3.0%, S: 0.005% or less, the remainder composed of Fe and inevitable impurities, has a composite structure including ferrite, tempered martensite, retained austenite, and low temperature transformation phase, and contains by volume percentage 30% or more of ferrite, 20% or more of tempered martensite, 2% or more of retained austenite, in which average crystal grain sizes of ferrite and tempered martensite are 10 μm or less, is an exemplary example (see Patent Document 1, for example).

In addition, as a conventional technique for enhancing workability of a high-strength steel sheet, a high-tensile cold-rolled steel sheet, in which amounts of C, Si, Mn, P, S, Al, and N are adjusted, which further contains 3% or more of ferrite and a total of 40% or more of bainite containing carbide and martensite containing carbide as metal structures of the steel sheet containing one or more of Ti, Nb, V, B, Cr, Mo, Cu, Ni, and Ca as necessary, in which the total amount of ferrite, bainite, and martensite is 60% or more, and which further has a structure in which the number of ferrite grains containing cementite, martensite, or retained austenite therein corresponds to 30% or more of the total number of ferrite grains and has tensile strength of 780 MPa or more, is an exemplary example (see Patent Document 2, for example).

Moreover, as a conventional technique for enhancing stretch-flangeability of a high-strength steel sheet, a steel sheet in which a difference in hardness between a hard part and a soft part of the steel sheet is reduced is an exemplary example. For example, Patent Document 3 discloses a technique in which the standard deviation of hardness in the steel sheet is reduced and uniform hardness is given to the entire steel sheet. Patent Document 4 discloses a technique in which hardness in the hard part is lowered by heat treatment and the difference in hardness from that in the soft part is reduced. Patent Document 5 discloses a technique in which the difference in hardness from the soft part is reduced by configuring the hard part of relatively soft bainite.

Furthermore, as a conventional technique for enhancing stretch-flangeability of a high-strength steel sheet, a steel sheet, which has a structure containing by an area ratio 40 to 70% of tempered martensite and a remainder composed of ferrite, in which a ratio between an upper limit value and a lower limit value of Mn concentration in a cross-section in a thickness direction of the steel sheet is reduced (see Patent Document 6, for example) may be exemplified.

CITATION LIST

Patent Documents

[Patent Document 1] Japanese Unexamined Patent Application, First Publication No. 2001-192768

[Patent Document 2] Japanese Unexamined Patent Application, First Publication No. 2004-68050

[Patent Document 3] Japanese Unexamined Patent Application, First Publication No. 2008-266778

[Patent Document 4] Japanese Unexamined Patent Application, First Publication No. 2007-302918

[Patent Document 5] Japanese Unexamined Patent Application, First Publication No. 2004-263270

[Patent Document 6] Japanese Unexamined Patent Application, First Publication No. 2010-65307

SUMMARY OF INVENTION

Technical Problem

According to the conventional techniques, however, workability of the high-strength steel sheet with a maximum tensile strength of 900 MPa or more is insufficient, and it has been desired to further enhance ductility and stretch-flangeability and to thereby further enhance workability.

The present invention is made in view of such circumstances, and an object thereof is to provide a high-strength steel sheet, which has excellent ductility and stretch-flangeability and has excellent workability while high strength is secured such that the maximum tensile strength becomes 900 MPa or more, and a manufacturing method thereof.

Solution to Problem

The present inventor conducted intensive study in order to solve the above problems. As a result, the present inventor found that it is possible to secure a maximum tensile strength as high as 900 MPa or more and significantly enhance ductility and stretch-flangeability (hole expanding property) by allowing the steel sheet to have a large hardness difference by increasing a micro Mn distribution inside the steel sheet and have a sufficiently small average crystal grain size by controlling dispertion in the hardness distribution.

[1] A high-strength steel sheet which has excellent ductility and stretch-flangeability, including by mass percentage: 0.05 to 0.4% of C; 0.1 to 2.5% of Si; 1.0 to 3.5% of Mn; 0.001 to 0.03% of P; 0.0001 to 0.01% of S; 0.001 to 2.5% of Al; 0.0001 to 0.01% of N; 0.0001 to 0.008% of O; and a remainder composed of iron and inevitable impurities, wherein a steel sheet structure contains by volume fraction 10 to 50% of a ferrite phase, 10 to 50% of a tempered martensite phase, and a remaining hard phase, wherein when a plurality of measurement regions with diameters of 1 μm or less are set in a range from ⅛ to ⅜ of thickness of the steel sheet, hardness measurement values in the plurality of measurement regions are arranged in an ascending order to obtain a hardness distribution, an integer N0.02, which is a number obtained by multiplying a total number of the hardness measurement values by 0.02 and, if present, by rounding up a decimal number, is obtained, a hardness of a measurement value which is an N0.02-th largest value from a smallest hardness measurement value is regarded as a 2% hardness, an integer N0.98 which is a number obtained by multiplying the total number of the hardness measurement values by 0.98 and, if present, by rounding down the decimal number is obtained, and a hardness of a measurement value which is an N0.98-th largest value from the smallest hardness measurement value is regarded as a 98% hardness, the 98% hardness is 1.5 or more times as high as the 2% hardness, wherein a kurtosis K* of the hardness distribution between the 2% hardness and the 98% hardness is equal to or more than −1.2 and equal to or less than −0.4, and wherein an average crystal grain size in the steel sheet structure is 10 μm or less.

[2] The high-strength steel sheet which has excellent ductility and stretch-flangeability according to [1], wherein a difference between a maximum value and a minimum value of Mn concentration in a base iron in a thickness range from ⅛ to ⅜ of the steel sheet is equal to or more than 0.4% and equal to or less than 3.5% when converted into the mass percentage.

[3] The high-strength steel sheet which has excellent ductility and stretch-flangeability according to [1] or [2], wherein when a section from the 2% hardness to the 98% hardness is equally divided into 10 parts, and 10 1/10-sections are set, a number of the hardness measurement values in each 1/10-section is 2 to 30% of a number of all measurement values.

[4] The high-strength steel sheet which has excellent ductility and stretch-flangeability according to any one of [1] to [3], wherein the hard phase includes any one of or both a bainitic ferrite phase and a bainite phase of 10 to 45% by a volume fraction, and a fresh martensite phase of at 10% or less.

[5] The high-strength steel sheet which has excellent ductility and stretch-flangeability according to any one of [1] to [4], wherein the steel sheet structure further includes 2 to 25% of a retained austenite phase.

[6] The high-strength steel sheet which has excellent ductility and stretch-flangeability according to any one of [1] to [5], further including by mass percentage one or more of 0.005 to 0.09% of Ti; and 0.005 to 0.09% of Nb.

[7] The high-strength steel sheet which has excellent ductility and stretch-flangeability according to any one of [1] to [6], further including by mass percentage one or more of: 0.0001 to 0.01% of B; 0.01 to 2.0% of Cr; 0.01 to 2.0% of Ni; 0.01 to 2.0% of Cu; and 0.01 to 0.8% of Mo.

[8] The high-strength steel sheet which has excellent ductility and stretch-flangeability according to any one of [1] to [7], further including by mass percentage: 0.005 to 0.09% of V.

[9] The high-strength steel sheet which has excellent ductility and stretch-flangeability according to any one of [1] to [8], further including one or more of Ca, Ce, Mg, and REM at 0.0001 to 0.5% by mass percentage in total.

[10] A high-strength zinc-coated steel sheet which has excellent ductility and stretch-flangeability, wherein the high-strength zinc-coated steel sheet is produced by forming a zinc-coated layer on a surface of the high-strength steel sheet according to any one of [1] to [9].

[11] A manufacturing method of a high-strength steel sheet which has an excellent ductility and a stretch-flangeability, the method including: a hot rolling process in which a slab containing the chemical constituents according to any one of [1] or [6] to [9] is heated up to 1050° C. or higher directly or after cooling once, a hot rolling is performed thereon at a higher temperature of one of 800° C. and an $Ar_3$ transformation point, and a winding is performed in a temperature range of 750° C. or lower such that an austenite phase in a structure of a rolled material after rolling occupies 50% by volume or more; a cooling process in which the steel sheet after the hot rolling is cooled from a winding temperature to (the winding temperature−100)° C. at a rate of 20° C./hour or lower while a following Equation (1) is satisfied; and a process in which continuous annealing is performed on the steel sheet after the cooling, wherein in the process in which continuous annealing is performed, the steel sheet is annealed at a maximum heating temperature of 750 to 1000° C., a first cooling in which the steel sheet is cooled from the maximum heating temperature to a ferrite transformation temperature range or lower and maintained in the ferrite transformation temperature range for 20 to 1000 seconds is subsequently performed, a second cooling in which the steel sheet is cooled at a cooling rate of 10° C./second or higher on average in a bainite transformation temperature range and cooling is stopped within a range from a martensite transformation start temperature−120° C. to the martensite transformation start temperature is subsequently performed, the steel sheet after the second cooling is maintained in a range from a second cooling stop temperature to the martensite transformation start temperature for 2 to 1000 seconds, the steel sheet is subsequently reheated up to a reheating stop temperature, which is equal to or more than a bainite transformation start temperature−100° C., at a rate of temperature increase of 10° C./second or higher on average in the bainite transformation temperature range, and a third cooling in which the steel sheet after the reheating is cooled from the reheating stop temperature to a temperature which is lower than the bainite transformation temperature range and maintained in the bainite transformation temperature range for 30 seconds or more is performed:

[Equation 1]

$$\left[\int_{T_{c-100}}^{T_c} 9.47\times10^5\cdot\exp\left(-\frac{18480}{T+273}\right)\cdot t(T)\cdot dT\right]^{0.5}\geq 1.0 \quad (1)$$

[where t(T) in Equation (1) represents maintaining time (seconds) of the steel sheet at a temperature T° C. in the cooling process after the winding.]

[12] The manufacturing method of the high-strength steel sheet which has excellent ductility and stretch-flangeability according to [11], wherein the winding temperature after the hot rolling is equal to or more than a Bs point and equal to or less than 750° C.

[13] The manufacturing method of the high-strength steel sheet which has excellent ductility and stretch-flangeability according to [11] or [12], further including between the cooling process and the continuous annealing process: a cold rolling process in which the steel sheet is subjected to acid pickling and a cold rolling at rolling reduction from 35 to 80%.

[14] The manufacturing method of the high-strength steel sheet which has excellent ductility and stretch-flangeability according to any one of [11] to [13], wherein a sum of a time during which the steel sheet is maintained in the bainite transformation temperature range in the second cooling and a time during which the steel sheet is maintained in the bainite transformation temperature range in the reheating is 25 seconds or less.

[15] A manufacturing method of a high-strength zinc-coated steel sheet which has excellent ductility and stretch-flangeability, wherein the steel sheet is dipped into a zinc plating bath in the reheating in manufacturing the high-strength steel sheet based on the manufacturing method according to any one of [11] to [14].

[16] A manufacturing method of a high-strength zinc-coated steel sheet which has excellent ductility and stretch-flangeability, wherein the steel sheet is dipped into a zinc plating bath in the bainite transformation temperature range in the third cooling in manufacturing the high-strength steel sheet based on the manufacturing method according to any one of [11] to [14].

[17] A manufacturing method of a high-strength zinc-coated steel sheet which has excellent ductility and stretch-flangeability, wherein a zinc electroplating is performed after manufacturing the high-strength steel sheet based on the manufacturing method according to any one of [11] to [14].

[18] A manufacturing method of a high-strength zinc-coated steel sheet which has excellent ductility and stretch-flangeability, wherein a hot-dip zinc-plating is performed after manufacturing the high-strength steel sheet based on the manufacturing method according to any one of [11] to [14].

Advantageous Effects of Invention

The high-strength steel sheet of the present invention contains predetermined chemical constituents, when a plurality of measurement regions with diameters of 1 μm or less are set in a range from ⅛ to ⅜ of a thickness of the steel sheet, hardness measurement values in the plurality of measurement regions are arranged in ascending order to obtain a hardness distribution, an integer N0.02 which is a number obtained by multiplying a total number of the hardness measurement values by 0.02 and, if present, by rounding up a decimal number, is obtained, a hardness of a measurement value which is an N0.02-th largest value from the smallest hardness measurement value is regarded as a 2% hardness, an integer N0.98 which is a number obtained by multiplying the total number of the hardness measurement values by 0.98 and, if present, rounding down a decimal number, is obtained, and a hardness of a measurement value which is an N0.98-th largest value from the smallest hardness measurement value is regarded as a 98% hardness, the 98% hardness is 1.5 or more times as high as the 2% hardness, a kurtosis K* of the hardness distribution between the 2% hardness and the 98% hardness is equal to or less than −0.40, an average crystal grain size in the steel sheet structure is 10 μm or less, and therefore, the steel sheet which has excellent ductility and stretch-flangeability is obtained while tensile strength which is as high as 900 MPa or more is secured.

In addition, a micro Mn distribution inside the steel sheet increases by winding the steel sheet after the hot rolling around a coil at 750° C. and cooling the steel sheet from the winding temperature to (the winding temperature−100)° C. at a cooling rate of 20° C./hour or lower while the above Equation (1) is satisfied, in the process for producing a hot-rolled coil from the slab containing the predetermined chemical constituents in the manufacturing method of the high-strength steel sheet according to the present invention.

In addition, since the process in which continuous annealing is performed on the steel sheet with increased Mn distribution includes a heating process in which the steel sheet is annealed at a maximum heating temperature of 750 to 1000° C., a first cooling process in which the steel sheet is cooled from the maximum heating temperature to a ferrite transformation temperature range or lower and maintained in a ferrite transformation temperature range for 20 to 1000 seconds, a second cooling process in which the steel sheet after the first cooling process is cooled at a cooling rate of 10° C./second or higher on average in a bainite transformation temperature range and cooling is stopped within a range from a martensite transformation start temperature−120° C. to the martensite transformation start temperature, a maintaining process in which the steel sheet after the second cooling process is maintained in a range from a second cooling stop temperature to the Ms point or lower for 2 to 1000 seconds, a reheating process in which the steel sheet after the maintaining process is reheated up to a reheating stop temperature, which is equal to or more than a bainite transformation start temperature−80° C., at a rate of temperature increase of 10° C./second or higher on average in the bainite transformation temperature range, and a third cooling process in which the steel sheet after the reheating process is cooled from the reheating stop temperature to a temperature which is lower than the bainite transformation temperature range and maintained in the bainite transformation temperature range for 30 seconds or more, the steel sheet structure is controlled such that the hardness difference inside the steel sheet is large and the average crystal grain size is sufficiently small, and it is possible to obtain the high-strength cold-rolled steel sheet which has excellent ductility and stretch-flangeability (hole expanding property) and has excellent workability while securing a maximum tensile strength of 900 MPa or more.

Furthermore, it is possible to obtain the high-strength zinc-coated steel sheet which has excellent ductility and stretch-flangeability (hole expanding property) and has excellent workability while securing the maximum tensile strength as high as 900 MPa or more by adding the process for forming the zinc-pated layer.

DESCRIPTION OF EMBODIMENTS

Figure 1:
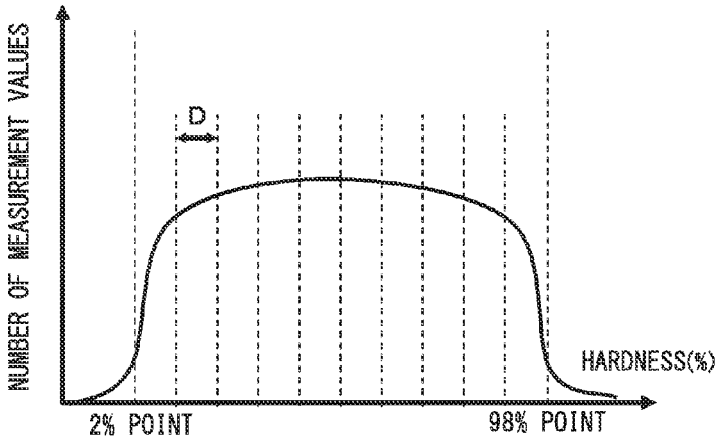
FIG. 1 is a graph showing a relationship between hardness classified into a plurality of levels and a number of measurement values in each level, which is obtained by converting each measurement value while a difference between a maximum hardness measurement value and a minimum hardness measurement value is regarded as 100%, in relation to an example of a high-strength steel sheet according to the present invention.

The high-strength steel sheet according to the present invention is a steel sheet, which includes predetermined chemical components, in which an average crystal grain size in the structure thereof is 10 μm or less, 98% hardness is 1.5 or more times as high as 2% hardness in a hardness distribution when a plurality of measurement regions with diameters of 1 μm or less is set in a thickness range from ⅛ to ⅜ thereof, and measurement values of hardness in the plurality of measurement regions are aligned in an order from a smallest measurement value, and kurtosis K* of the hardness distribution between the 2% hardness region and the 98% hardness region is −0.40 or less. An example of hardness distribution in the high-strength steel sheet according to the present invention is shown in FIG. 1.

(Definition of Hardness)

Hereinafter, definition of hardness will be described, and 2% hardness and 98% hardness will be described first. Measurement values of hardness are obtained in the plurality of measurement regions set in a thickness range from ⅛ to ⅜ of the steel sheet, and an integer N0.02, which is a number obtained by multiplying the total number of the measurement values of hardness by 0.02 and, if present, by rounding up a decimal number, is obtained. In addition, when a number obtained by multiplying the total number of the measurement values of hardness by 0.98 includes a decimal number, an integer N0.98 is obtained by rounding down the decimal number. Then, hardness of an N0.02-th largest measurement value from the minimum hardness measurement value in the plurality of measurement regions is regarded as the 2% hardness. In addition, a hardness of an N0.98-th largest measurement value from the minimum hardness measurement value in the plurality of measurement regions is regarded as the 98% hardness. In the high-strength steel sheet of the present invention, the 98% hardness is preferably 1.5 or more times as high as the 2% hardness, and the kurtosis K* of the hardness distribution between the 2% hardness and the 98% hardness is preferably −0.40 or less.

Each diameter of the measurement regions is limited to 1 μm or less in setting the plurality of measurement regions in order to exactly evaluate dispertion in hardness resulting from a steel sheet structure including a ferrite phase, a bainite phase, a martensite phase, and the like. Since the average crystal grain size in the steel sheet structure is 10 μm or less in the high-strength steel sheet of the present invention, it is necessary to obtain hardness measurement values in narrower measurement regions than the average crystal grain size in order to exactly evaluate the dispertion in hardness resulting from the steel sheet structure, and specifically, it is necessary to set regions with diameters of 1 μm or less as the measurement regions. When the hardness is measured using an ordinary Vickers tester, an indentation size is too large to exactly evaluate the dispertion in hardness resulting from the structure.

Accordingly, the "hardness measurement value" in the present invention represents a value evaluated based on the following method. That is, a measurement value obtained by measuring hardness under an indentation load of 1 g using a dynamic micro-hardness tester provided with a Berkovich type three-sided pyramid indenter based on an indentation depth measurement method is used for the high-strength steel sheet of the present invention. The hardness measurement position is set to a range from ⅛ to ⅜ around ¼ of a sheet thickness in the sheet thickness cross-section which is parallel to a rolling direction of the steel sheet. In addition, the total number of the hardness measurement values ranges from 100 to 10000, and is preferably equal to or more than 1000. The thus measured indentation size has a diameter of 1 μm or less on the assumption that the indentation shape is a circular shape. When the indentation shape is rectangular shape or a triangular shape other than the circular shape, the dimension of the indentation shape in the longitudinal direction may be 1 μm or less.

In addition, the "average crystal grain size" in the present invention represents the size measured by the following method. That is, a grain size measured based on an EBSD (Electron BackScattering Diffraction) method is preferably used for the high-strength steel sheet of the present invention. A grain size observation surface ranges from ⅛ to ⅜ around ¼ of the sheet thickness in the sheet thickness cross-section which is parallel to the rolling direction of the steel sheet. In addition, it is preferable to calculate the average crystal grain size by applying a intercept method to a grain boundary map for the observation surface obtained by regarding a boundary, at which a crystal orientation difference between adjacent measurement points in a bcc crystal orientation becomes 15° or more, as a grain boundary.

In order to obtain a steel sheet which has excellent ductility, it is important to utilize a structure such as ferrite, which has excellent ductility, as the steel sheet structure. However, the structure which has excellent ductility is soft. Accordingly, it is necessary to employ a steel sheet structure containing a soft structure and a hard structure such as martensite in order to obtain a steel sheet with high ductility while having sufficient strength.

In the steel sheet with the steel sheet structure including both the soft structure and the hard structure, strain caused by deformation is more easily accumulated in the soft part and is not easily distributed to the hard part when a hardness difference between the soft part and the hard part is larger, and therefore ductility is enhanced.

Since the 98% hardness is 1.5 or more times as high as the 2% hardness in the high-strength steel sheet of the present invention, the hardness difference between the soft part and the hard part is sufficiently large, and therefore, it is possible to obtain sufficiently high ductility. In order to obtain further higher ductility, the 98% hardness is preferably 3.0 or more times as high as the 2% hardness, more preferably more than 3.0 times, further more preferably 3.1 or more times, further more preferably 4.0 or more times, and still further more preferably 4.2 or more times. When the measurement value of the 98% hardness is less than 1.5 times of the measurement value of the 2% hardness, the hardness difference between the soft part and the hard part is not sufficiently large, and therefore, ductility is insufficient. Meanwhile, the measurement value of the 98% hardness is 4.2 or more times of the measurement value of the 2% hardness, the hardness difference between the soft part and the hard part is sufficiently large, and both ductility and a hole expanding property are further enhanced, which is preferable.

As described above, the hardness difference between the soft part and the hard part is preferably larger from the standpoint of ductility. However, if regions with the large hardness difference are in contact with each other, a strain gap caused by deformation of the steel sheet occurs at the border part, and a micro-crack is easily generated. Since the micro-crack may become a start point of cracking, stretch-flangeability is degraded. In order to suppress the degradation of stretch-flangeability resulted from the large hardness difference between the soft part and the hard part, it is effective to reduce number of borders at which the regions with the large hardness difference are in contact with each other and shorten the length of each border at which the regions with the large hardness difference are in contact with each other.

Since the average crystal grain size of the high-strength steel sheet of the present invention, which is measured by the EBSD method, is 10 μm or less, the border, at which the regions with the large hardness differences are in contact with each other, in the steel sheet is shortened, degradation of stretch-flangeability resulting from the large hardness difference between the soft part and the hard part is suppressed, and excellent stretch-flangeability can be obtained. In order to obtain further excellent stretch-flangeability, the average crystal grain size is preferably 8 μm or less, and more preferably 5 μm. If the average crystal grain size exceeds 10 μm, the effect of shortening the border, at which the regions with the large hardness difference are in contact with each other, in the steel sheet is not sufficient, and it is not possible to sufficiently suppress the degradation of stretch-flangeability.

In addition, in order to reduce the number of the borders at which the regions with the large hardness difference are in contact with each other, the steel sheet structure having a variety of narrow distribution of hardness, in which dispertion of the hardness distribution in the steel sheet is small, may be employed.

According to the high-strength steel sheet of the present invention, the dispertion in the hardness distribution in the steel sheet is reduced by setting the kurtosis K* of the hardness distribution to be −0.40 or less, it is possible to reduce the borders at which the regions with the large hardness difference are in contact with each other and thereby to obtain excellent stretch-flangeability. In order to obtain further excellent stretch-flangeability, the kurtosis K* is preferably −0.50 or less, and more preferably −0.55 or less. Although the effects of the present invention can be achieved without particularly determining the lower limit of the kurtosis K*, it is difficult to set K* to be less than −1.20, and therefore, this value is regarded as the lower limit.

In addition, the kurtosis K* is a value which can be obtained by the following Equation (2) based on the hardness distribution and is a numerical value obtained as a result of evaluation of the hardness distribution by comparing the hardness distribution with the normal distribution. A case in which the kurtosis is a negative value denotes that a hardness distribution curve is relatively flat, and a large absolute value denotes that the hardness distribution deviates further from the normal distribution.

[Equation 2]

$$K^* = \left\{\frac{(N_{0.98} - N_{0.02} + 1)(N_{0.98} - N_{0.02} + 2)}{(N_{0.98} - N_{0.02})(N_{0.98} - N_{0.02} - 1)(N_{0.98} - N_{0.02} - 2)}\right\} \cdot \sum_{i=N_{0.02}}^{N_{0.98}} \left(\frac{H_i H^*}{s^*}\right)^4 - \frac{3(N_{0.98} - N_{0.02})^2}{(N_{0.98} - N_{0.02} - 1)(N_{0.98} - N_{0.02} - 2)} \quad (2)$$

Hi: hardness of an i-th largest measurement point from a measurement value of the minimum hardness H*: average hardness from the N0.02-th largest measurement point from the minimum hardness to the N0.98-th largest measurement point s*: standard deviation from the N0.02-th largest measurement point from the minimum hardness to the N0.98-th largest measurement point In addition, when the kurtosis K* exceeds −0.40, the steel sheet structure is not a structure which has a sufficient variety of sufficiently narrow distribution of hardness, dispertion in the hardness distribution in the steel sheet becomes larger, the number of the borders at which the regions with the large hardness difference are in contact with each other increases, and it is not possible to sufficiently suppress degradation of stretch-flangeability.

Next, detailed description will be given of the dispertion in the hardness distribution in the steel sheet with reference to FIG. 1. FIG. 1 is a graph showing a relationship between hardness classified into a plurality of levels and a number of measurement values in each level, which is obtained by converting each measurement value while a difference between a maximum hardness measurement value and a minimum hardness measurement value of the hardness is regarded as 100%, in relation to an example of a high-strength steel sheet according to the present invention. In the graph shown in FIG. 1, the horizontal axis represents hardness, and the vertical axis represents a number of measurement values in each level. In addition, a solid line of the graph shown in FIG. 1 is obtained by connecting the point representing the numbers of the measurement values in each level.

In the high-strength steel sheet of the present invention, it is preferable that all numbers of the measurement values in divided ranges D, which are obtained by equally dividing a range from the 2% hardness to the 98% hardness into 10 parts, in the graph shown in FIG. 1 be within a range from 2% to 30% of the number of all measurement values.

In such a high-strength steel sheet, the line joining up the numbers of the measurement values in the levels becomes a smooth curve with no steep peaks and valleys in the graph shown in FIG. 1, and the dispertion in the hardness distribution in the steel sheet is significantly reduced. Accordingly, such a high-strength steel sheet has less borders at which the regions with large hardness difference are in contact with each other, and excellent stretch-flangeability can be obtained.

In addition, if any of the numbers of the measurement values in a divided range D, which has been equally divided into 10 parts, is outside the range from 2% to 30% of the number of total measurement values in the graph shown in FIG. 1, the line joining up the numbers of the measurement values in the levels may easily include a steep peak or a valley, and an effect that stretch-flangeability is enhanced due to low dispertion in the hardness distribution in the steel sheet is reduced.

Specifically, for example, when only a number of the measurement values in a divided range D near the center exceeds 30% of the number of all measurement values among the equally divided 10 regions D, the line joining up the numbers of the measurement numbers in the levels has a peak in the divided range D near the center.

In addition, if only a number of the measurement values in the divided range D near the center are less than 2% of the number of all measurement values, the line joining up the numbers of the measurement values in the levels has a valley in the divided range D near the center, and many structures have large hardness differences, in which the hardness in different divided ranges D arranged on both sides of the valley is included.

In the high-strength steel sheet of the present invention, all numbers of the measurement values in the divided ranges D are preferably 25% or less of the number of all measurement values, and more preferably 20% or less, in order to further enhance stretch-flangeability. In order to still further enhance stretch-flangeability, all numbers of the measurement values in the divided ranges D are preferably 4% or more of the number of all measurement values, and more preferably 5% or more.

Figure 2:
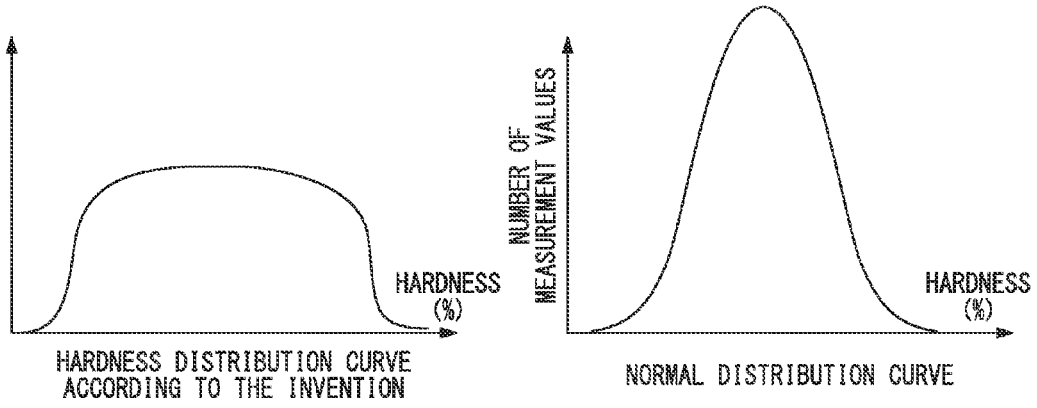
FIG. 2 is a diagram for comparing the hardness distribution in the high-strength steel sheet according to the present invention with a normal distribution.

The hardness distribution in the high-strength steel sheet of the present invention will be compared with a general normal distribution and described in detail. The kurtosis K* of the normal distribution is generally considered to be 0. On the other hand, the kurtosis of the hardness distribution in the steel sheet according to the present invention is −0.4 or less, and therefore, it is obvious that the distribution is different from the normal distribution. The hardness distribution in the steel sheet according to the present invention is flatter and has a wider bottom as compared with the normal distribution as shown in FIG. 2. Since the high-strength steel sheet of the present invention has such a hardness distribution, and the ratio of the 98% hardness to the 2% hardness, which correspond to both sides of the bottom of the distribution, is 1.5 or more times which is extremely large, the hardness difference between the soft part and the hard part in the steel sheet structure is sufficiently large, and high ductility can be obtained. That is, the present inventor found that the hole expanding property is further enhanced when the ratio between the 98% harness and the 2% hardness is larger in the hardness distribution in which the kurtosis is −0.4 or less unlike the conventional hardness distribution. On the other hand, the hole expanding property is considered to be further enhanced as the hardness ratio in the structure is smaller, according to the conventional technique. The conventional technique was based on the assumption of the hardness distribution which is close to the normal distribution, which is basically different from the technique proposed in the present invention.

(Mn Distribution)

In the high-strength steel sheet of the present invention, it is preferable that a difference between a maximum value and a minimum value of Mn concentration in the base iron at a thickness from ⅛ to ⅜ of the steel sheet be equal to or more than 0.40% and equal to or less than 3.50% when converted into a mass percentage in order to obtain the aforementioned hardness distribution.

The difference between the maximum value and the minimum value of the Mn concentration in the base iron at the thickness from ⅛ to ⅜ of the steel sheet is defined as 0.40% or more when converted into a mass percentage because phase transformation proceeds more slowly during continuous annealing after cold rolling as the difference between the maximum value and the minimum value of the Mn concentration is larger and it is possible to reliably generate each transformation product at a desired volume fraction and to thereby obtain the high-strength steel sheet with the aforementioned hardness distribution. More specifically, it is possible to generate a transformation product with relatively high hardness such as martensite in place of a transformation product with relatively low hardness such as ferrite in a balanced manner, and therefore, a sharp peak is not present in the hardness distribution in the high-strength steel sheet, that is, the kurtosis decrease, and a flat hardness distribution curve as shown in FIG. 1 can be obtained. In addition, the width of the hardness distribution is widened by generating various transformation products in a balanced manner, and it is thus possible to set the 98% hardness to be 1.5 or more times as high as the 2% hardness, preferably 3.0 or more times, more preferably more than 3.0 times, further more preferably 3.1 or more times, still further preferably 4.0 or more times, and still further preferably 4.2 or more times.

For example, transformation of a ferrite phase will be described as an example. In a heat treatment process for causing transformation of the ferrite phase, the phase transformation from austenite to ferrite starts relatively early in a region where the Mn concentration is low. On the other hand, the phase transformation from austenite to ferrite starts relatively slowly in the region where the Mn concentration is high as compared with the region where the Mn concentration is low. Therefore, the phase transformation from the austenite to ferrite proceeds more slowly in the steel sheet as the Mn concentration in the steel sheet is more non-uniform and the concentration difference is larger. In other words, a transformation rate, during a period when the volume percentage of the ferrite phase reaches, for example, 50% from 0%, becomes lower.

The above phenomenon similarly occurs in the tempered martensite phase and the remaining hard phase as well as the ferrite phase.

Figure 3:
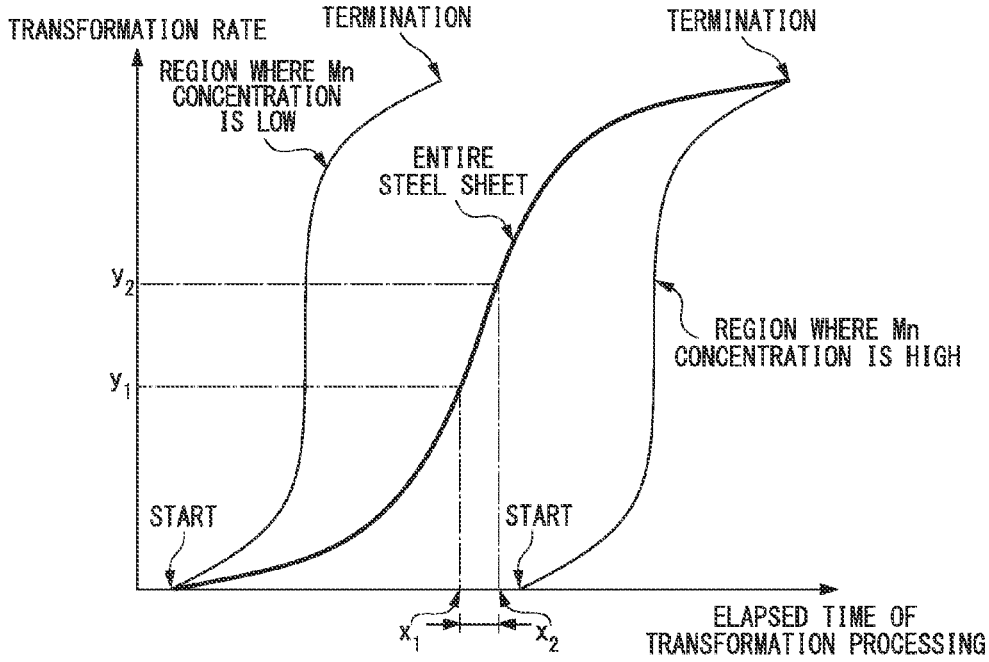
FIG. 3 is a graph schematically showing a relationship between a transformation rate and elapsed time of transformation treatment when the difference between a maximum value and a minimum value of Mn concentration in base iron is relatively large.
Figure 4:
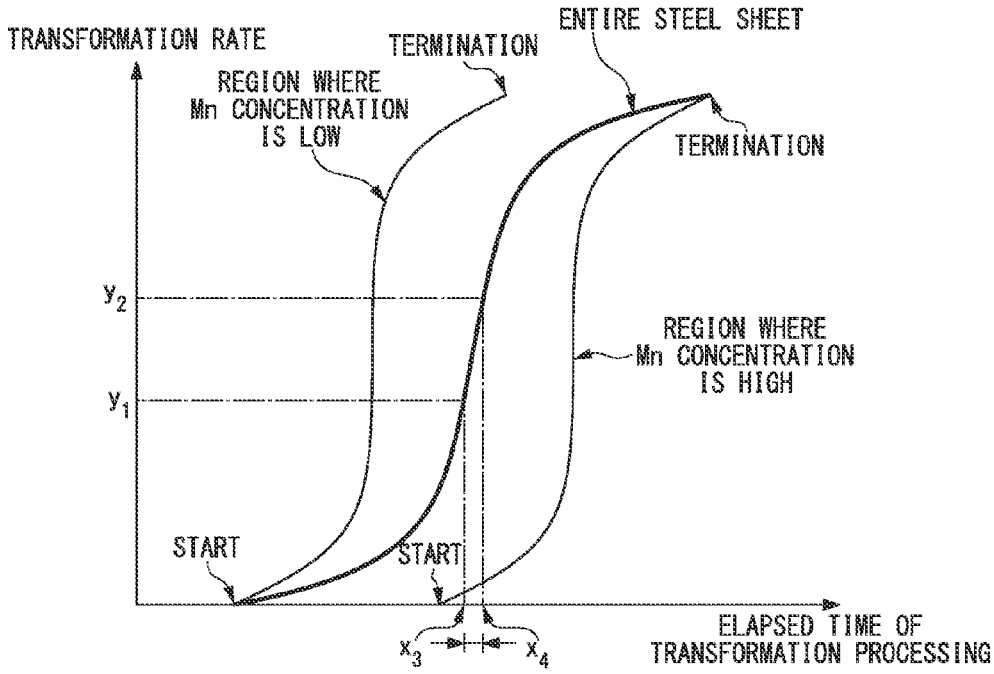
FIG. 4 is a graph schematically showing a relationship between a transformation rate and elapsed time of transformation treatment when a difference between a maximum value and a minimum value of Mn concentration in base iron is relatively small.

FIG. 3 schematically shows a relationship between a transformation rate and elapsed time of transformation treatment. In the case of the phase transformation from austenite to ferrite, for example, the transformation rate represents a volume percentage of ferrite in the steel sheet structure, and the elapsed time of the transformation treatment represents elapsed time of heat treatment for causing ferrite transformation. In the example of the present invention shown in FIG. 3, the difference between the maximum value and the minimum value of the Mn concentration is relatively large, and a gradient of the curve showing the transformation rate in the entire steel sheet is small (the transformation rate is low). On the other hand, in the comparative example shown in FIG. 4, the difference between the maximum value and the minimum value of the Mn concentration is relatively small, and the gradient of the curve showing the transformation rate in the entire steel sheet is large (the transformation rate is high). For this reason, although the transformation treatment may be terminated during a period from $x_1$ to $x_2$ in order to control the transformation rate (volume percentage) in a range from $y_1$ to $y_2$(%) in the example shown in FIG. 3, it is necessary to terminate the transformation treatment during a period from $x_3$ to $x_4$ and it is difficult to control treatment time in the example shown in FIG. 4.

When the difference in the Mn concentration is less than 0.40%, it is not possible to sufficiently suppress the transformation rate and achieve a sufficient effect, and therefore, this is set as the lower limit. The difference in the Mn concentration is preferably 0.60% or more, and more preferably 0.80% or more. Although the phase transformation can be more easily controlled as the difference in the Mn concentration is larger, it is necessary to excessively increase the amount of Mn added to the steel sheet in order that the difference in the Mn concentration exceeds 3.50%, and it is preferable that the difference in the Mn concentration be 3.50% or less since there is a concern of cracking of a cast slab and degradation of a welding property. In view of the welding property, the difference in the Mn concentration is more preferably 3.40% or less, and more preferably 3.30% or less.

A method of determining a difference between the maximum value and the minimum value of Mn at the thickness from ⅛ to ⅜ is as follows. First, a sample is obtained while a sheet thickness cross-section which is parallel to the rolling direction of the steel sheet is regarded as an observation surface. Then, EPMA analysis is performed in a thickness range from ⅛ to ⅜ around a thickness of ¼ to measure an Mn amount. The measurement is performed while a probe diameter is set to 0.2 to 1.0 vim and measurement time per one point is set to 10 ms or longer, and the Mn amounts are measured at 1000 or more points based on line analysis or surface analysis.

In the measurement results, points at which the Mn concentration exceeds three times the added Mn concentration are considered to be points at which inclusions such as manganese sulfide are observed. In addition, points at which the Mn concentration is less than ⅓ times the added Mn concentration are considered to be points at which inclusions such as aluminum oxide are observed. Since such Mn concentrations hardly affect the phase transformation behavior in the base iron, the maximum value and the minimum value of the Mn concentration are respectively obtained after the measurement results of the inclusions are excluded from the measurement results. Then, the difference between the thus obtained maximum value and minimum value of the Mn concentration is calculated.

The method of measuring the Mn amount is not limited to the above method. For example, an EMA method or direct observation using a three-dimensional atom probe (3D-AP) may be performed to measure the Mn concentration.

(Steel Sheet Structure)

In addition, the steel sheet structure of the high-strength steel sheet of the present invention includes 10 to 50% of a ferrite phase and 10 to 50% of a tempered martensite phase and a remaining hard phase by volume fractions. In addition, the remaining hard phase includes 10 to 60% of one of or both a bainitic ferrite phase and a bainite phase and 10% or less of a fresh martensite phase by volume fractions. Furthermore, the steel sheet structure may contain 2 to 25% of a retained austenite phase. When the high-strength steel sheet of the present invention has such a steel sheet structure, the hardness difference inside the steel sheet becomes much larger, the average crystal grain size becomes sufficiently small, and therefore, the high-strength steel sheet has further higher strength and excellent ductility and strength-flangeability (hole expanding property).

"Ferrite"

Ferrite is a structure which is effective in enhancing ductility and is preferably contained in the steel sheet structure at 10 to 50% by a volume fraction. The volume fraction of ferrite contained in the steel sheet structure is preferably 15% or more, and more preferably 20% or more in view of ductility. In addition, the volume fraction of ferrite contained in the steel sheet structure is preferably 45% or less, and more preferably 40% or less in order to sufficiently enhance the tensile strength of the steel sheet. When the volume fraction of ferrite is less than 10%, there is a concern that sufficient ductility may not be achieved. On the other hand, ferrite has a soft structure, and therefore, yield stress is lower in some cases when the volume fraction exceeds 50%.

"Bainitic Ferrite and Bainite"

Bainitic ferrite and bainite are structures with a hardness between the hardness of soft ferrite and the hardness of hard tempered martensite and fresh martensite. The high-strength steel sheet of the present invention may contain any one of bainitic ferrite and bainite or may contain both. In order to flatten the hardness distribution inside the steel sheet, a total amount of bainitic ferrite and bainite contained in the steel sheet structure is preferably 10 to 45% by volume fraction. The sum of volume fractions of bainitic ferrite and bainite contained in the steel sheet structure is preferably 15% or more, and more preferably 20% or more in view of stretch-flangeability. In addition, the sum of the volume fractions of bainitic ferrite and bainite is preferably 40% or less, or more preferably 35% or less in order to obtain a satisfactory balance between ductility and yield stress.

When the sum of the volume fractions of bainitic ferrite and bainite is less than 10%, bias occurs in the hardness distribution, and there is a concern that stretch-flangeability may be degraded. On the other hand, when the sum of the volume fractions of bainitic ferrite and bainite exceeds 45%, it becomes difficult to generate appropriate amounts of ferrite and tempered martensite, and the balance between ductility and yield stress is degraded, which is not preferable.

"Tempered Martensite"

Tempered martensite is a structure which greatly enhances the tensile strength and is preferably contained in the steel sheet structure at 10 to 50% by a volume fraction. When the volume fraction of tempered martensite contained in the steel sheet structure is less than 10%, there is a concern that sufficient tensile strength may not be obtained. On the other hand, when the volume fraction of the tempered martensite contained in the steel sheet structure exceeds 50%, it becomes difficult to secure ferrite and retained austenite necessary for enhancing ductility. In order to sufficiently enhance the ductility of the high-strength steel sheet, the volume fraction of tempered martensite is preferably 45% or less, and more preferably 40% or less. In addition, in order to secure tensile strength, the volume fraction of tempered martensite is preferably 15% or more, and more preferably 20% or more.

"Retained Austenite"

Retained austenite is a structure which is effective in enhancing ductility and is preferably contained in the steel sheet structure at 2 to 25% by a volume fraction. When the volume fraction of retained austenite contained in the steel sheet structure is 2% or more, more sufficient ductility can be obtained. In addition, when the volume fraction of retained austenite is 25% or less, the welding property is enhanced without a need for adding a large amount of austenite stabilizer such as C or Mn. In addition, although it is preferable that retained austenite be contained in the steel sheet structure of the high-strength steel sheet according to the present invention since retained austenite is effective in enhancing ductility, retained austenite may not be contained when sufficient ductility can be obtained.

"Fresh Martensite"

Since fresh martensite functions as a start point of fracture and degrades stretch-flangeability while fresh martensite greatly enhances tensile strength, fresh martensite is preferably contained in the steel sheet structure at 10% or less by a volume fraction. In order to enhance stretch-flangeability, the volume fraction of fresh martensite is preferably 5% or less, and more preferably 2% or less.

"Others"

The steel sheet structure of the high-strength steel sheet according to the present invention may contain structures such as pearlite and coarse cementite other than the above structures. However, when large amounts of pearlite and coarse cementite are contained in the steel sheet structure of the high-strength steel sheet, ductility is degraded. For this reason, the volume fraction of pearlite and coarse cementite contained in the steel sheet structure is preferably 10% or less in total, and more preferably 5% or less.

The volume fraction of each structure contained in the steel sheet structure of the high-strength steel sheet according to the present invention can be measured based on the following method, for example.

In relation to the volume fraction of retained austenite, X-ray analysis is performed while a surface at a thickness of ¼, which is parallel to the sheet surface of the steel sheet, is regarded as an observation surface, an area fraction is calculated, and the result thereof can be regarded as the volume fraction.

In relation to the volume fractions of ferrite, bainitic ferrite, bainite, tempered martensite, and fresh martensite, a sample is obtained while a sheet thickness cross-section which is parallel to the rolling direction of the steel sheet is regarded as an observation surface, the observation surface is ground, subjected to nital etching, and observed with a Field Emission Scanning Electron Microscope (FE-SEM) in a thickness range from ⅛ to ⅜ around ¼ of the sheet thickness to measure area fractions, and the results thereof can be regarded as the volume fractions.

In addition, an area of the observation surface observed with the FE-SEM can be a 30 μm sided square, for example, and each structure in the observation surface can be distinguished from each other as follows.

Ferrite is a lump of crystal grains and is a region inside which iron carbide with a long diameter of 100 nm or more is not present. In addition, the volume fraction of ferrite is a sum of the volume fraction of ferrite remaining at the highest heating temperature and the volume fraction of ferrite which is newly produced in a ferrite transformation temperature range. However, it is difficult to directly measure the volume fraction of ferrite during the production. For this reason, a small piece of the cold-rolled steel sheet before passing though the continuous annealing line is cut, the small piece is annealed based on the same temperature history as that when the small piece is made to pass through the continuous annealing line, dispertion in the volume of ferrite in the small piece is measured, and a numerical value calculated with the use of the result is regarded as the volume fraction, in the present invention.

In addition, bainitic ferrite is a group of lath-shaped crystal grains, and iron carbide with a long diameter of 20 nm or more is not contained inside the lath.

In addition, bainite is a group of lath-shaped crystal grains, and a plurality of compounds of iron carbide with a long diameter of 20 nm or more is contained inside the lath, and carbide belongs to a single variant, namely an iron carbide group extending in a same direction. Here, the iron carbide group extending in the same direction denotes that the differences in the extending direction of the iron carbide group are within 5°.

In addition, tempered martensite is a group of lath-shaped crystal grains, a plurality of compounds of iron carbide with a long diameter of 20 nm or more is contained inside the lath, and carbide belongs to a plurality of variants, namely a plurality of iron carbide groups extending in different directions.

Moreover, bainite and tempered martensite can be easily distinguished from each other by observing iron carbide inside the lath-shaped crystal grain using the FE-SEM and examining the extending directions thereof.

In addition, fresh martensite and retained austenite are not sufficiently eroded by the nital etching. Therefore, fresh martensite and retained austenite are apparently distinguished from the aforementioned structures (ferrite, bainitic ferrite, bainite, tempered martensite) in the observation with the FE-SEM.

Accordingly, the volume fraction of fresh martensite is obtained as a difference between an area fraction of a region observed with the FE-SEM, which has not yet been eroded, and an area fraction of retained austenite measured with X rays.

(Concerning Definition of Chemical Compositions)

Next, description will be given of chemical constituents (compositions) of the high-strength steel sheet of the present invention. In addition, [%] in the following description represents [mass %].

"C: 0.050 to 0.400%"

C is contained in order to enhance the strength of the high-strength steel sheet. However, if the C content exceeds 0.400%, a sufficient welding property is not obtained. In view of the welding property, the C content is preferably 0.350% or less, and more preferably 0.300% or less. On the other hand, if the C content is less than 0.050%, the strength is lowered, and it is not possible to secure the maximum tensile strength of 900 MPa or more. In order to enhance the strength, the C content is preferably 0.060% or more, and more preferably 0.080% or more.

"Si: 0.10 to 2.50%"

Si is added in order to suppress temper softening of martensite and enhance the strength of the steel sheet. However, if the Si content exceeds 2.50%, embrittlement of the steel sheet is caused, and ductility is degraded. In view of ductility, the Si content is preferably 2.20% or less, and more preferably 2.00% or less. On the other hand, if the Si content is less than 0.10%, hardness of tempered martensite is lowered to a large degree, and it is not possible to secure a maximum tensile strength of 900 MPa or more. In order to enhance the strength, the lower limit value of Si is preferably 0.30% or more, and more preferably 0.50% or more.

"Mn: 1.00 to 3.50%"

Since Mn is an element which enhances the strength of the steel sheet, and it is possible to control the hardness distribution in the steel sheet by controlling the Mn distribution in the steel sheet, Mn is added to the steel sheet of the present invention. However, if the Mn content exceeds 3.50%, a coarse Mn concentrated part is generated at the center in the sheet thickness of the steel sheet, embrittlement easily occurs, and problems such as cracking of a cast slab easily occur. In addition, if the Mn content exceeds 3.50%, the welding property is also degraded. For this reason, it is necessary that the Mu content be 3.50% or less. In view of the welding property, the Mn content is preferably 3.20% or less, and more preferably 3.00% or less. On the other hand, if the Mn content is less than 1.00%, a large amount of soft structures are formed during cooling after annealing, which makes it difficult to secure the maximum tensile strength of 900 MPa or more, and therefore, it is necessary that the Mn content be 1.00% or more. In order to enhance the strength, the Mn content is preferably 1.30% or more, and more preferably 1.50% or more.

"P: 0.001 to 0.030%"

P tends to be segregated at the center in the sheet thickness of the steel sheet and brings about embrittlement of a welded part. If the P content exceeds 0.300%, significant embrittlement of the welded part occurs, and therefore the P content is limited to 0.030% or less. Although the effects of the present invention can be achieved without particularly determining the lower limit of the P content, 0.001% is set as the lower limit value since manufacturing costs greatly increase when the P content is less than 0.001%.

"S: 0.0001 to 0.0100%"

S adversely affects the welding property and manufacturability during casting and hot rolling. For this reason, the upper limit of S content is set to 0.0100% or less. In addition, since S is bonded to Mn to form coarse MnS and lowers the stretch-flangeability, S is preferably contained at 0.0050% or less, and more preferably contained at 0.0025% or less. Although the effects of the present invention can be achieved without particularly determining the lower limit of S content, 0.0001% is set as the lower limit value since manufacturing costs greatly increase when the S content is less than 0.0001%.

"Al: 0.001% to 2.500%"

Al is an element which suppresses production of iron carbide and enhances the strength. However, if an Al content exceeds 2.50%, a ferrite fraction in the steel sheet excessively increases, and the strength is rather lowered, therefore the upper limit of the Al content is set to 2.500%. The Al content is preferably 2.000% or less, and more preferably 1.600% or less. Although the effects of the present invention can be achieved without particularly determining the lower limit of the Al content, 0.001% is set as the lower limit since an effect as a deoxidizing agent can be obtained when the Al content is 0.001% or more. In order to obtain sufficient effect as the deoxidizing agent, the Al content is preferably 0.005% or more, and more preferably 0.010% or more.

"N: 0.0001 to 0.0100%"

Since N forms coarse nitride and degrades the stretch-flangeability, it is necessary to suppress the added amount thereof. If the N content exceeds 0.0100%, this tendency is more evident, and therefore, the range of the N content is set to 0.0100% or less. In addition, since N causes a blow hole during welding in many cases, it is preferable that the amount of N is as small as possible. Although the effects of the present invention can be achieved without particularly determining the lower limit of the N content, 0.0001% is set as the lower limit value since manufacturing costs greatly increase when the N content is less than 0.0001%.

"O: 0.0001 to 0.0080%"

Since O forms oxide and degrades the stretch-flangeability, it is necessary to suppress the added amount thereof. If the O content exceeds 0.0080%, the degradation of the stretch-flangeability is more evident, and therefore, the upper limit of the O content is set to 0.0080% or less. The O content is preferably 0.0070% or less, and more preferably 0.0060% or less. Although the effects of the present invention can be achieved without particularly determining the lower limit of the O content, 0.0001% is set as the lower limit value since manufacturing costs greatly increase when the O content is less than 0.0001%.

The high-strength steel sheet of the present invention may further contain the following elements as necessary.

"Ti: 0.005 to 0.090%"

Ti is an element which contributes to enhancement of the strength of the steel sheet by precipitation strengthening, fine grain strengthening by suppressing growth of the ferrite crystal grains, and dislocation strengthening by suppressing recrystallization. However, if a Ti content exceeds 0.090%, the number of precipitate of carbonitride increases, formability is degraded, and therefore, the Ti content is preferably 0.090% or less. In view of the formability, the Ti content is preferably 0.080% or less, and more preferably 0.70% or less. Although the effects of the present invention can be achieved without particularly determining the lower limit of the Ti content, the Ti content is preferably 0.005% or more in order to sufficiently obtain the effect of Ti enhancing the strength. In order to further enhance the strength of the steel sheet, the Ti content is preferably 0.010% or more, and more preferably 0.015% or more.

"Nb: 0.005 to 0.090%"

Nb is an element which contributes to enhancement of the strength of the steel sheet by precipitation strengthening, fine grain strengthening by suppressing growth of ferrite crystal grains, and dislocation strengthening by suppressing recrystallization. However, if the Nb content exceeds 0.090%, the number of precipitate of carbonitride increases, formability is degraded, and therefore, the Nb content is preferably 0.090% or less. In view of formability, the Nb content is preferably 0.070% or less, and more preferably 0.050% or less. Although the effects of the present invention can be achieved without particularly determining the lower limit of the Nb content, the Nb content is preferably 0.005% or more in order to sufficiently obtain the effect of Nb enhancing the strength. In order to further enhance the strength of the steel sheet, the Nb content is preferably 0.010% or more, and more preferably 0.015% or more.

"V: 0.005 to 0.090%"

V is an element which contributes to enhancement of the strength of the steel sheet by precipitation strengthening, fine grain strengthening by suppressing growth of ferrite crystal grains, and dislocation strengthening by suppressing recrystallization. However, if the V content exceeds 0.090%, the number of precipitate of carbonitride increases, formability is degraded, and therefore, the Nb content is preferably 0.090% or less. Although the effects of the present invention can be achieved without particularly determining the lower limit of the V content, the V content is preferably 0.005% or more in order to sufficiently obtain the effect of V enhancing the strength.

"B: 0.0001 to 0.0100%"

Since B delays phase transformation from austenite in a cooling process after hot rolling, it is possible to effectively cause distribution of Mn to proceed by adding B. If the B content exceeds 0.0100%, workability at a high temperature deteriorates, productivity is lowered, and therefore, the B content is preferably 0.0100% or less. In view of the productivity, the B content is preferably 0.0050% or less, and more preferably 0.0030% or less. Although the effects of the present invention can be achieved without particularly determining the lower limit of the B content, the B content is preferably 0.0001% or more in order to sufficiently obtain the effect of B delaying the phase transformation. In order to delay the phase transformation, the B content is preferably 0.0003% or more, and more preferably 0.0005% or more.

"Mo: 0.01 to 0.80%"

Since Mo delays phase transformation from austenite in a cooling process after hot rolling, it is possible to effectively cause distribution of Mn to proceed by adding Mo. If the Mo content exceeds 0.80%, workability at a high temperature deteriorates, productivity is lowered, and therefore, the Mo content is preferably 0.80% or less. Although the effects of the present invention can be achieved without particularly determining the lower limit of the Mo content, the Mo content is preferably 0.01% or more in order to sufficiently obtain the effect of Mo delaying the phase transformation.

"Cr: 0.01 to 2.00%" "Ni: 0.01 to 2.00%" "Cu: 0.01 to 2.00%"

Cr, Ni, and Cu are elements which enhance contribution to the strength, and one kind or two or more kinds therefrom can be added instead of a part of C and/or Si. If the content of each element exceeds 2.00%, the acid pickling property, the welding property, the workability at a high temperature, and the like are degraded, and therefore, the content of Cr, Ni, and Cu is preferably 2.00% or less, respectively. Although the effects of the present invention can be achieved without particularly determining the lower limit of the content of Cr, Ni, and Cu, the content of Cr, Ni, and Cu is preferably 0.10% or more, respectively, in order to sufficiently obtain the effect of enhancing the strength of the steel sheet.

"Total Content of one kind or two or more kinds from Ca, Ce, Mg, and REM from 0.0001 to 0.5000%"

Ca, Ce, Mg, and REM are elements which are effective in enhancing formability, and it is possible to add one kind or two or more kinds therefrom. However, if the total amount of one or more of Ca, Ce, Mg, and REM exceeds 0.5000%, there is a concern that ductility may deteriorate, on the contrary, and therefore, the total content of the elements is preferably 0.5000% or less. Although the effects of the present invention can be achieved without particularly determining the lower limit of the content of one or more of Ca, Ce, Mg, and REM, the total content of the elements is preferably 0.0001% or more in order to sufficiently obtain the effect of enhancing formability of the steel sheet. In view of the formability, the total content of one or more of Ca, Ce, Mg, and REM is preferably 0.0005% or more, and more preferably 0.0010% or more. In addition, REM is an abbreviation for Rare Earth Metals and represents an element belonging to lanthanoid series. In the present invention, REM and Ce are added in the form of misch metal in many cases, and there is a case in which elements in the lanthanoid series are contained in combination in addition to La and Ce. Even if such elements in the lanthanoid series other than La and Ce are included as inevitable impurities, the effects of the present invention can be achieved. In addition, the effects of the present invention can be achieved even if metal La and Ce are added.

In addition, the high-strength steel sheet of the present invention may be configured as a high-strength zinc-coated steel sheet by forming a zinc-plated layer or an alloyed zinc-plated layer on the surface thereof. By forming the zinc-plated layer on the surface of the high-strength steel sheet, the high-strength steel sheet obtains excellent corrosion resistance. The high-strength steel sheet has excellent corrosion resistance, and excellent adhesion of a coating can be obtained, since the alloyed zinc-plated layer is formed on the surface thereof.

(Manufacturing Method of High-Strength Steel Sheet)

Next, description will be given of a manufacturing method of the high-strength steel sheet of the present invention.

Firstly, in order to manufacture the high-strength steel sheet of the present invention, slab containing the aforementioned chemical constituents (compositions) is firstly casted.

As the slab subjected to hot rolling, continuous cast slab or slab manufactured by a thin slab caster can be used. The manufacturing method of the high-strength steel sheet of the present invention can be adapted to a process such as continuous casting-direct rolling (CC-DR) in which hot rolling is performed immediately after the casting.

In the hot rolling process, it is necessary that a slab heating temperature be 1050° C. or higher. If the slab heating temperature is excessively low, a finish rolling temperature is below an $Ar_3$ transformation temperature, two phase region rolling of ferrite and austenite is performed, a hot-rolled sheet structure becomes a duplex grain structure in which non-uniform grains are mixed, the non-uniform structure remains even after cold rolling and annealing processes, and therefore, ductility and bendability are degraded. In addition, since lowering of the finish rolling temperature causes excessive increase in rolling load, and there is a concern that it may become difficult to perform rolling or a shape of the steel sheet after the rolling may be defective, it is necessary that the slab heating temperature be 1050° C. or higher. Although the effects of the present invention can be achieved without particularly determining the upper limit of the slab heating temperature, it is preferable that the upper limit of the slab heating temperature be 1350° C. or lower since setting of an excessively high heating temperature is not economically preferable.

In addition, the $Ar_3$ temperature is calculated based on the following equation.

$$Ar_3=901-325\times C+33\times Si-92\times(Mn+Ni/2+Cr/2+Cu/2+Mo/2)+52\times Al$$

In the above equation, C, Si, Mn, Ni, Cr, Cu, Mo, and Al represent content [mass %] of the elements.

In relation to the finish rolling temperature of the hot rolling, a higher temperature among 800° C. and the $Ar_3$ point is set as a lower limit thereof, and 1000° C. is set as an upper limit thereof. If the finish rolling temperature is lower than 800° C., the rolling load during the finish rolling increases, and there is a concern that it may become difficult to perform the hot rolling or the shape of the hot-rolled steel sheet obtained after the hot rolling may be defective. In addition, if the finish rolling temperature is lower than the $Ar_3$ point, the hot rolling becomes two phase region rolling of ferrite and austenite, and the structure of the hot-rolled steel sheet becomes a structure in which non-uniform grains are mixed.

On the other hand, although the effects of the present invention can be achieved without particularly determining the upper limit of the finish rolling temperature, it is necessary to set the slab heating temperature to an excessively high temperature when the finish rolling temperature is set to an excessively high temperature in order to secure the finish rolling temperature. For this reason, it is preferable that the upper limit temperature of the finish rolling temperature be 1000° C. or lower.

A winding process after the hot rolling and a cooling process before and after the winding process are significantly important to distribute Mn. The above Mn distribution in the steel sheet can be obtained by causing the micro structure during slow cooling after the winding to be a two phase structure of ferrite and austenite and performing processing thereon at a high temperature for long time to cause Mn to be diffused from ferrite to austenite.

In order to control the distribution of the Mn concentration in the base iron at the thickness from ⅛ to ⅜ of the steel sheet, it is necessary that the volume fraction of austenite is 50% or more at the thickness from ⅛ to ⅜ when the steel sheet is wound up. If the volume fraction of austenite at the thickness from ⅛ to ⅜ is less than 50%, austenite disappears immediately after the winding due to progression of the phase transformation, and therefore, the Mn distribution does not sufficiently proceed, and the above Mn concentration distribution in the steel sheet cannot be obtained. In order that the Mn distribution effectively proceeds, the volume fraction of austenite is preferably 70% or more, and more preferably 80% or more. On the other hand, if the volume fraction of austenite is 100%, the phase transformation proceeds after the winding, ferrite is produced, the Mn distribution is started, and therefore the upper limit is not particularly provided for the volume fraction of austenite.

In order to enhance the austenite fraction when the steel sheet is wound up, it is necessary that the cooling rate during a period from completion of the hot rolling to the winding be 10° C./second or higher on average. If the cooling rate is lower than 10° C./second, ferrite transformation proceeds during the cooling, and there is a possibility that the volume fraction of austenite during the winding may become less than 50%. In order to enhance the volume fraction of austenite, the cooling rate is preferably 13° C./second or higher, and more preferably 15° C./second or higher. Although the effects of the present invention can be achieved without particularly determining the upper limit of the cooling rate, it is preferable that the cooling rate be 200° C./second or lower since a special facility is required to obtain a cooling rate of higher than 200° C./second and manufacturing costs significantly increase.

Since a thickness of oxide formed on the surface of the steel sheet excessively increases and the acid pickling property is degraded if the steel sheet is wound up at a temperature which exceeds 800° C., the winding temperature is set to 750° C. or lower. In order to enhance the acid pickling property, the winding temperature is preferably 720° C. or lower, and more preferably 700° C. or lower. On the other hand, if the winding temperature is lower than Bs point, the strength of the hot-rolled steel sheet is excessively enhanced, it becomes difficult to perform cold rolling, and therefore, the winding temperature is set to the Bs point or higher. In addition, the winding temperature is preferably 500° C. or higher, more preferably 550° C. or higher, and further more preferably 600° C. or higher in order to enhance the austenite fraction after the winding.

Moreover, since it is difficult to directly measure the volume fraction of austenite during the production, a small piece is cut from the slab before the hot rolling, the small piece is rolled or compressed at the same temperature and rolling reduction as those in the final pass of the hot rolling and cooled with water immediately after cooling at the same cooling rate as that during a period from the hot rolling and the winding, phase fractions of the small piece are measured, and a sum of the volume fractions of as-quenched martensite, tempered martensite, and retained austenite is regarded as a volume fraction of austenite during the winding, in determining the volume fraction of austenite during the winding according to the present invention.

The cooling process of the steel sheet after the winding is important to control the Mn distribution. The Mn distribution according to the present invention can be obtained by cooling the steel sheet from the winding temperature to (winding temperature−100)° at a rate of 20° C./hour or lower while the austenite fraction is set to 50% or more during the winding and the following equation (3) is satisfied. Equation (3) is an index representing the degree of progression of the Mn distribution between ferrite and austenite and represents that the Mn distribution further proceeds as the value of the left side becomes greater. In order to further cause the Mn distribution to proceed, the value of the left side is preferably 2.5 or more, and more preferably 4.0 or more. Although the effects of the present invention can be achieved without particularly determining the upper limit of the value of the left side, it is preferable that the upper limit is 50.0 or less since it is necessary to retain heat for long time to keep the value over 50.0 and the manufacturing costs significantly increase.

[Equation 3]

$$\left[\int_{T_{c-100}}^{T_c} 9.47\times10^5\cdot\exp\left(-\frac{18480}{T+273}\right)\cdot t(T)\cdot dT\right]^{0.5} \geq 1.0 \quad (3)$$

Tc: winding temperature (° C.)

T: steel sheet temperature (° C.)

t(T): maintaining time at temperature T (second)

In order to cause the Mn distribution to proceed between ferrite and austenite, it is necessary to maintain a state where both the two phases coexist. If the cooling rate from the winding temperature to (winding temperature−100)° C. exceeds 20° C./hour, the phase transformation excessively proceeds, austenite in the steel sheet may disappear, and therefore, the cooling rate from the winding temperature to (winding temperature−100)° C. is set to 20° C./hour or lower. In order to cause the Mn distribution to proceed, the cooling rate from the winding temperature to (winding temperature−100)° C. is preferably 17° C./hour or lower, and more preferably 15° C./hour or lower. Although the effects of the present invention can be achieved without particularly determining the lower limit of the cooling rate, it is preferable that the lower limit be 1° C./hour or higher since it is necessary to perform heat retaining for a long period of time in order to keep the cooling rate at lower than 1° C./hour and the manufacturing costs significantly increase.

In addition, the steel sheet may be reheated after the winding within a range of satisfying Equation (3) and the cooling rate.

Acid pickling is performed on the thus manufactured hot-rolled steel sheet. Acid pickling is important to enhance a phosphatability of the cold-rolled high-strength steel sheet as a final product and a hot dipping zinc-plating property of the cold-rolled steel sheet for a galvanized steel sheet or a galvannealed a steel sheet since oxide on the surface of the steel sheet can be removed by pickling. In addition, the acid pickling may be performed once or a plurality of times.

Next, the hot-rolled steel sheet after the acid pickling is subjected to cold rolling at rolling reduction from 35 to 80% and is made to pass through a continuous annealing line or a continuous galvanizing line. By setting the rolling reduction to 35% or higher, it is possible to maintain the flattened shape and enhance the ductility of the final product.

In order to enhance the stretch-flangeability, it is preferable that regions where the Mn concentration is high and regions where the Mn concentration is low have a narrow distribution in distributing Mn in the subsequent process. In order to do so, it is effective to increase the rolling reduction during the cold rolling, recrystallize ferrite during temperature increase, and make grain diameters be fine. In such a viewpoint, the rolling reduction is preferably 40% or higher, and more preferably 45% or higher.

On the other hand, in the case of cold rolling at the rolling reduction of 80% or lower, the cold rolling load is not excessively large, and it is not difficult to perform the cold rolling. For this reason, the upper limit of the rolling reduction is set to 80% or lower. In view of the cold rolling load, the rolling reduction is preferably 75% or lower.

In addition, the effects of the present invention can be achieved without particularly determining the number of rolling passes and rolling reduction of each pass. In addition, the cold rolling may be omitted.

Next, the obtained cold-rolled steel sheet is caused to pass through the continuous annealing line to manufacture the high-strength cold-rolled steel sheet. In relation to a process in which the cold-rolled steel sheet is caused to pass through the continuous annealing line, a detailed description will be given of a temperature history of the steel sheet when the steel sheet is caused to pass through the continuous annealing line, with reference to FIG. 5.

Figure 5:
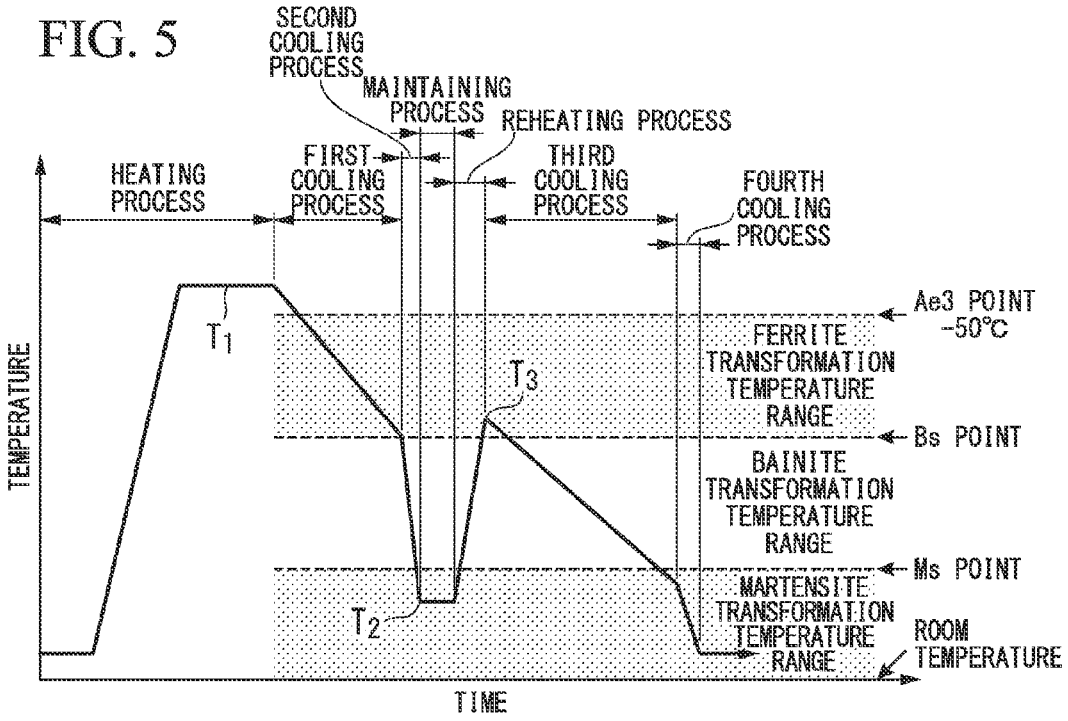
FIG. 5 is a graph illustrating temperature history of a cold-rolled steel sheet when the sheet is made to pass through a continuous annealing line, which shows a relationship between the temperature of the cold-rolled steel sheet and time.

FIG. 5 is a graph illustrating the temperature history of the cold-rolled steel sheet when the cold-rolled steel sheet is caused to pass through the continuous annealing line, which is a graph showing the relationship between the temperature of the cold-rolled steel sheet and time. In FIG. 5, a range from (the Ae3 point −50° C.) to the Bs point is shown as a "ferrite transformation temperature region", a range from the Bs point to the Ms point is shown as the "bainite transformation temperature range", and a range from the Ms point to a room temperature is shown as the "martensite transformation temperature range".

In addition, the Bs point is calculated based on the following equation:

$$\text{Bs point [° C.]}=820-290\,C/(1-VF)-37Si-90Mn-65Cr-50Ni+70Al$$

In the above equation, VF represents the volume fraction of ferrite, and C, Mn, Cr, Ni, Al, and Si represent added amounts [mass %] of the elements.

In addition, the Ms point is calculated based on the following equation:

$$\text{Ms point [° C.]}=541-474\,C/(1-VF)-15Si-35Mn-17Cr-17Ni+19Al$$

In the above equation, VF represents a volume fraction of ferrite, C, Si, Mn, Cr, Ni, and Al represent added amounts [mass %] of the elements. In addition, since it is difficult to directly measure the volume fraction of ferrite during the production, a small piece of the cold-rolled steel sheet before the cold-rolling sheet is made to pass through the continuous annealing line is cut and annealed based on the same temperature history as that when the small piece is caused to pass through the continuous annealing line, dispertion in the volume of ferrite in the small piece is measured, and a numerical value calculated using the result of the measurement is regarded as the volume fraction VF of ferrite, in determining the Ms point in the present invention.

As shown in FIG. 5, a heating process for annealing the cold-rolled steel sheet at a maximum heating temperature ($T_1$) ranging from 750° C. to 1000° C. is firstly performed in causing the cold-rolled steel sheet to pass through the continuous annealing line. If the maximum heating temperature $T_1$ in the heating process is lower than 750° C., the amount of austenite is insufficient, and it is not possible to secure a sufficient amount of hard structures in the phase transformation during the subsequent cooling. From this viewpoint, the maximum heating temperature $T_1$ is preferably 770° C. or higher. On the other hand, if the maximum heating temperature $T_1$ exceeds 1000° C., the grain diameter of austenite becomes coarse, the transformation hardly proceeds during the cooling, and it becomes difficult to sufficiently obtain a soft ferrite structure, in particular. From this viewpoint, the maximum heating temperature $T_1$ is preferably 900° C. or lower.

Next, a first cooling process for cooling the cold-rolled steel sheet from the maximum heating temperature $T_1$ to the ferrite transformation temperature range or lower is performed as shown in FIG. 5. In the first cooling process, the cold-rolled steel sheet is maintained in the ferrite transformation temperature range for 20 seconds to 1000 seconds. In order to sufficiently produce a soft ferrite structure, it is necessary that the cold-rolled steel sheet be maintained for 20 seconds or longer in the ferrite transformation temperature range in the first cooling process, and the cold-rolled steel sheet is preferably maintained for 30 seconds or longer, and more preferably maintained for 50 seconds or longer. On the other hand, if the time during which the cold-rolled steel sheet is maintained in the ferrite transformation temperature range exceeds 1000 seconds, the ferrite transformation excessively proceeds, an amount of untransformed austenite decreases, and it is not possible to sufficiently obtain a hard structure.

In addition, a second cooling process in which the cold-rolled steel sheet after being maintained in the ferrite transformation temperature range for 20 seconds to 1000 seconds to cause ferrite transformation in the first cooling process is cooled at a second cooling rate and the cooling is stopped within a range from the Ms point −120° C. to the Ms point (the martensite transformation start temperature) is performed as shown in FIG. 5. By performing the second cooling process, it is possible to cause the martensite transformation of the untransformed austenite to proceed.

If the second cooling stop temperature $T_2$ at which the second cooling process is stopped exceeds the Ms point, martensite is not produced. On the other hand, if the second cooling stop temperature $T_2$ is lower than the Ms point−120° C., most parts of the untransformed austenite become martensite, and it is not possible to obtain a sufficient amount of bainite in the subsequent processes. In order to cause a sufficient amount of untransformed austenite to remain, the second cooling process stop temperature $T_2$ is preferably the Ms point−80° C. or higher, and more preferably the Ms point−60° C. or higher.

In addition, it is preferable to prevent the bainite transformation from excessively proceeding in the bainite transformation temperature range, which is a temperature range between the ferrite transformation temperature range and the martensite transformation temperature range, in cooling the steel sheet from the ferrite transformation temperature range to the martensite transformation temperature range at the second cooling rate in the second cooling process. For this reason, it is necessary to set the second cooling rate in the bainite transformation temperature range to 10° C./second or higher on average, and the second cooling rate is preferably 20° C./second or higher, and more preferably 50° C./second or higher.

After performing the second cooling process which stops the cooling in a range from the Ms point−120° C. to the Ms point, as shown in FIG. 5, a maintaining process in which the steel sheet is maintained within a range from the second cooling stop temperature to the Ms point for 2 seconds to 1000 seconds in order to cause the martensite transformation to further proceed is performed. In the maintaining process, it is necessary to maintain the steel sheet for 2 seconds or longer in order to cause the martensite transformation to sufficiently proceed. If the time during which the steel sheet is maintained exceeds 1000 seconds in the maintaining process, hard lower bainite is produced, an amount of untransformed austenite is reduced, and bainite with a hardness which is close to that of ferrite cannot be obtained.

Moreover, after maintaining the steel sheet in within the range from the second cooling stop temperature to the Ms point and causing the martensite transformation to proceed as shown in FIG. 5, a reheating process for reheating the steel sheet is performed in order to produce bainite with a hardness between the hardness of ferrite and the hardness of martensite. A temperature $T_3$ (reheating stop temperature) at which the reheating is stopped in the reheating process is set to the Bs point (Bainite transformation start temperature (the upper limit of the bainite transformation temperature range))−100° C. or higher in order to reduce the dispertion in the hardness distribution in the steel sheet.

In order to further reduce the dispertion in the hardness distribution in the steel sheet, it is preferable to produce soft bainite with a small hardness different from that of ferrite. In order to produce soft bainite, the bainite transformation is preferably caused to proceed at a temperature which is as high as possible. Accordingly, the reheating stop temperature $T_3$ is preferably the Bs point−60° C. or higher, and is more preferably the Bs point or higher as shown in FIG. 5.

In the reheating process, it is necessary that the rate of temperature increase in the bainite transformation temperature range be 10° C./second or higher on average, and the rate of temperature increase is preferably 20° C./second or higher, and more preferably 40° C./second or higher. Since the bainite transformation excessively proceeds in a state of the low temperature range if the rate of temperature increase in the bainite transformation temperature range is low in the reheating process, hard bainite with a large hardness difference from that of ferrite is easily produced, and soft bainite with a small hardness difference from that of ferrite, which can reduce the dispertion in the hardness distribution in the steel sheet, is not easily produced. Accordingly, it is preferable that the rate of temperature increase in the bainite transformation temperature range be high in the reheating process.

According to this embodiment, a sum (total maintaining time) of the time during which the steel sheet is maintained in the bainite transformation temperature range in the second cooling process and the time during which the steel sheet is maintained in the bainite transformation range in the reheating process is preferably 25 seconds or shorter, and more preferably 20 seconds or shorter, in order to suppress the excessive progression of the bainite transformation in the second cooling process and the reheating process.

In addition, a third cooling process for cooling the steel sheet from the reheating stop temperature T3 to a temperature which is lower than the bainite transformation temperature range is performed after the reheating process as shown in FIG. 5. In the third cooling process, the steel sheet is maintained in the bainite transformation temperature range for 30 seconds or longer in order to cause the bainite transformation to proceed. In order to obtain a sufficient amount of bainite, the steel sheet is preferably maintained in the bainite transformation temperature range for 60 seconds or longer in the third process, and more preferably maintained for 120 seconds or longer. Although the upper limit of the time during which the steel sheet is maintained in the bainite transformation temperature range in the third cooling process is not particularly provided, the upper limit is preferably 2000 seconds or shorter, and more preferably 1000 seconds or shorter. If the time during which the steel sheet is maintained in the bainite transformation temperature range is 2000 seconds or shorter, it is possible to cool the steel sheet to the room temperature before completion of the bainite transformation of untransformed austenite and to thereby further enhance the yield stress and the ductility of the high-strength cold-rolled steel sheet by changing the untransformed austenite into martensite or retained austenite.

Moreover, a fourth cooling process for cooling the steel sheet from the temperature which is lower than the bainite transformation temperature range to room temperature is performed after the third cooling process as shown in FIG. 5. Although the cooling rate in the fourth cooling process is not particularly defined, it is preferable that the average cooling rate be 1° C./second or higher in order to change untransformed austenite into martensite or retained austenite.

As a result of the above processes, it is possible to obtain a high-strength cold-rolled steel sheet with high ductility and high stretch-flangeability.

Furthermore, a high-strength zinc-coated steel sheet may also be obtained in the present invention by performing zinc electroplating on the high-strength cold-rolled steel sheet obtained by causing the steel sheet to pass through the continuous annealing line based on the aforementioned method.

In addition, the high-strength zinc-coated steel sheet may also be manufactured in the present invention by the following method using the cold-rolled steel sheet obtained based on the above method.

That is, the high-strength zinc-coated steel sheet can be manufacturing in the same manner as the aforementioned case in which the cold-rolled steel sheet is caused to pass through the continuous annealing line except that the cold-rolled steel sheet is dipped into a zinc plating bath in the reheating process.

In so doing, it is possible to obtain the high-strength zinc-coated steel sheet with high ductility and high stretch-flangeability, the surface of which includes a zinc-plated layer formed thereon.

Furthermore, when the cold-rolled steel sheet is dipped into the zinc plating bath in the reheating process, the plated layer on the surface may be alloyed by setting the reheating stop temperature $T_3$ during the reheating process to 460° C. to 600° C. and performing alloying processing in which the cold-rolled steel sheet after being dipped into the zinc plating bath is maintained at the reheating stop temperature $T_3$ for two or more seconds.

By performing such alloying processing, Zn—Fe alloy obtained by alloying the zinc plating layer is formed on the surface, and the high-strength zinc-coated steel sheet with the alloyed zinc plated layer provided on the surface thereof can be obtained.

In addition, the manufacturing method of the high-strength zinc-coated steel sheet is not limited to the above example, and the high-strength zinc-coated steel sheet may be manufactured by performing the same processing as that in the aforementioned case in which the cold-rolled steel sheet is caused to pass through the continuous annealing line other than that the steel sheet is dipped into the zinc plating bath in the bainite transformation temperature range in the third cooling process, for example.

In so doing, the high-strength zinc-coated steel sheet with high ductility and high stretch-flangeability, the surface of which includes the zinc-plated layer formed thereon, can be obtained.

When the steel sheet is dipped into the zinc plating bath in the bainite transformation temperature range in the third cooling process, the plated layer on the surface may be alloyed by performing alloying processing in which the cold-rolled steel sheet after being dipped into the zinc plating bath is reheated again up to 460° C. to 600° C. and maintained for 2 seconds or longer.

Even when such alloying processing is performed, Zn—Fe alloy which is obtained by alloying the zinc plated layer is formed on the surface, and the high-strength zinc-coated steel sheet which includes the alloyed zinc plated layer on the surface thereof can be obtained.

In addition, rolling for shape correction may be performed on the cold-rolled steel sheet after the annealing in this embodiment. However, since work-hardening of the soft ferrite part occurs and the ductility is significantly degraded if the rolling reduction after the annealing exceeds 10%, the rolling reduction is preferably less than 10%.

In addition, the present invention is not limited to the above examples.

For example, plating of one or a plurality of Ni, Cu, Co, and Fe may be performed on the steel sheet before the annealing in order to enhance plating adhesion in the manufacturing method of the high-strength zinc-coated steel sheet according to the present invention.

EXAMPLES

Slab containing chemical constituents A to AQ shown in Tables 1, 2, 19, and 20 was cast, hot rolling was performed thereon under conditions (hot rolling slab heating temperature, finish rolling temperature) shown in Tables 3, 4, 21, 22, and 29, and winding was performed under conditions (cooling rate after rolling, winding temperature, cooling rate after winding) shown in Tables 3, 4, 21, 22, and 29. Then, after acid pickling, cold rolling was performed at "rolling reduction" shown in Tables 3, 21, and 22 to obtain the cold-rolled steel sheets with thicknesses in Experiment Examples a to bd and Experiment Examples ca to ds shown in Tables 3, 21, and 22. In addition, acid picking was performed after the winding, and cold rolling was not performed thereon to obtain the hot-rolled steel sheet with thicknesses in Experiment Examples dt to dz shown in Table 29.

Thereafter, the cold-rolled steel sheet in Experiment Examples a to bd and Experiment Examples ca to ds and the hot-rolled steel sheet in Experiment Examples dt to dz were caused to pass through the continuous annealing line to manufacture the steel sheets in Experiment Examples 1 to 134.

In causing the steel sheets to pass through the continuous annealing line, the high-strength cold-rolled steel sheets in Experiment Examples 1 to 134 were obtained based on the following method under conditions shown in Tables 5 to 12, 23 to 25, 30, and 31 (a maximum heating temperature in a heating process, maintaining time in a ferrite transformation temperature range in a first cooling process, a cooling rate in bainite transformation temperature range in a second cooling process, a cooling stop temperature in the second cooling process, maintaining time in a maintaining process, a rate of temperature increase in the bainite transformation temperature range and the reheating stop temperature in a reheating process, maintaining time in the bainite transformation temperature range in a third cooling process, the cooling rate in a fourth cooling process, a sum of a time during which the steel sheet is maintained in the bainite transformation temperature range in the second cooling process and a time during which the steel sheet is maintained in the bainite transformation range in the reheating process (total maintaining time)).

That is, the heating process for annealing the cold-rolled steel sheet in Experiment Examples a to bd and Experiment Examples ca to ds and the hot-rolled steel sheet in Experiment Examples dt to dz, the first cooling process for cooling the cold-rolled steel sheet from the maximum heating temperature to the ferrite transformation temperature range or lower, the second cooling process for cooling the cold-rolled steel sheet after the first cooling process, the maintaining process for maintaining the cold-rolled steel sheet after the second cooling process, the reheating process for reheating the cold-rolled steel sheet after the maintaining process up to the reheating stop temperature, the third cooling process for cooling the cold-rolled steel sheet after the reheating process from the reheating stop temperature to the temperature which is lower than the bainite transformation temperature range, in which the cold-rolled steel sheet is maintained in the bainite transformation temperature range for 30 seconds or longer, and the fourth cooling process for cooling the steel sheet from the temperature which is lower than the bainite transformation temperature range to the room temperature are performed.

As a result of the above processes, the high-strength cold-rolled steel sheets and the high-strength hot-rolled steel sheets in Experiment Examples 1 to 134 were obtained.

Thereafter, a part of Experiment Examples in which the steel sheets were caused to pass through the continuous annealing line, namely the cold-rolled steel sheets in Experiment Examples 60 to 63 were subjected to the zinc electroplating based on the following method to manufacture the zinc-electroplated steel sheet (EG) in Experiment Examples 60 to 63.

First, alkaline degreasing, rinsing with water, acid pickling, and rinsing with water were performed on the steel sheet, which had passed through the continuous annealing line, as pre-processing for plating. Thereafter, electrolytic treatment was performed on the steel sheet after the pre-processing using a liquid circulation type electroplating device with a plating bath containing zinc sulfate, sodium sulfate, and sulfuric acid at a current density of 100 $A/dm^2$ up to a predetermined plating thickness, and Zn plating was performed.

In relation to the cold-rolled steel sheets in Experiment Examples 64 to 68, the cold-rolled steel sheets were dipped into the zinc plating bath in the reheating process when the cold-rolled steel sheet was caused to pass through the continuous annealing line and the high-strength zinc-coated steel sheets were obtained.

In addition, in relation to the cold-rolled steel sheets in Experiment Examples 69 to 73, the cold-rolled steel sheets after being dipped into the zinc plating bath in the reheating process were subjected to the alloying processing, in which the cold-rolled steel sheets were maintained at the "reheating stop temperature $T_3$" shown in Table 11 for the "maintaining time" shown in Table 12 to alloy the plated layer on the surface thereof, and the high-strength zinc-coated steel sheets with alloyed zinc-plated layers were obtained.

In relation to the cold-rolled steel sheet in Experiment Examples 74 to 77, the cold-rolled steel sheets were dipped into the zinc plating bath in the third cooling process when the cold-rolled steel sheets were caused to pass through the continuous annealing line, and the high-strength zinc-coated steel sheets were obtained.

In relation to the cold-rolled steel sheets in Experiment Examples 78 to 82, the cold-rolled steel sheets after being dipped into the zinc plating bath in the third cooling process were subjected to the alloying process in which the cold-rolled steel sheets were reheated again up to the "alloying temperature Tg" shown in Table 12 and maintained for the "maintaining time" shown in Table 12 to alloy the plated layers on the surfaces thereof, and the high-strength zinc-coated steel sheets with alloyed zinc-plated layers were obtained.

In relation to the hot-rolled steel sheet in Experiment Example 130, the high-strength zinc-coated steel sheet with the alloyed zinc-plated layer was obtained by dipping the steel sheet which was made to pass through the continuous annealing line into the zinc plating bath, then performing thereon alloying processing in which the steel sheet was reheated again up to the "alloying temperature Tg" shown in Table 31 and maintained for the "maintaining time" shown in Table 31, and thereby alloyed the plated layer on the surface thereof.

In relation to the hot-rolled steel sheet in Experiment Example 132, the high-strength zinc-coated steel sheet with the alloyed zinc-plated layer was obtained by dipping the hot-rolled steel sheet into the zinc plating bath when the hot-rolled steel sheet was caused to pass through the continuous annealing line, performing thereon alloying processing in which the hot-rolled steel sheet was reheated again up to the "alloying temperature Tg" shown in Table 31 and maintained for the "maintaining time" shown in Table 31, and thereby alloying the plated layer on the surface thereof.

In relation to the hot-rolled steel sheet in Example 134, the steel sheet which was caused pass through the continuous annealing line was dipped into the zinc plating bath, and the high-strength zinc-coated steel sheet was obtained.

In relation to the thus obtained high-strength steel sheets in Experiment Examples 1 to 134, micro structures were observed, and volume fractions of ferrite (F), bainitic ferrite (BF), bainite (B), tempered martensite (TM), fresh martensite (M), and retained austenite (retained γ) were obtained based on the following method. In addition, "B+BF" in the tables represents a total volume fraction of ferrite and bainitic ferrite.

In relation to the volume fraction of retained austenite, an observation surface at a thickness of ¼, which was parallel to the plate surface of the steel sheet, was regarded as an observation surface, X-ray analysis was performed thereon, and an area fraction was calculated and regarded as the volume fraction thereof.

In relation to the volume fractions of ferrite, bainitic ferrite, bainite, tempered martensite, and fresh martensite, a sheet thickness cross-section which was parallel to the rolling direction of the steel sheet was regarded as an observation surface, a sample was collected therefrom, grinding and nital etching were performed on the observation surface, a region surrounded by sides of 30 μm was set at a thickness range from ⅛ to ⅜ around ¼ of the sheet thickness, the region was observed with FE-SEM, and area fractions were measured and regarded as the volume fractions thereof.

The results are shown in Tables 13, 14, 17, 26, and 32.

In relation to the high-strength steel sheets in Experiment Example 1 to 134, sheet thickness cross-section which were parallel to the rolling direction of the steel sheets were finished as mirror surfaces, and EPMA analysis was performed in a range from ⅛ to ⅜ around ¼ of the sheet thicknesses to measure the Mn amounts. The measurement was performed while the probe diameter was set to 0.5 μm and a measurement time for one point was set to 20 ms, and the Mn amounts were measured for 40000 points in the surface analysis. The results are shown in Tables 15, 16, 18, 27, 28, and 33. After removing inclusion measurement results from the measurement results, maximum values and minimum values of the Mn concentration were respectively obtained, and differences between the obtained maximum values and the minimum values of the Mn concentration were calculated. The results will be shown in Tables 15, 16, 18, 27, 28, and 33.

In relation to each of the high-strength steel sheets in Experiment Examples 1 to 134, "a ratio (H98/H2) of a measurement value of the 2% hardness (H2) with respect to a measurement value of the 98% hardness (H98), which was obtained by converting the measurement values while a difference between a maximum measurement value and a minimum measurement value of hardness was regarded as 100%, a kurtosis (K*) between the measurement value of the 2% hardness and the measurement value of the 98% hardness, an average crystal grain size, and whether or not the number of all measurement values in each divided range, which were obtained by equally dividing a range from the 2% hardness to the 98% hardness into 10 parts, were in a range from 2% to 30% of the number of all measurement values in a graph representing a relationship between the hardness classified into a plurality of levels and a number of measurement values in each level when each measurement value was converted while a difference between a maximum value and a minimum value of the hardness measurement values was regarded as 100%" were exemplified. The results are shown in Tables 15, 16, 18, 27, 28, and 33.

In addition, the hardness was measured using a dynamic micro-hardness tester provided with a Berkovich type three-sided pyramid indenter under an indentation load of 1 g based on an indentation depth measurement method. The hardness measurement position was set to a range from ⅛ to ⅜ around ¼ of the sheet thickness in the sheet thickness cross-section which was parallel to the rolling direction of the steel sheet. In addition, the number of measurement values (point number of indentations) was in the range from 100 to 10000 and preferably 1000 or more.

In addition, the average crystal grain size was measured using an EBSD (Electron BackScattering Diffraction) method. A crystal grain size observation surface was set a range from ⅛ to ⅜ around ¼ of the sheet thickness in the sheet thickness cross-section which was parallel to the rolling direction of the steel sheet. Then, a border, at which a crystal orientation difference between measurement points which were adjacent in the bcc crystal orientation on the observation surface was 15° or more, on the observation surface was regarded as a crystal grain boundary, and crystal grain size was measured. Then, the average crystal grain size was calculated by applying a intercept method to the result (map) of the obtained crystal grain boundary. The results are shown in Tables 13, 14, 17, 26, and 32.

Moreover, tensile test pieces based on JIS Z 2201 were collected from the high-strength steel sheets in Experiment Examples 1 to 134, tensile tests were performed thereon based on JIS Z 2241, and maximum tensile strength (TS) and ductility (EL) were measured. The results are shown in Tables 15, 16, 18, 27, 28, and 33.

As shown in Tables 15, 16, 18, 27, 28, and 33, it was confirmed that the measurement value of the 98% hardness was 1.5 or more times as high as the measurement value of the 2% hardness, that the kurtosis (K*) between the measurement value of the 2% hardness and the measurement value of the 98% hardness was −0.40 or less, that the average crystal grain size was 10 μm or less, and that the steel sheet had excellent maximum tensile strength (TS), ductility (EL), and stretch-flangeability (λ), in Examples of the present invention.

On the other hand, in Experiment Examples 9, 14, 17, 25, 30, 36, 39, 56 to 59, 85, 86, 89, 90, 93, 94, 101, 102, 117, 120, and 123 as Comparative Examples of the present invention, there was no steel sheet in which all the maximum tensile strength (TS), the ductility (EL), and the stretch-flangeability (λ) were sufficient as shown below. Particularly, in Experiment Example 102, the total of the volume fractions of bainite and bainitic ferrite was 50% or more, the K* value was −0.4 or more, that is, the hardness distribution was close to the normal distribution, and therefore, the ductility was low even at a hardness ratio of 4.2.

In Experiment Example 9, the maintaining time in the bainite transformation temperature range was short in the third cooling process in the continuous annealing line, and the bainite transformation did not sufficiently proceed. For this reason, the ratios of bainite and bainitic ferrite were low in Experiment Example 9, the kurtosis (K*) exceeded −0.40, the hardness distribution was not flat and had a "valley", and therefore, the stretch-flangeability λ deteriorated.

In Experiment Example 14, the rolling reduction in the cold rolling process was below the lower limit, and the degree of flatness of the steel sheet deteriorated. In addition, since the rolling reduction was low, recrystallization did not proceed in the continuous annealing line, the average crystal grain size became coarse, and therefore, the stretch-flangeability λ was lowered.

In Experiment Example 17, the maintaining time in the ferrite transformation temperature range was short in the first cooling process, and the ferrite transformation did not sufficiently proceed. For this reason, a fraction of soft ferrite was low, H98/H2 was below the lower limit, the hardness difference between the hard part and the soft part was small, and the ductility EL deteriorated, in Experiment Example 17.

In Experiment Example 25, since the maintaining time in the ferrite transformation temperature range was long, the ferrite transformation excessively proceeded. In Experiment Example 25, the cooling termination temperature exceeded the Ms point in the second cooling process, and tempered martensite was not sufficiently obtained. For this reason, the stretch-flangeability λ was lowered in Experiment Example 25.

In Experiment Example 30, the cooling termination temperature was below the lower limit in the second cooling process, and it was not possible to cause the bainite transformation to proceed in the third cooling process. For this reason, the ratios of bainite and bainitic ferrite were low, the hardness distribution has a "valley", and therefore, the stretch-flangeability λ deteriorated in Experiment Example 30.

In Experiment Example 36, the maximum heating temperature exceeded the upper limit, and the cooling termination temperature in the second cooling process was below the lower limit. For this reason, a fraction of tempered martensite increased, the soft structures such as ferrite were not present, and therefore, H98/H2 was below the lower limit, the hardness difference between the hard part and the soft part was small, and the ductility EL deteriorated, in Experiment Example 36.

Experiment Example 39 was an example in which the average cooling rate in the bainite transformation temperature range was low in the second cooling process and the bainite transformation excessively proceeded in the process. In Experiment Example 39, tempered martensite was not present, and therefore, the tensile strength TS was insufficient.

The chemical constituents of the steel sheets in Experiment Examples 56 to 59 were not within the range of definition.

More specifically, the C content in the steel W in Experiment Example 56 was below the lower limit defined in this invention. For this reason, the ratio of soft structure was high, and the tensile strength TS was insufficient, in Experiment Example 56.

In Experiment Example 57, the C content in the steel X exceeded the upper limit. For this reason, the rate of the soft structure was low, and the ductility EL was insufficient, in Experiment Example 57.

In Experiment Example 58, the Si content in the steel Y was below the lower limit. For this reason, the strength of tempered martensite was low, and the tensile strength TS was insufficient in Experiment Example 58.

In Experiment Example 59, the Mn content in the steel Z was below the lower limit. For this reason, a tempering property was significantly lowered, it was not possible to obtain tempered martensite and martensite which had soft structures, and therefore, the tensile strength TS was insufficient, in Experiment Example 59.

In Experiment Examples 85 and 102, the cooling rate from the completion of the hot rolling to the winding was below the lower limit. For this reason, the phase transformation excessively proceeded before the winding, most parts of austenite in the steel sheet disappeared, the Mn distribution did not proceed, and a predetermined micro structure was not obtained in the continuous annealing line, in Experiment Examples 85 and 102. For this reason, the kurtosis K* exceeds the upper limit, and the stretch-flangeability λ was insufficient.

In Experiment Example 86, the maintaining time in the maintaining process in the martensite transformation temperature range in the continuous annealing line was below the lower limit. For this reason, the ratio of tempered martensite was low, the kurtosis (K*) exceeded −0.40, the hardness distribution was not flat and had a "valley", and therefore, the stretch-flangeability λ was lowered, in Experiment Example 86.

In Experiment Example 89, the winding temperature was below the lower limit. For this reason, the Mn distribution did not proceed, and the predetermined micro structure was not obtained in the continuous annealing line in Experiment Example 89. For this reason, the kurtosis K* exceeded the upper limit, and the stretch-flangeability λ was insufficient.

In Experiment Example 90, the reheating stop temperature in the reheating process in the continuous annealing line was below the lower limit. For this reason, the hardness of produced bainite and bainitic ferrite excessively increased, the hardness difference between the hardness of ferrite and the hardness of bainite and bainitic ferrite increased, the kurtosis (K*) exceeded −0.40, the hardness distribution had a "valley", and therefore, the stretch-flangeability λ was lowered.

In Experiment Example 93, the cooling rate after the winding exceeded the upper limit. For this reason, the Mn distribution did not proceed, and the predetermined micro structure was not obtained in the continuous annealing line, in Experiment Example 93. Therefore, the kurtosis K* exceeded the upper limit, and the stretch-flangeability λ was insufficient.

In Experiment Example 94, the average rate of temperature increase in the bainite transformation temperature range in the reheating process in the continuous annealing line exceeded the upper limit. For this reason, the hardness of produced bainite and bainitic ferrite excessively increased, the hardness difference between the hardness of ferrite and the hardness of bainite and bainitic ferrite increased, the kurtosis (K*) exceeded −0.40, the hardness distribution had a "valley", and the therefore, the stretch-flangeability λ was lowered.

In Experiment Example 101, the maintaining time in the maintaining process in the martensite transformation temperature range in the continuous annealing line exceeded the upper limit. For this reason, hard lower bainite was produced, relatively soft bainite and/or bainitic ferrite was not obtained, the kurtosis (K*) exceeded −0.40, the hardness distribution had a "valley", and therefore, the stretch-flangeability λ was lowered.

In Experiment Example 117, the maximum heating temperature in the continuous annealing line exceeded the upper limit. For this reason, soft ferrite was not obtained, H98/H2 was below the lower limit, the hardness difference between the hard part and the soft part was small, and the ductility EL deteriorated, in Experiment Example 117.

In Example 120, the maximum heating temperature in the continuous annealing line was below the lower limit. For this reason, less hard structure was obtained, and the strength TS deteriorated, in Experiment Example 120.

In Experiment Example 123, the cooling stop temperature in the second cooling process in the continuous annealing line exceeded the upper limit. For this reason, tempered martensite was not obtained, the kurtosis (K*) exceeded −0.40, the hardness distribution had a "valley", and therefore, the stretch-flangeability λ was lowered, in Experiment Example 123.

INDUSTRIAL APPLICABILITY

Since the high-strength steel sheet of the present invention contains predetermined chemical constituents, the 98% hardness is 1.5 or more times as high as the 2% hardness, the kurtosis K* of the hardness distribution between the 2% hardness and the 98% hardness is −0.40 or less, the average crystal grain size in the steel sheet structure is 10 μm or less, and therefore, the steel sheet has excellent ductility and stretch-flangeability while tensile strength which is as high as 900 MPa or more is secured. Accordingly, the present invention can make very significant contributions to the industry since the strength of the steel sheet can be secured without degrading workability.

TABLE 1

| Experiment Example | C mass % | Si mass % | Mn mass % | P mass % | S mass % | Al mass % | N mass % | O mass % | |
|---|---|---|---|---|---|---|---|---|---|
| A | 0.185 | 1.32 | 2.41 | 0.006 | 0.0016 | 0.043 | 0.0039 | 0.0008 | Example |
| B | 0.094 | 1.79 | 2.65 | 0.012 | 0.0009 | 0.017 | 0.0020 | 0.0011 | Example |
| C | 0.128 | 1.02 | 2.87 | 0.022 | 0.0007 | 0.127 | 0.0028 | 0.0014 | Example |
| D | 0.234 | 0.85 | 2.15 | 0.005 | 0.0004 | 0.233 | 0.0016 | 0.0011 | Example |
| E | 0.167 | 1.38 | 2.16 | 0.013 | 0.0021 | 0.026 | 0.0030 | 0.0009 | Example |
| F | 0.219 | 1.47 | 1.82 | 0.007 | 0.0020 | 0.061 | 0.0025 | 0.0020 | Example |
| G | 0.242 | 0.50 | 2.37 | 0.007 | 0.0043 | 1.175 | 0.0040 | 0.0022 | Example |
| H | 0.124 | 1.65 | 2.14 | 0.005 | 0.0043 | 0.032 | 0.0050 | 0.0010 | Example |
| I | 0.104 | 2.28 | 1.95 | 0.018 | 0.0046 | 0.030 | 0.0023 | 0.0018 | Example |
| J | 0.076 | 1.82 | 2.48 | 0.018 | 0.0013 | 0.064 | 0.0056 | 0.0009 | Example |
| K | 0.197 | 0.78 | 2.82 | 0.005 | 0.0021 | 1.310 | 0.0054 | 0.0008 | Example |
| L | 0.159 | 1.09 | 3.01 | 0.005 | 0.0040 | 0.029 | 0.0028 | 0.0016 | Example |
| M | 0.088 | 2.06 | 2.50 | 0.020 | 0.0032 | 0.015 | 0.0034 | 0.0017 | Example |
| N | 0.080 | 1.52 | 2.01 | 0.022 | 0.0023 | 0.046 | 0.0032 | 0.0018 | Example |
| O | 0.172 | 1.33 | 2.67 | 0.014 | 0.0032 | 0.086 | 0.0039 | 0.0043 | Example |
| P | 0.223 | 0.38 | 3.02 | 0.009 | 0.0037 | 2.304 | 0.0015 | 0.0012 | Example |
| Q | 0.137 | 2.08 | 2.12 | 0.013 | 0.0045 | 0.075 | 0.0020 | 0.0015 | Example |
| R | 0.143 | 1.13 | 1.59 | 0.004 | 0.0041 | 0.020 | 0.0060 | 0.0021 | Example |
| S | 0.173 | 0.85 | 2.37 | 0.010 | 0.0004 | 1.526 | 0.0048 | 0.0023 | Example |
| T | 0.167 | 1.95 | 1.79 | 0.009 | 0.0032 | 0.091 | 0.0016 | 0.0016 | Example |
| U | 0.211 | 0.41 | 2.56 | 0.012 | 0.0043 | 0.683 | 0.0034 | 0.0023 | Example |
| V | 0.226 | 1.26 | 1.68 | 0.003 | 0.0029 | 0.746 | 0.0014 | 0.0010 | Example |
| W | 0.025 | 1.99 | 2.19 | 0.014 | 0.0039 | 0.046 | 0.0058 | 0.0021 | Comparative Example |
| X | 0.519 | 1.22 | 1.84 | 0.018 | 0.0047 | 0.036 | 0.0033 | 0.0010 | Comparative Example |
| Y | 0.175 | 0.03 | 2.14 | 0.019 | 0.0036 | 0.050 | 0.0034 | 0.0008 | Comparative Example |
| Z | 0.205 | 0.93 | 0.57 | 0.009 | 0.0037 | 0.099 | 0.0020 | 0.0015 | Comparative Example |

TABLE 2

| Experiment Example | Ti mass % | Nb mass % | B mass % | Cr mass % | Ni mass % | Cu mass % | Mo mass % | V mass % | Ca mass % | Ce mass % | Mg mass % | REM mass % | |
|---|---|---|---|---|---|---|---|---|---|---|---|---|---|
| A | | | | | | | | | | | | | Example |
| B | | | | | | | | | | | | | Example |
| C | | | | | | | | | 0.0016 | | | | Example |
| D | | | | | | | | | | 0.0013 | | | Example |
| E | 0.017 | | | | | | | | | | | | Example |
| F | 0.065 | | | | | | | | 0.0014 | 0.0007 | | | Example |
| G | | 0.046 | | | | | | | | | | | Example |
| H | 0.030 | | 0.0016 | | | | | | | | 0.0014 | | Example |
| I | | | 0.0034 | | | | | | | | | | Example |
| J | 0.021 | 0.019 | | | | | | | | | | | Example |
| K | | | | 0.31 | | | | | | | | | Example |
| L | | | | | 0.25 | | | | | | | | Example |
| M | | | | | | 0.42 | | | | | | | Example |
| N | | | | | | | 0.29 | | | | | | Example |
| O | | | | | | | | 0.071 | | | | | Example |
| P | 0.053 | | 0.0011 | | 0.18 | | | | 0.0032 | | | | Example |
| Q | | | | 0.42 | | | 0.22 | | | | | 0.0012 | Example |
| R | | | | | 1.29 | 0.10 | | | | 0.0013 | | | Example |
| S | 0.028 | | 0.0008 | 0.10 | 0.27 | 0.14 | 0.07 | | 0.0007 | 0.0009 | | | Example |
| T | | 0.027 | | 0.78 | | | | 0.086 | | | 0.0018 | | Example |
| U | 0.017 | 0.050 | | | | 0.60 | 0.10 | | | 0.0028 | | 0.0015 | Example |
| V | | | 0.0029 | 1.11 | 0.50 | | | 0.039 | 0.0018 | 0.0018 | | | Example |
| W | | | | | | | | | | | | | Comparative Example |
| X | | | | | | | | | | | | | Comparative Example |
| Y | | | | | | | | | | | | | Comparative Example |
| Z | | | | | | | | | | | | | Comparative Example |

TABLE 3

| Experiment Example | Chemical Constituent | Slab Heating Temperature ° C. | $Ar_3$ Transformation Point ° C. | Finish Rolling Temperature ° C. | Cooling Rate After Rolling ° C./second | Winding Temperature ° C. |
|---|---|---|---|---|---|---|
| a | A | 1230 | 665 | 909 | 48 | 630 |
| b | A | 1265 | 665 | 937 | 114 | 576 |
| c | A | 1210 | 665 | 916 | 32 | 674 |

TABLE 3-continued

| | | | | | | |
|---|---|---|---|---|---|---|
| d | B | 1245 | 687 | 909 | 48 | 526 |
| e | B | 1245 | 687 | 861 | 71 | 601 |
| f | B | 1255 | 687 | 851 | 19 | 606 |
| g | C | 1215 | 636 | 953 | 26 | 614 |
| h | C | 1240 | 636 | 902 | 77 | 617 |
| i | D | 1175 | 667 | 890 | 26 | 573 |
| j | D | 1165 | 667 | 890 | 61 | 528 |
| k | E | 1190 | 695 | 908 | 69 | 608 |
| l | E | 1205 | 695 | 918 | 29 | 654 |
| m | E | 1165 | 695 | 940 | 25 | 653 |
| n | F | 1225 | 714 | 865 | 36 | 561 |
| o | F | 1225 | 714 | 899 | 79 | 542 |
| p | G | 1210 | 682 | 929 | 67 | 555 |
| q | G | 1260 | 682 | 862 | 49 | 537 |
| r | H | 1165 | 720 | 897 | 14 | 581 |
| s | H | 1195 | 720 | 945 | 34 | 528 |
| t | H | 1170 | 720 | 903 | 38 | 663 |
| u | I | 1210 | 765 | 881 | 55 | 533 |
| v | I | 1175 | 765 | 924 | 26 | 613 |
| w | I | 1200 | 765 | 931 | 12 | 559 |
| x | J | 1260 | 712 | 901 | 72 | 627 |
| y | J | 1270 | 712 | 950 | 60 | 573 |
| z | K | 1210 | 657 | 916 | 64 | 547 |

| Experiment Example | Left Side of Equation (1) | Cooling Rate After Winding ° C./hour | Volume Fraction of Austenite volume % | Bs ° C. | Rolling Reduction % | Cold-rolled Sheet Thickness mm | |
|---|---|---|---|---|---|---|---|
| a | 11.2 | 14 | 82 | 492 | 50 | 1.6 | Example |
| b | 3 | 13 | 100 | 504 | 50 | 1.6 | Example |
| c | 29.2 | 15 | 90 | 498 | 68 | 0.8 | Example |
| d | 1.1 | 8 | 72 | 479 | 40 | 1.2 | Example |
| e | 6.1 | 12 | 83 | 484 | 60 | 1.2 | Example |
| f | 5.9 | 14 | 77 | 481 | 60 | 1.2 | Example |
| g | 5.7 | 18 | 88 | 491 | 60 | 1.2 | Example |
| h | 12.8 | 9 | 95 | 494 | 60 | 1.2 | Example |
| i | 2.7 | 13 | 58 | 494 | 50 | 1.6 | Example |
| j | 1.2 | 9 | 72 | 517 | 50 | 1.6 | Example |
| k | 11.4 | 8 | 79 | 515 | 60 | 1.6 | Example |
| l | 16 | 18 | 72 | 509 | 68 | 0.8 | Example |
| m | 24.4 | 11 | 78 | 514 | 5 | 2.3 | Comparative Example |
| n | 2.2 | 12 | 79 | 526 | 50 | 2 | Example |
| o | 1.1 | 12 | 78 | 525 | 50 | 2 | Example |
| p | 1.5 | 14 | 93 | 595 | 50 | 2 | Example |
| q | 1.1 | 11 | 74 | 576 | 50 | 2 | Example |
| r | 2.7 | 15 | 78 | 522 | 50 | 2 | Example |
| s | 1.1 | 7 | 93 | 530 | 50 | 2 | Example |
| t | 18.6 | 19 | 100 | 533 | 72 | 0.8 | Example |
| u | 1.2 | 10 | 90 | 529 | 38 | 1.6 | Example |
| v | 8.1 | 13 | 86 | 527 | 38 | 1.6 | Example |
| w | 1.9 | 13 | 97 | 531 | 38 | 1.6 | Example |
| x | 9.5 | 15 | 100 | 512 | 38 | 1.6 | Example |
| y | 1.8 | 18 | 86 | 508 | 38 | 1.6 | Example |
| z | 1.5 | 12 | 83 | 540 | 50 | 1.6 | Example |

TABLE 4

| Experiment Example | Chemical Constituent | Slab Heating Temperature ° C. | $Ar_3$ Transformation Point ° C. | Finish Rolling Temperature ° C. | Cooling Rate After Rolling ° C./second | Winding Temperature ° C. |
|---|---|---|---|---|---|---|
| aa | K | 1165 | 657 | 916 | 59 | 574 |
| ab | L | 1235 | 598 | 923 | 20 | 521 |
| ac | L | 1170 | 598 | 908 | 79 | 616 |
| ad | M | 1245 | 692 | 893 | 71 | 576 |
| ae | M | 1215 | 692 | 900 | 35 | 611 |
| af | N | 1180 | 729 | 918 | 88 | 629 |
| ag | N | 1210 | 729 | 830 | 26 | 608 |
| ah | N | 1155 | 729 | 873 | 38 | 508 |
| ai | O | 1205 | 648 | 919 | 106 | 538 |
| aj | O | 1250 | 648 | 949 | 26 | 575 |
| ak | O | 1255 | 648 | 937 | 49 | 650 |
| al | P | 1165 | 675 | 941 | 58 | 617 |
| am | P | 1165 | 675 | 903 | 34 | 566 |

TABLE 4-continued

| | | | | | | |
|---|---|---|---|---|---|---|
| an | Q | 1230 | 705 | 872 | 30 | 571 |
| ao | Q | 1210 | 705 | 958 | 68 | 615 |
| ap | R | 1200 | 683 | 872 | 72 | 607 |
| aq | R | 1150 | 683 | 899 | 25 | 580 |
| ar | S | 1265 | 707 | 884 | 25 | 532 |
| as | S | 1210 | 707 | 944 | 63 | 624 |
| at | S | 1205 | 707 | 933 | 96 | 573 |
| au | T | 1265 | 715 | 886 | 37 | 611 |
| av | T | 1160 | 715 | 960 | 68 | 589 |
| aw | U | 1185 | 614 | 920 | 20 | 620 |
| ax | U | 1215 | 614 | 909 | 43 | 640 |
| ay | V | 1190 | 679 | 871 | 54 | 580 |
| az | V | 1205 | 679 | 911 | 43 | 609 |
| ba | W | 1155 | 759 | 862 | 56 | 651 |
| bb | X | 1210 | 605 | 939 | 56 | 659 |
| bc | Y | 1225 | 651 | 938 | 58 | 655 |
| bd | Z | 1180 | 818 | 917 | 50 | 643 |

| Experiment Example | Left Side of Equation (1) | Cooling Rate After Winding ° C./hour | Volume Fraction of Austenite volume % | Bs ° C. | Rolling Reduction % | Cold-rolled Sheet Thickness mm | |
|---|---|---|---|---|---|---|---|
| aa | 2.2 | 15 | 89 | 545 | 50 | 1.6 | Example |
| ab | 1.1 | 6 | 78 | 439 | 50 | 1.2 | Example |
| ac | 9.2 | 13 | 100 | 452 | 50 | 1.2 | Example |
| ad | 2.7 | 14 | 91 | 492 | 60 | 0.8 | Example |
| ae | 7.4 | 15 | 67 | 482 | 60 | 0.8 | Example |
| af | 10.1 | 16 | 100 | 563 | 50 | 1.2 | Example |
| ag | 7.6 | 12 | 73 | 554 | 50 | 1.2 | Example |
| ah | 1.2 | 4 | 89 | 560 | 36 | 1.2 | Example |
| ai | 1.4 | 9 | 100 | 487 | 60 | 0.8 | Example |
| aj | 2.5 | 15 | 80 | 474 | 60 | 0.8 | Example |
| ak | 15.7 | 18 | 98 | 486 | 72 | 0.8 | Example |
| al | 9.7 | 13 | 94 | 618 | 68 | 0.8 | Example |
| am | 2.8 | 11 | 74 | 599 | 68 | 0.8 | Example |
| an | 2.7 | 14 | 80 | 481 | 50 | 1.6 | Example |
| ao | 5.8 | 20 | 84 | 483 | 50 | 1.6 | Example |
| ap | 8.7 | 11 | 84 | 523 | 50 | 1.6 | Example |
| aq | 3.4 | 14 | 87 | 524 | 50 | 1.6 | Example |
| ar | 2.1 | 5 | 62 | 581 | 50 | 1.6 | Example |
| as | 11 | 13 | 86 | 604 | 50 | 1.6 | Example |
| at | 2.8 | 13 | 89 | 606 | 38 | 1.6 | Example |
| au | 17.1 | 6 | 87 | 487 | 50 | 1.6 | Example |
| av | 4.6 | 12 | 79 | 481 | 50 | 1.6 | Example |
| aw | 7.8 | 17 | 74 | 540 | 40 | 1.6 | Example |
| ax | 20.6 | 11 | 88 | 553 | 40 | 1.6 | Example |
| ay | 3.7 | 12 | 78 | 493 | 60 | 1.2 | Example |
| az | 6.4 | 14 | 76 | 491 | 60 | 1.2 | Example |
| ba | 24.7 | 11 | 0 | — | 72 | 1.4 | Comparative Example |
| bb | 31.6 | 11 | 87 | 439 | 50 | 1.4 | Comparative Example |
| bc | 27.5 | 10 | 72 | 559 | 50 | 1.6 | Comparative Example |
| bd | 17.7 | 12 | 23 | 483 | 50 | 1.6 | Comparative Example |

TABLE 5

| | | | | | | Second Cooling Process | | | |
|---|---|---|---|---|---|---|---|---|---|
| Experiment Example | Cold-rolled Steel Sheet | Chemical Constituent | Type of Steel | Maximum Heating Temperature (T1) ° C. | First Cooling Process Maintaining Time in Ferrite Transformation Temperature Range second | Average Cooling Rate in Bainite Transformation Temperature Range ° C./second | Cooling Termination Temperature (T2) ° C. | Cooling Termination Temperature - Ms ° C. | |
| 1 | a | A | CR | 822 | 47 | 57 | 257 | −52 | Example |
| 2 | b | A | CR | 835 | 82 | 64 | 181 | −93 | Example |
| 3 | c | A | CR | 839 | 39 | 85 | 268 | −48 | Example |
| 4 | d | B | CR | 845 | 84 | 68 | 236 | −99 | Example |
| 5 | e | B | CR | 837 | 126 | 60 | 308 | −40 | Example |
| 6 | f | B | CR | 848 | 79 | 62 | 291 | −58 | Example |
| 7 | g | C | CR | 831 | 149 | 74 | 270 | −64 | Example |

TABLE 5-continued

| Experiment Example | Cold-rolled Steel Sheet | Chemical Constituent | Type of Steel | Maximum Heating Temperature (T1) ° C. | First Cooling Process Maintaining Time in Ferrite Transformation Temperature Range second | Second Cooling Process: Average Cooling Rate in Bainite Transformation Temperature Range ° C./second | Second Cooling Process: Cooling Termination Temperature (T2) ° C. | Second Cooling Process: Cooling Termination Temperature - Ms ° C. | |
|---|---|---|---|---|---|---|---|---|---|
| 8 | h | C | CR | 843 | 164 | 74 | 259 | −66 | Example |
| 9 | h | C | CR | 838 | 150 | 88 | 305 | −23 | Comparative Example |
| 10 | i | D | CR | 827 | 66 | 83 | 275 | −54 | Example |
| 11 | j | D | CR | 840 | 78 | 78 | 271 | −49 | Example |
| 12 | k | E | CR | 803 | 71 | 61 | 219 | −94 | Example |
| 13 | l | E | CR | 808 | 75 | 79 | 304 | −8 | Example |
| 14 | m | E | CR | 802 | 70 | 60 | 255 | −51 | Comparative Example |
| 15 | n | F | CR | 817 | 42 | 59 | 211 | −83 | Example |
| 16 | o | F | CR | 833 | 49 | 62 | 228 | −85 | Example |
| 17 | o | F | CR | 880 | 6 | 60 | 272 | −81 | Comparative Example |
| 18 | p | G | CR | 787 | 85 | 67 | 261 | −78 | Example |
| 19 | q | G | CR | 865 | 24 | 78 | 282 | −60 | Example |
| 20 | r | H | CR | 845 | 90 | 67 | 284 | −62 | Example |
| 21 | s | H | CR | 837 | 77 | 67 | 302 | −36 | Example |
| 22 | t | H | CR | 872 | 35 | 56 | 309 | −62 | Example |
| 23 | u | I | CR | 921 | 53 | 68 | 271 | −78 | Example |
| 24 | v | I | CR | 936 | 42 | 69 | 281 | −88 | Example |
| 25 | w | I | CR | 888 | 1730 | 85 | 303 | 50 | Comparative Example |
| 26 | x | J | CR | 879 | 67 | 75 | 338 | −36 | Example |
| 27 | y | J | CR | 852 | 74 | 77 | 304 | −69 | Example |
| 28 | z | K | CR | 860 | 284 | 62 | 261 | −38 | Example |
| 29 | aa | K | CR | 962 | 457 | 85 | 278 | −52 | Example |
| 30 | aa | K | CR | 906 | 171 | 88 | 142 | −148 | Comparative Example |

TABLE 6

| Experiment Example | Cold-rolled Steel Sheet | Chemical Constituent | Type of Steel | Maximum Heating Temperature (T1) ° C. | First Cooling Process: Maintaining Time in Ferrite Transformation Temperature Range second | Second Cooling Process: Average Cooling Rate in Bainite Transformation Temperature Range ° C./second | Second Cooling Process: Cooling Termination Temperature (T2) ° C. | Second Cooling Process: Cooling Termination Temperature - Ms ° C. | |
|---|---|---|---|---|---|---|---|---|---|
| 31 | ab | L | CR | 809 | 96 | 88 | 274 | −47 | Example |
| 32 | ac | L | CR | 814 | 153 | 67 | 247 | −67 | Example |
| 33 | ad | M | CR | 846 | 75 | 79 | 274 | −70 | Example |
| 34 | ae | M | CR | 843 | 81 | 71 | 292 | −58 | Example |
| 35 | af | N | CR | 862 | 62 | 56 | 332 | −49 | Example |
| 36 | ag | N | CR | 1035 | 42 | 86 | 272 | −139 | Comparative Example |
| 37 | ah | N | CR | 891 | 70 | 71 | 303 | −92 | Example |
| 38 | ai | O | CR | 830 | 74 | 70 | 234 | −64 | Example |
| 39 | aj | O | CR | 840 | 70 | 1 | 253 | −54 | Comparative Example |
| 40 | ak | O | CR | 835 | 70 | 74 | 266 | −43 | Example |
| 41 | al | P | CR | 905 | 249 | 64 | 207 | −65 | Example |
| 42 | am | P | CR | 909 | 248 | 53 | 218 | −77 | Example |
| 43 | an | Q | CR | 838 | 55 | 74 | 326 | −15 | Example |
| 44 | ao | Q | CR | 837 | 47 | 54 | 225 | −107 | Example |
| 45 | ap | R | CR | 820 | 69 | 88 | 302 | −61 | Example |
| 46 | aq | R | CR | 856 | 44 | 77 | 221 | −105 | Example |
| 47 | ar | S | CR | 888 | 65 | 53 | 304 | −47 | Example |
| 48 | as | S | CR | 902 | 35 | 57 | 330 | −35 | Example |
| 49 | at | S | CR | 879 | 55 | 85 | 249 | −71 | Example |
| 50 | au | T | CR | 852 | 47 | 54 | 250 | −58 | Example |
| 51 | av | T | CR | 844 | 59 | 71 | 246 | −80 | Example |
| 52 | aw | U | CR | 812 | 114 | 57 | 246 | −80 | Example |
| 53 | ax | U | CR | 837 | 202 | 55 | 260 | −77 | Example |
| 54 | ay | V | CR | 873 | 178 | 61 | 240 | −43 | Example |

TABLE 6-continued

| Experiment Example | Cold-rolled Steel Sheet | Chemical Constituent | Type of Steel | Maximum Heating Temperature (T1) ° C. | First Cooling Process: Maintaining Time in Ferrite Transformation Temperature Range second | Second Cooling Process: Average Cooling Rate in Bainite Transformation Temperature Range ° C./second | Second Cooling Process: Cooling Termination Temperature (T2) ° C. | Second Cooling Process: Cooling Termination Temperature - Ms ° C. | |
|---|---|---|---|---|---|---|---|---|---|
| 55 | az | V | CR | 858 | 155 | 78 | 238 | −66 | Example |
| 56 | ba | W | CR | 842 | 46 | 56 | 334 | −32 | Comparative Example |
| 57 | bb | X | CR | 830 | 65 | 58 | 168 | −40 | Comparative Example |
| 58 | bc | Y | CR | 825 | 81 | 87 | 258 | −80 | Comparative Example |
| 59 | bd | Z | CR | 870 | 54 | 85 | 222 | −19 | Comparative Example |

TABLE 7

| Experiment Example | Maintaining Time Maintaining Time in Martensite Transformation Temperature Range Second | Reheating Process: Average Rate of Temperature Increase in Bainite Transformation Temperature Range ° C./second | Reheating Process: Reheating Stop Temperature (T3) ° C. | Reheating Process: Reheating Stop Temperature - Bs ° C. | Total Maintaining Time in Bainite Transformation Temperature Range Second | |
|---|---|---|---|---|---|---|
| 1 | 8 | 18 | 489 | 10 | 12 | Example |
| 2 | 9 | 20 | 427 | −30 | 11 | Example |
| 3 | 12 | 12 | 471 | −12 | 15 | Example |
| 4 | 9 | 25 | 443 | −20 | 6 | Example |
| 5 | 10 | 24 | 420 | −51 | 5 | Example |
| 6 | 12 | 15 | 470 | −2 | 10 | Example |
| 7 | 7 | 22 | 485 | 9 | 8 | Example |
| 8 | 7 | 24 | 427 | −43 | 6 | Example |
| 9 | 6 | 20 | 409 | −63 | 6 | Comparative Example |
| 10 | 12 | 20 | 483 | −50 | 10 | Example |
| 11 | 8 | 22 | 484 | −44 | 10 | Example |
| 12 | 5 | 14 | 455 | −40 | 13 | Example |
| 13 | 15 | 15 | 447 | −48 | 11 | Example |
| 14 | 7 | 27 | 438 | −53 | 8 | Comparative Example |
| 15 | 5 | 22 | 475 | −32 | 12 | Example |
| 16 | 6 | 26 | 467 | −52 | 9 | Example |
| 17 | 9 | 25 | 507 | −36 | 9 | Comparative Example |
| 18 | 8 | 26 | 577 | −11 | 13 | Example |
| 19 | 4 | 15 | 538 | −53 | 16 | Example |
| 20 | 9 | 26 | 495 | −15 | 8 | Example |
| 21 | 6 | 11 | 446 | −59 | 12 | Example |
| 22 | 12 | 17 | 464 | −61 | 8 | Example |
| 23 | 7 | 15 | 505 | −2 | 13 | Example |
| 24 | 11 | 22 | 522 | 3 | 9 | Example |
| 25 | 0 | 17 | 447 | −1 | 13 | Comparative Example |
| 26 | 8 | 18 | 487 | −14 | 8 | Example |
| 27 | 6 | 11 | 455 | −45 | 9 | Example |
| 28 | 11 | 27 | 485 | −31 | 10 | Example |
| 29 | 11 | 15 | 494 | −42 | 13 | Example |
| 30 | 15 | 25 | 485 | −26 | 10 | Comparative Example |

TABLE 8

| Experiment Example | Maintaining Time Maintaining Time in Martensite Transformation Temperature Range Second | Reheating Process: Average Rate of Temperature Increase in Bainite Transformation Temperature Range ° C./second | Reheating Stop Temperature (T3) ° C. | Reheating Stop Temperature - Bs ° C. | Total Maintaining Time in Bainite Transformation Temperature Range Second | |
|---|---|---|---|---|---|---|
| 31 | 3 | 28 | 467 | 26 | 6 | Example |
| 32 | 8 | 16 | 380 | −56 | 6 | Example |
| 33 | 6 | 25 | 492 | 20 | 7 | Example |
| 34 | 11 | 21 | 483 | 7 | 8 | Example |
| 35 | 5 | 18 | 539 | −6 | 12 | Example |
| 36 | 14 | 23 | 577 | 14 | 8 | Comparative Example |
| 37 | 6 | 25 | 564 | 10 | 9 | Example |
| 38 | 10 | 25 | 428 | −29 | 7 | Example |
| 39 | 9 | 23 | 467 | 5 | 161 | Comparative Example |
| 40 | 12 | 15 | 450 | −13 | 11 | Example |
| 41 | 10 | 16 | 546 | −19 | 22 | Example |
| 42 | 6 | 14 | 518 | −61 | 21 | Example |
| 43 | 13 | 14 | 437 | −39 | 9 | Example |
| 44 | 8 | 12 | 479 | 8 | 14 | Example |
| 45 | 4 | 17 | 529 | 9 | 11 | Example |
| 46 | 11 | 20 | 453 | −45 | 9 | Example |
| 47 | 5 | 25 | 581 | −10 | 14 | Example |
| 48 | 7 | 22 | 593 | −6 | 14 | Example |
| 49 | 7 | 11 | 530 | −41 | 22 | Example |
| 50 | 9 | 26 | 401 | −62 | 6 | Example |
| 51 | 5 | 16 | 431 | −43 | 9 | Example |
| 52 | 10 | 23 | 515 | −26 | 12 | Example |
| 53 | 9 | 27 | 509 | −40 | 10 | Example |
| 54 | 6 | 18 | 437 | −38 | 12 | Example |
| 55 | 7 | 15 | 468 | −20 | 13 | Example |
| 56 | 7 | 23 | 513 | 3 | 9 | Comparative Example |
| 57 | 5 | 19 | 460 | 2 | 17 | Comparative Example |
| 58 | 9 | 27 | 512 | −39 | 9 | Comparative Example |
| 59 | 10 | 18 | 584 | 7 | 23 | Comparative Example |

TABLE 9

| Experiment Example | Third Cooling Process Maintaining Time in Bainite Transformation Temperature Range Second | Fourth Cooling Process Average Cooling Rate ° C./second | Bainite Transformation Start Temperature (Bs) ° C. | Martensite Transformation Start Temperature (Ms) ° C. | |
|---|---|---|---|---|---|
| 1 | 407 | 7 | 479 | 309 | Example |
| 2 | 179 | 7 | 457 | 274 | Example |
| 3 | 212 | 13 | 483 | 317 | Example |
| 4 | 304 | 5 | 463 | 335 | Example |
| 5 | 271 | 13 | 471 | 348 | Example |
| 6 | 409 | 9 | 472 | 349 | Example |
| 7 | 407 | 4 | 476 | 334 | Example |
| 8 | 339 | 5 | 470 | 324 | Example |
| 9 | 9 | 10 | 472 | 328 | Comparative Example |
| 10 | 347 | 7 | 533 | 329 | Example |
| 11 | 331 | 8 | 528 | 320 | Example |
| 12 | 264 | 9 | 495 | 312 | Example |
| 13 | 370 | 4 | 495 | 312 | Example |

TABLE 9-continued

| Experiment Example | Third Cooling Process Maintaining Time in Bainite Transformation Temperature Range Second | Fourth Cooling Process Average Cooling Rate ° C./second | Bainite Transformation Start Temperature (Bs) ° C. | Martensite Transformation Start Temperature (Ms) ° C. | |
|---|---|---|---|---|---|
| 14 | 186 | 13 | 491 | 305 | Comparative Example |
| 15 | 159 | 13 | 507 | 294 | Example |
| 16 | 329 | 11 | 519 | 313 | Example |
| 17 | 350 | 9 | 543 | 353 | Comparative Example |
| 18 | 149 | 7 | 588 | 339 | Example |
| 19 | 285 | 7 | 591 | 342 | Example |
| 20 | 305 | 8 | 510 | 346 | Example |
| 21 | 209 | 13 | 505 | 338 | Example |
| 22 | 149 | 4 | 525 | 371 | Example |
| 23 | 374 | 10 | 507 | 349 | Example |
| 24 | 237 | 9 | 519 | 368 | Example |
| 25 | 295 | 12 | 448 | 253 | Comparative Example |
| 26 | 244 | 13 | 501 | 374 | Example |
| 27 | 276 | 11 | 500 | 373 | Example |
| 28 | 248 | 5 | 516 | 299 | Example |
| 29 | 384 | 4 | 536 | 330 | Example |
| 30 | 139 | 11 | 511 | 290 | Comparative Example |

TABLE 10

| Experiment Example | Third Cooling Process Maintaining Time in Bainite Transformation Temperature Range Second | Fourth Cooling Process Average Cooling Rate ° C./second | Bainite Transformation Start Temperature (Bs) ° C. | Martensite Transformation Start Temperature (Ms) ° C. | |
|---|---|---|---|---|---|
| 31 | 201 | 8 | 441 | 321 | Example |
| 32 | 430 | 7 | 436 | 313 | Example |
| 33 | 194 | 10 | 472 | 344 | Example |
| 34 | 194 | 6 | 476 | 351 | Example |
| 35 | 408 | 9 | 545 | 382 | Example |
| 36 | 338 | 8 | 563 | 411 | Comparative Example |
| 37 | 349 | 12 | 554 | 396 | Example |
| 38 | 171 | 10 | 457 | 299 | Example |
| 39 | 283 | 11 | 462 | 307 | Comparative Example |
| 40 | 202 | 7 | 463 | 309 | Example |
| 41 | 324 | 6 | 565 | 272 | Example |
| 42 | 348 | 7 | 579 | 295 | Example |
| 43 | 310 | 6 | 476 | 341 | Example |
| 44 | 195 | 12 | 471 | 332 | Example |
| 45 | 172 | 13 | 520 | 363 | Example |
| 46 | 405 | 4 | 498 | 326 | Example |
| 47 | 273 | 10 | 591 | 351 | Example |
| 48 | 418 | 10 | 599 | 365 | Example |
| 49 | 164 | 4 | 571 | 320 | Example |
| 50 | 149 | 5 | 463 | 308 | Example |
| 51 | 174 | 8 | 474 | 326 | Example |
| 52 | 288 | 13 | 541 | 326 | Example |
| 53 | 327 | 11 | 549 | 338 | Example |
| 54 | 374 | 8 | 475 | 283 | Example |
| 55 | 218 | 5 | 488 | 304 | Example |
| 56 | 332 | 4 | 510 | 366 | Comparative Example |
| 57 | 416 | 13 | 458 | 208 | Comparative Example |
| 58 | 229 | 4 | 551 | 338 | Comparative Example |
| 59 | 412 | 6 | 577 | 241 | Comparative Example |

TABLE 11

| Experiment Example | Cold-rolled Steel Sheet | Chemical Constituent | Type of Steel | Maximum Heating Temperature (T1) ° C. | First Cooling Process Maintaining Time in Ferrite Transformation Temperature Range Second | Second Cooling Process Average Cooling Rate in Bainite Transformation Temperature Range ° C./second | Second Cooling Process Cooling Termination Temperature (T2) ° C. | Second Cooling Process Cooling Termination Temperature - Ms ° C. |
|---|---|---|---|---|---|---|---|---|
| 60 | g | C | EG | 831 | 49 | 74 | 270 | −64 |
| 61 | z | K | EG | 860 | 84 | 62 | 261 | −38 |
| 62 | ab | L | EG | 809 | 46 | 88 | 274 | −47 |
| 63 | ay | V | EG | 873 | 78 | 61 | 240 | −43 |
| 64 | a | A | GI | 835 | 56 | 51 | 291 | −49 |
| 65 | d | B | GI | 840 | 82 | 72 | 301 | −71 |
| 66 | i | D | GI | 822 | 50 | 57 | 266 | −30 |
| 67 | ag | N | GI | 864 | 59 | 54 | 312 | −93 |
| 68 | al | P | GI | 912 | 47 | 51 | 284 | −55 |
| 69 | b | A | GA | 842 | 61 | 23 | 284 | −50 |
| 70 | e | B | GA | 832 | 71 | 19 | 322 | −44 |
| 71 | n | F | GA | 825 | 49 | 22 | 249 | −84 |
| 72 | w | I | GA | 888 | 54 | 27 | 328 | −49 |
| 73 | x | J | GA | 868 | 53 | 17 | 332 | −46 |
| 74 | c | A | GI | 829 | 48 | 55 | 273 | −71 |
| 75 | r | H | GI | 852 | 80 | 64 | 304 | −65 |
| 76 | p | G | GI | 802 | 76 | 79 | 281 | −51 |
| 77 | u | I | GI | 915 | 56 | 49 | 297 | −74 |
| 78 | h | C | GA | 837 | 43 | 12 | 278 | −81 |
| 79 | k | E | GA | 812 | 56 | 25 | 287 | −57 |
| 80 | s | H | GA | 842 | 51 | 19 | 312 | −56 |
| 81 | ad | M | GA | 836 | 52 | 17 | 278 | −98 |
| 82 | aj | O | GA | 847 | 66 | 17 | 263 | −70 |

| Experiment Example | Maintaining Process Maintaining Time in Martensite Transformation Temperature Range Second | Reheating Process Average Rate of Temperature Increase in Bainite Transformation Temperature Range ° C./second | Reheating Process Reheating Stop Temperature (T3) ° C. | Reheating Process Reheating Stop Temperature - Bs ° C. | Reheating Process Total Maintaining Time in Bainite Transformation Temperature Range Second | |
|---|---|---|---|---|---|---|
| 60 | 7 | 22 | 485 | 9 | 8 | Example |
| 61 | 11 | 27 | 485 | −31 | 10 | Example |
| 62 | 3 | 28 | 467 | 26 | 6 | Example |
| 63 | 6 | 18 | 437 | −38 | 12 | Example |
| 64 | 10 | 11 | 486 | −12 | 16 | Example |
| 65 | 7 | 19 | 471 | −15 | 13 | Example |
| 66 | 10 | 14 | 497 | −16 | 18 | Example |
| 67 | 9 | 13 | 527 | −32 | 12 | Example |
| 68 | 8 | 22 | 548 | −58 | 15 | Example |
| 69 | 4 | 14 | 524 | 30 | 18 | Example |
| 70 | 3 | 12 | 492 | 10 | 16 | Example |
| 71 | 4 | 20 | 501 | −30 | 17 | Example |
| 72 | 5 | 10 | 507 | −17 | 18 | Example |
| 73 | 5 | 19 | 531 | 28 | 14 | Example |
| 74 | 10 | 25 | 467 | −33 | 8 | Example |
| 75 | 11 | 29 | 483 | −41 | 6 | Example |
| 76 | 9 | 28 | 542 | −42 | 11 | Example |
| 77 | 9 | 18 | 521 | 0 | 11 | Example |
| 78 | 4 | 22 | 483 | −8 | 17 | Example |
| 79 | 4 | 19 | 490 | −25 | 14 | Example |
| 80 | 3 | 16 | 494 | −29 | 16 | Example |
| 81 | 6 | 24 | 507 | 16 | 12 | Example |
| 82 | 5 | 20 | 501 | 24 | 16 | Example |

TABLE 12

| Experiment Example | Third Cooling Process Maintaining Time in Bainite Transformation Temperature Range Second | Fourth Cooling Process Average Cooling Rate ° C./second | Bainite Transformation Start Rate (Bs) ° C. | Martensite Transformation Start Temperature (Ms) ° C. | Plating Bath Position | Alloying Conditions Alloying Temperature (Tg) ° C. | Alloying Conditions Maintaining Time Second | |
|---|---|---|---|---|---|---|---|---|
| 60 | 407 | 4 | 476 | 334 | After Annealing | — | — | Example |
| 61 | 248 | 5 | 516 | 299 | After Annealing | — | — | Example |
| 62 | 201 | 8 | 441 | 321 | After Annealing | — | — | Example |
| 63 | 374 | 8 | 475 | 283 | After Annealing | — | — | Example |
| 64 | 157 | 9 | 498 | 340 | Reheating Process | — | — | Example |
| 65 | 136 | 4 | 486 | 372 | Reheating Process | — | — | Example |
| 66 | 179 | 10 | 513 | 296 | Reheating Process | — | — | Example |
| 67 | 103 | 8 | 559 | 405 | Reheating Process | — | — | Example |
| 68 | 147 | 7 | 606 | 339 | Reheating Process | — | — | Example |
| 69 | 59 | 7 | 494 | 334 | Reheating Process | — | 10 | Example |
| 70 | 50 | 6 | 482 | 366 | Reheating Process | — | 10 | Example |
| 71 | 67 | 6 | 531 | 333 | Reheating Process | — | 10 | Example |
| 72 | 240 | 6 | 524 | 377 | Reheating Process | — | 10 | Example |
| 73 | 267 | 6 | 503 | 378 | Reheating Process | — | 10 | Example |
| 74 | 300 | 11 | 500 | 344 | Third Cooling Process | — | — | Example |
| 75 | 278 | 4 | 524 | 369 | Third Cooling Process | — | — | Example |
| 76 | 85 | 6 | 584 | 332 | Third Cooling Process | — | — | Example |
| 77 | 62 | 5 | 521 | 371 | Third Cooling Process | — | — | Example |
| 78 | 137 | 4 | 491 | 359 | Third Cooling Process | 504 | 7 | Example |
| 79 | 51 | 4 | 515 | 344 | Third Cooling Process | 544 | 7 | Example |
| 80 | 37 | 4 | 523 | 368 | Third Cooling Process | 508 | 7 | Example |
| 81 | 86 | 4 | 491 | 376 | Third Cooling Process | 535 | 7 | Example |
| 82 | 81 | 4 | 477 | 333 | Third Cooling Process | 532 | 7 | Example |

TABLE 13

| Experiment Example | Cold-Rolled Steel Sheet | Chemical Constituent | Type of Steel | Micro Structure Observation Results: Volume Fraction F % | B % | BF % | B + BF % | TM % | M % | Retained γ % | Others % | Average Crystal Grain μm | |
|---|---|---|---|---|---|---|---|---|---|---|---|---|---|
| 1 | a | A | CR | 33 | 18 | 12 | 30 | 27 | 0 | 10 | 0 | 4.5 | Example |
| 2 | b | A | CR | 45 | 19 | 2 | 21 | 32 | 2 | 0 | 0 | 5.1 | Example |
| 3 | c | A | CR | 27 | 21 | 15 | 36 | 22 | 3 | 11 | 1 | 2.9 | Example |
| 4 | d | B | CR | 47 | 3 | 12 | 15 | 33 | 0 | 5 | 0 | 9.0 | Example |
| 5 | e | B | CR | 41 | 9 | 29 | 38 | 15 | 0 | 5 | 1 | 7.7 | Example |
| 6 | f | B | CR | 39 | 19 | 10 | 29 | 22 | 4 | 6 | 0 | 7.2 | Example |
| 7 | g | C | CR | 36 | 23 | 9 | 32 | 25 | 1 | 6 | 0 | 6.5 | Example |
| 8 | h | C | CR | 43 | 32 | 0 | 32 | 22 | 3 | 0 | 0 | 8.4 | Example |

TABLE 13-continued

| Experiment Example | Cold-Rolled Steel Sheet | Chemical Constituent | Type of Steel | Micro Structure Observation Results: Volume Fraction F % | B % | BF % | B + BF % | TM % | M % | Retained γ % | Others % | Average Crystal Grain μm | |
|---|---|---|---|---|---|---|---|---|---|---|---|---|---|
| 9 | h | C | CR | 41 | 5 | 2 | 7 | 19 | 30 | 2 | 1 | 4.7 | Comparative Example |
| 10 | i | D | CR | 14 | 16 | 26 | 42 | 27 | 3 | 14 | 0 | 3.8 | Example |
| 11 | j | D | CR | 20 | 24 | 19 | 43 | 23 | 0 | 14 | 0 | 3.3 | Example |
| 12 | k | E | CR | 40 | 0 | 12 | 12 | 35 | I | 10 | 2 | 3.3 | Example |
| 13 | l | E | CR | 41 | 8 | 31 | 39 | 13 | 0 | 7 | 0 | 2.6 | Example |
| 14 | m | E | CR | 43 | 20 | 11 | 31 | 19 | 2 | 5 | 0 | 21.7 | Comparative Example |
| 15 | n | F | CR | 35 | 22 | 8 | 30 | 31 | 0 | 4 | 0 | 1.9 | Example |
| 16 | o | F | CR | 28 | 0 | 18 | 18 | 41 | 2 | 10 | 1 | 2.2 | Example |
| 17 | o | F | CR | 3 | 18 | 26 | 44 | 44 | 3 | 4 | 2 | 2.5 | Comparative Example |
| 18 | p | G | CR | 14 | 31 | 5 | 36 | 45 | 1 | 3 | 1 | 1.2 | Example |
| 19 | q | G | CR | 16 | 27 | 16 | 43 | 31 | 1 | 8 | 1 | 8.0 | Example |
| 20 | r | H | CR | 40 | 4 | 19 | 23 | 25 | 0 | 11 | 1 | 5.6 | Example |
| 21 | s | H | CR | 42 | 10 | 24 | 34 | 14 | 3 | 7 | 0 | 4.7 | Example |
| 22 | t | H | CR | 16 | 1 | 33 | 34 | 41 | 0 | 9 | 0 | 2.0 | Example |
| 23 | u | I | CR | 46 | 0 | 24 | 24 | 24 | 0 | 6 | 0 | 8.1 | Example |
| 24 | v | I | CR | 30 | 3 | 18 | 21 | 40 | 0 | 7 | 2 | 8.7 | Example |
| 25 | w | I | CR | 75 | 1 | 5 | 6 | 0 | 18 | 1 | 0 | 6.9 | Comparative Example |
| 26 | x | J | CR | 32 | 5 | 37 | 42 | 15 | 2 | 9 | 0 | 5.5 | Example |
| 27 | y | J | CR | 35 | 10 | 15 | 25 | 31 | 2 | 5 | 2 | 6.2 | Example |
| 28 | z | K | CR | 40 | 24 | 17 | 41 | 15 | 0 | 4 | 0 | 5.6 | Example |
| 29 | aa | K | CR | 23 | 22 | 16 | 38 | 26 | 3 | 9 | 1 | 3.1 | Example |
| 30 | aa | K | CR | 44 | 0 | 6 | 6 | 42 | 4 | 4 | 0 | 2.9 | Comparative Example |

TABLE 14

| Experiment Example | Cold-Rolled Steel Sheet | Chemical Constituent | Type of Steel | Micro Structure Observation Results: Volume Fraction F % | B % | BF % | B + BF % | TM % | M % | Retained γ % | Others % | Average Crystal Grain μm | |
|---|---|---|---|---|---|---|---|---|---|---|---|---|---|
| 31 | ab | L | CR | 21 | 21 | 23 | 44 | 24 | 2 | 8 | 1 | 3.9 | Example |
| 32 | ac | L | CR | 27 | 31 | 4 | 35 | 32 | 0 | 6 | 0 | 4.5 | Example |
| 33 | ad | M | CR | 47 | 0 | 17 | 17 | 23 | 5 | 7 | 1 | 6.1 | Example |
| 34 | ae | M | CR | 43 | 5 | 25 | 30 | 19 | 0 | 8 | 0 | 4.9 | Example |
| 35 | af | N | CR | 43 | 20 | 13 | 33 | 17 | 0 | 7 | 0 | 4.4 | Example |
| 36 | ag | N | CR | 0 | 0 | 8 | 8 | 84 | 3 | 5 | 0 | 1.3 | Comparative Example |
| 37 | ah | N | CR | 29 | 5 | 16 | 21 | 42 | 1 | 6 | 1 | 9.2 | Example |
| 38 | ai | O | CR | 36 | 2 | 19 | 21 | 28 | 0 | 15 | 0 | 5.1 | Example |
| 39 | aj | O | CR | 35 | 14 | 37 | 51 | 0 | 1 | 13 | 0 | 5.8 | Comparative Example |
| 40 | ak | O | CR | 32 | 14 | 25 | 39 | 17 | 4 | 8 | 0 | 2.8 | Example |
| 41 | al | P | CR | 45 | 3 | 21 | 24 | 23 | 3 | 5 | 0 | 4.7 | Example |
| 42 | am | P | CR | 41 | 4 | 15 | 19 | 31 | 1 | 7 | 1 | 5.0 | Example |
| 43 | an | Q | CR | 28 | 10 | 31 | 41 | 22 | 0 | 9 | 0 | 4.7 | Example |
| 44 | ao | Q | CR | 34 | 0 | 18 | 18 | 41 | 0 | 7 | 0 | 6.1 | Example |
| 45 | ap | R | CR | 19 | 20 | 17 | 37 | 32 | 2 | 10 | 0 | 5.5 | Example |
| 46 | aq | R | CR | 45 | 15 | 4 | 19 | 35 | 1 | 0 | 0 | 6.0 | Example |
| 47 | ar | S | CR | 30 | 22 | 18 | 40 | 22 | 0 | 7 | 1 | 3.8 | Example |
| 48 | as | S | CR | 21 | 5 | 15 | 20 | 19 | 38 | 2 | 0 | 1.1 | Example |
| 49 | at | S | CR | 43 | 13 | 13 | 26 | 24 | 2 | 5 | 0 | 5.7 | Example |
| 50 | au | T | CR | 38 | 7 | 22 | 29 | 22 | 0 | 11 | 0 | 3.9 | Example |
| 51 | av | T | CR | 29 | 26 | 0 | 26 | 36 | 5 | 4 | 0 | 3.5 | Example |
| 52 | aw | U | CR | 25 | 12 | 10 | 22 | 38 | 3 | 10 | 2 | 7.0 | Example |
| 53 | ax | U | CR | 17 | 18 | 8 | 26 | 42 | 1 | 14 | 0 | 6.6 | Example |
| 54 | ay | V | CR | 35 | 6 | 23 | 29 | 17 | 2 | 17 | 0 | 4.7 | Example |
| 55 | az | V | CR | 26 | 14 | 18 | 32 | 28 | 1 | 13 | 0 | 6.3 | Example |

TABLE 14-continued

| Experiment Example | Cold-Rolled Steel Sheet | Chemical Constituent | Type of Steel | Micro Structure Observation Results: Volume Fraction F % | B % | BF % | B + BF % | TM % | M % | Retained γ % | Others % | Average Crystal Grain μm | |
|---|---|---|---|---|---|---|---|---|---|---|---|---|---|
| 56 | ba | W | CR | 83 | 4 | 8 | 12 | 0 | 0 | 0 | 5 | 8.9 | Comparative Example |
| 57 | bb | X | CR | 2 | 45 | 20 | 65 | 23 | 0 | 4 | 6 | 0.8 | Comparative Example |
| 58 | bc | Y | CR | 35 | 28 | 0 | 28 | 35 | 2 | 0 | 0 | 8.4 | Comparative Example |
| 59 | bd | Z | CR | 65 | 27 | 5 | 32 | 0 | 2 | 1 | 0 | 7.6 | Comparative Example |

TABLE 15

| Experiment Example | Hardness Measurement Results: H2 Hv | H98 Hv | H98/H2 | K* | f (Maximum) % | f (Minimum) % | Mn Segregation: Maximum Concentration mass % | Minimum Concentration mass % | Difference between Maximum Value and Minimum Value mass % | Material Quality Measurement Results: TS MPa | EL % | λ % | |
|---|---|---|---|---|---|---|---|---|---|---|---|---|---|
| 1 | 125 | 482 | 3.86 | −0.61 | 17 | 7 | 3.12 | 2.09 | 1.03 | 1131 | 22 | 49 | Example |
| 2 | 119 | 513 | 4.31 | −0.99 | 19 | 7 | 2.75 | 1.98 | 0.77 | 1116 | 24 | 66 | Example |
| 3 | 131 | 493 | 3.77 | −0.49 | 22 | 3 | 3.12 | 1.99 | 1.13 | 1171 | 21 | 46 | Example |
| 4 | 120 | 427 | 3.56 | −0.84 | 17 | 7 | 3.01 | 2.50 | 0.51 | 943 | 24 | 78 | Example |
| 5 | 124 | 408 | 3.30 | −0.88 | 24 | 5 | 3.18 | 2.01 | 1.17 | 973 | 21 | 70 | Example |
| 6 | 117 | 394 | 3.37 | −0.48 | 22 | 6 | 3.23 | 2.25 | 0.98 | 925 | 24 | 53 | Example |
| 7 | 113 | 377 | 3.35 | −0.56 | 19 | 6 | 3.52 | 2.59 | 0.93 | 957 | 23 | 62 | Example |
| 8 | 121 | 409 | 3.37 | −0.63 | 22 | 5 | 3.78 | 2.33 | 1.45 | 1022 | 22 | 68 | Example |
| 9 | 119 | 421 | 3.54 | −0.30 | 19 | 0 | 3.67 | 2.39 | 1.28 | 1032 | 22 | 19 | Comparative Example |
| 10 | 102 | 404 | 3.96 | −0.43 | 18 | 4 | 2.45 | 1.96 | 0.49 | 1035 | 25 | 55 | Example |
| 11 | 112 | 411 | 3.67 | −0.52 | 19 | 5 | 2.40 | 1.83 | 0.57 | 1010 | 22 | 67 | Example |
| 12 | 138 | 431 | 3.12 | −0.45 | 22 | 4 | 2.77 | 1.75 | 1.02 | 1023 | 21 | 50 | Example |
| 13 | 128 | 429 | 3.36 | −0.98 | 19 | 6 | 2.99 | 1.81 | 1.18 | 1012 | 21 | 88 | Example |
| 14 | 120 | 398 | 3.32 | −1.03 | 23 | 3 | 2.83 | 1.56 | 1.27 | 963 | 23 | 22 | Comparative Example |
| 15 | 157 | 456 | 2.90 | −0.46 | 16 | 6 | 2.05 | 1.57 | 0.48 | 1303 | 15 | 42 | Example |
| 16 | 168 | 433 | 2.57 | −0.61 | 21 | 4 | 2.16 | 1.63 | 0.53 | 1145 | 16 | 54 | Example |
| 17 | 295 | 408 | 1.38 | −0.43 | 19 | 4 | 2.07 | 1.65 | 0.42 | 1250 | 9 | 44 | Comparative Example |
| 18 | 131 | 351 | 2.68 | −0.51 | 20 | 5 | 2.67 | 2.05 | 0.62 | 1140 | 16 | 59 | Example |
| 19 | 117 | 409 | 3.50 | −0.78 | 23 | 4 | 2.67 | 2.13 | 0.54 | 1236 | 20 | 60 | Example |
| 20 | 148 | 405 | 2.74 | −1.07 | 18 | 5 | 2.55 | 1.93 | 0.62 | 927 | 21 | 89 | Example |
| 21 | 150 | 429 | 2.86 | −0.84 | 26 | 3 | 2.38 | 1.86 | 0.52 | 1047 | 19 | 65 | Example |
| 22 | 154 | 399 | 2.59 | −0.45 | 20 | 4 | 2.99 | 1.80 | 1.19 | 1237 | 15 | 45 | Example |
| 23 | 142 | 458 | 3.23 | −0.69 | 21 | 4 | 2.25 | 1.60 | 0.65 | 1052 | 19 | 73 | Example |
| 24 | 137 | 376 | 2.74 | −0.58 | 19 | 7 | 2.31 | 1.60 | 0.71 | 1063 | 19 | 59 | Example |
| 25 | 134 | 523 | 3.91 | 0.11 | 37 | 0 | 2.22 | 1.67 | 0.55 | 920 | 25 | 10 | Comparative Example |
| 26 | 135 | 435 | 3.22 | −0.68 | 23 | 6 | 3.04 | 1.92 | 1.12 | 1029 | 20 | 74 | Example |
| 27 | 146 | 439 | 3.01 | −0.76 | 18 | 5 | 2.74 | 2.15 | 0.59 | 1098 | 19 | 62 | Example |
| 28 | 101 | 427 | 4.22 | −0.85 | 18 | 7 | 3.10 | 2.47 | 0.63 | 1194 | 22 | 68 | Example |
| 29 | 111 | 391 | 3.52 | −0.73 | 22 | 4 | 3.22 | 2.52 | 0.70 | 1178 | 19 | 59 | Example |
| 30 | 119 | 417 | 3.50 | −0.22 | 19 | 1 | 3.30 | 2.57 | 0.73 | 1222 | 19 | 8 | Comparative Example |

TABLE 16

| Experiment Example | Hardness Measurement Results: H2 Hv | H98 Hv | H98/H2 | K* | f (Maximum) % | f (Minimum) % | Mn Segregation: Maximum Concentration mass % | Minimum Concentration mass % | Difference between Maximum Value and Minimum Value mass % | Material Quality Measurement Results: TS MPa | EL % | λ % | |
|---|---|---|---|---|---|---|---|---|---|---|---|---|---|
| 31 | 115 | 402 | 3.50 | −0.84 | 24 | 3 | 3.44 | 2.75 | 0.69 | 1068 | 22 | 58 | Example |
| 32 | 112 | 377 | 3.38 | −0.66 | 17 | 7 | 3.74 | 2.37 | 1.37 | 1061 | 20 | 62 | Example |
| 33 | 140 | 434 | 3.11 | −0.97 | 19 | 7 | 2.85 | 2.06 | 0.79 | 948 | 23 | 84 | Example |
| 34 | 148 | 403 | 2.72 | −0.51 | 21 | 5 | 2.96 | 2.15 | 0.81 | 922 | 22 | 66 | Example |
| 35 | 134 | 409 | 3.06 | −0.60 | 19 | 4 | 2.47 | 1.63 | 0.84 | 914 | 23 | 64 | Example |
| 36 | 241 | 330 | 1.37 | 0.07 | 18 | 4 | 2.34 | 1.73 | 0.61 | 970 | 6 | 58 | Comparative Example |
| 37 | 116 | 398 | 3.42 | −0.49 | 23 | 4 | 2.33 | 1.84 | 0.49 | 996 | 23 | 60 | Example |
| 38 | 145 | 434 | 2.99 | −1.01 | 21 | 3 | 3.06 | 2.37 | 0.69 | 990 | 22 | 70 | Example |
| 39 | 148 | 341 | 2.30 | −0.46 | 24 | 5 | 3.11 | 2.46 | 0.65 | 865 | 21 | 59 | Comparative Example |
| 40 | 165 | 389 | 2.35 | −0.84 | 18 | 6 | 3.76 | 2.14 | 1.62 | 1114 | 16 | 61 | Example |
| 41 | 143 | 453 | 3.16 | −0.74 | 25 | 3 | 3.67 | 2.45 | 1.22 | 1038 | 21 | 71 | Example |
| 42 | 140 | 388 | 2.78 | −1.08 | 26 | 5 | 3.52 | 2.64 | 0.88 | 923 | 22 | 80 | Example |
| 43 | 128 | 378 | 2.97 | −0.93 | 19 | 6 | 2.45 | 1.91 | 0.54 | 945 | 23 | 77 | Example |
| 44 | 121 | 387 | 3.21 | −0.80 | 23 | 4 | 2.68 | 1.80 | 0.88 | 1000 | 21 | 76 | Example |
| 45 | 132 | 333 | 2.53 | −0.71 | 22 | 4 | 1.93 | 1.16 | 0.77 | 1025 | 20 | 74 | Example |
| 46 | 121 | 371 | 3.08 | −0.78 | 23 | 3 | 1.89 | 1.38 | 0.51 | 1014 | 19 | 53 | Example |
| 47 | 142 | 347 | 2.44 | −0.64 | 18 | 7 | 2.66 | 2.13 | 0.53 | 953 | 19 | 60 | Example |
| 48 | 159 | 541 | 3.40 | −0.53 | 34 | 3 | 3.02 | 2.06 | 0.96 | 1359 | 15 | 34 | Example |
| 49 | 143 | 421 | 2.94 | −0.44 | 20 | 4 | 2.79 | 2.01 | 0.78 | 1021 | 21 | 56 | Example |
| 50 | 169 | 437 | 2.58 | −0.63 | 16 | 7 | 2.20 | 1.50 | 0.70 | 1047 | 20 | 61 | Example |
| 51 | 158 | 445 | 2.81 | −0.67 | 19 | 6 | 2.22 | 1.53 | 0.69 | 1338 | 14 | 48 | Example |
| 52 | 141 | 372 | 2.64 | −1.07 | 21 | 4 | 3.07 | 1.94 | 1.13 | 993 | 19 | 70 | Example |
| 53 | 137 | 405 | 2.97 | −0.62 | 17 | 7 | 3.52 | 1.96 | 1.56 | 1347 | 17 | 49 | Example |
| 54 | 152 | 410 | 2.70 | −1.12 | 20 | 5 | 1.92 | 1.45 | 0.47 | 1147 | 19 | 69 | Example |
| 55 | 141 | 403 | 2.86 | −0.63 | 20 | 3 | 1.98 | 1.34 | 0.64 | 990 | 21 | 58 | Example |
| 56 | 116 | 142 | 1.22 | 0.24 | 25 | 5 | 2.30 | 2.06 | 0.24 | 414 | 35 | 80 | Comparative Example |
| 57 | 339 | 454 | 1.34 | −0.30 | 22 | 0 | 2.47 | 1.38 | 1.09 | 1409 | 7 | 26 | Comparative Example |
| 58 | 86 | 245 | 2.85 | −0.59 | 19 | 6 | 2.72 | 1.82 | 0.90 | 795 | 22 | 55 | Comparative Example |
| 59 | 143 | 203 | 1.42 | −0.35 | 32 | 3 | 0.66 | 0.48 | 0.18 | 723 | 24 | 41 | Comparative Example |

TABLE 17

| Experiment Example | Cold-rolled Steel Sheet | Chemical Constituent | Type of Steel | Micro Structure Observation Results: Volume Fraction: F % | B % | BF % | B + BF % | TM % | M % | Retained γ % | Others % | Average Crystal Grain μm | |
|---|---|---|---|---|---|---|---|---|---|---|---|---|---|
| 60 | g | C | EG | 39 | 21 | 14 | 35 | 19 | 0 | 7 | 0 | 6.0 | Example |
| 61 | z | K | EG | 35 | 20 | 22 | 42 | 18 | 0 | 4 | 1 | 6.0 | Example |
| 62 | ab | L | EG | 23 | 22 | 20 | 42 | 23 | 0 | 12 | 0 | 4.5 | Example |
| 63 | ay | V | EG | 33 | 7 | 22 | 29 | 20 | 2 | 15 | 1 | 4.8 | Example |
| 64 | a | A | GI | 38 | 22 | 10 | 32 | 20 | 1 | 8 | 1 | 4.5 | Example |
| 65 | d | B | GI | 43 | 8 | 11 | 19 | 30 | 0 | 7 | 1 | 8.4 | Example |
| 66 | i | D | GI | 20 | 10 | 30 | 40 | 30 | 0 | 10 | 0 | 4.5 | Example |
| 67 | ag | N | GI | 43 | 20 | 13 | 33 | 17 | 0 | 6 | 1 | 6.1 | Example |
| 68 | al | P | GI | 38 | 10 | 19 | 29 | 26 | 1 | 6 | 0 | 5.7 | Example |
| 69 | b | A | GA | 45 | 10 | 16 | 26 | 27 | 0 | 2 | 0 | 6.2 | Example |
| 70 | e | B | GA | 47 | 15 | 20 | 35 | 13 | 0 | 5 | 0 | 5.9 | Example |
| 71 | n | F | GA | 38 | 11 | 15 | 26 | 28 | 2 | 6 | 0 | 3.9 | Example |
| 72 | w | I | GA | 40 | 8 | 20 | 28 | 26 | 0 | 6 | 0 | 7.1 | Example |
| 73 | x | J | GA | 29 | 15 | 28 | 43 | 21 | 0 | 7 | 0 | 5.0 | Example |
| 74 | c | A | GI | 32 | 19 | 6 | 25 | 29 | 0 | 13 | 1 | 4.3 | Example |
| 75 | r | H | GI | 37 | 0 | 19 | 19 | 33 | 1 | 10 | 0 | 7.2 | Example |
| 76 | p | G | GI | 19 | 18 | 19 | 37 | 35 | 0 | 9 | 0 | 8.6 | Example |
| 77 | u | I | GI | 45 | 0 | 28 | 28 | 22 | 0 | 5 | 0 | 7.4 | Example |

TABLE 17-continued

| | | | | Micro Structure Observation Results | | | | | | | | | |
|---|---|---|---|---|---|---|---|---|---|---|---|---|---|
| | | | | Volume Fraction | | | | | | | | Average Crystal | |
| Experiment Example | Cold-rolled Steel Sheet | Chemical Constituent | Type of Steel | F % | B % | BF % | B + BF % | TM % | M % | Retained γ % | Others % | Grain μm | |
| 78 | h | C | GA | 39 | 22 | 12 | 34 | 24 | 3 | 0 | 0 | 9.0 | Example |
| 79 | k | E | GA | 38 | 2 | 21 | 23 | 28 | 0 | 8 | 3 | 5.1 | Example |
| 80 | s | H | GA | 38 | 13 | 20 | 33 | 19 | 1 | 9 | 0 | 6.1 | Example |
| 81 | ad | M | GA | 41 | 2 | 11 | 13 | 37 | 1 | 8 | 0 | 6.7 | Example |
| 82 | aj | O | GA | 33 | 18 | 15 | 33 | 19 | 0 | 15 | 0 | 6.3 | Example |

TABLE 18

| | Hardness Measurement Results | | | | | | Mn Segregation | | | Material Quality Measurement Results | | | |
|---|---|---|---|---|---|---|---|---|---|---|---|---|---|
| Experiment Example | H2 Hv | H98 Hv | H98/H2 | K* | f (Maximum) % | f (Minimum) % | Maximum Concentration mass % | Minimum Concentration mass % | Difference between Maximum Value and Minimum Value mass % | TS MPa | EL % | λ % | |
| 60 | 113 | 403 | 3.57 | −0.63 | 17 | 5 | 3.35 | 2.42 | 0.93 | 940 | 25 | 77 | Example |
| 61 | 111 | 486 | 4.37 | −0.63 | 18 | 6 | 3.05 | 2.54 | 0.51 | 1184 | 19 | 63 | Example |
| 62 | 95 | 458 | 4.82 | −0.79 | 22 | 3 | 3.26 | 2.74 | 0.52 | 1070 | 22 | 60 | Example |
| 63 | 131 | 450 | 3.44 | −0.58 | 18 | 6 | 2.02 | 1.44 | 0.58 | 1139 | 19 | 48 | Example |
| 64 | 132 | 467 | 3.54 | −0.71 | 19 | 4 | 2.95 | 1.75 | 1.20 | 1101 | 21 | 51 | Example |
| 65 | 106 | 477 | 4.50 | −0.71 | 18 | 5 | 2.97 | 2.53 | 0.44 | 923 | 28 | 76 | Example |
| 66 | 126 | 393 | 3.12 | −0.82 | 17 | 6 | 2.37 | 1.91 | 0.46 | 1005 | 21 | 78 | Example |
| 67 | 115 | 467 | 4.06 | −0.44 | 18 | 3 | 2.40 | 1.76 | 0.64 | 960 | 22 | 55 | Example |
| 68 | 135 | 448 | 3.32 | −0.60 | 19 | 4 | 3.97 | 2.55 | 1.42 | 1027 | 19 | 74 | Example |
| 69 | 109 | 497 | 4.56 | −0.68 | 21 | 3 | 2.88 | 1.87 | 1.01 | 1113 | 24 | 66 | Example |
| 70 | 141 | 466 | 3.31 | −0.91 | 19 | 7 | 3.38 | 2.33 | 1.05 | 961 | 21 | 72 | Example |
| 71 | 142 | 448 | 3.15 | −0.47 | 18 | 4 | 2.12 | 1.64 | 0.48 | 1261 | 16 | 36 | Example |
| 72 | 143 | 606 | 4.23 | −0.72 | 20 | 3 | 2.30 | 1.77 | 0.53 | 937 | 23 | 85 | Example |
| 73 | 120 | 496 | 4.14 | −0.98 | 18 | 6 | 3.18 | 2.19 | 0.99 | 1024 | 24 | 74 | Example |
| 74 | 131 | 487 | 3.71 | −0.97 | 17 | 5 | 3.59 | 1.96 | 1.63 | 1208 | 20 | 60 | Example |
| 75 | 147 | 479 | 3.26 | −0.45 | 20 | 3 | 2.50 | 1.90 | 0.60 | 909 | 23 | 60 | Example |
| 76 | 122 | 458 | 3.75 | −1.03 | 19 | 5 | 2.68 | 2.24 | 0.44 | 1237 | 18 | 69 | Example |
| 77 | 129 | 506 | 3.92 | −0.93 | 16 | 7 | 2.13 | 1.76 | 0.37 | 1042 | 20 | 84 | Example |
| 78 | 121 | 442 | 3.65 | −0.65 | 19 | 3 | 4.05 | 2.23 | 1.82 | 1039 | 20 | 62 | Example |
| 79 | 118 | 487 | 4.13 | −0.68 | 18 | 6 | 2.69 | 1.62 | 1.07 | 1003 | 23 | 81 | Example |
| 80 | 138 | 499 | 3.61 | −0.74 | 21 | 3 | 2.39 | 1.92 | 0.47 | 1048 | 20 | 63 | Example |
| 81 | 143 | 515 | 3.60 | −0.80 | 17 | 5 | 3.11 | 2.25 | 0.86 | 941 | 23 | 70 | Example |
| 82 | 129 | 462 | 3.58 | −0.71 | 20 | 6 | 3.17 | 2.35 | 0.82 | 929 | 22 | 81 | Example |

TABLE 19

| Experiment Example | C mass % | Si mass % | Mn mass % | P mass % | S mass % | Al mass % | N mass % | O mass % | |
|---|---|---|---|---|---|---|---|---|---|
| AA | 0.112 | 0.78 | 1.99 | 0.028 | 0.0022 | 0.054 | 0.0022 | 0.0020 | Example |
| AB | 0.193 | 1.26 | 2.52 | 0.015 | 0.0036 | 0.012 | 0.0025 | 0.0037 | Example |
| AC | 0.087 | 1.06 | 2.60 | 0.003 | 0.0033 | 0.050 | 0.0041 | 0.0014 | Example |
| AD | 0.144 | 1.75 | 1.93 | 0.018 | 0.0038 | 0.015 | 0.0054 | 0.0023 | Example |
| AE | 0.205 | 0.99 | 2.28 | 0.014 | 0.0021 | 0.114 | 0.0044 | 0.0018 | Example |
| AF | 0.235 | 0.75 | 1.75 | 0.014 | 0.0005 | 0.023 | 0.0007 | 0.0031 | Example |
| AG | 0.310 | 0.57 | 1.94 | 0.006 | 0.0035 | 0.341 | 0.0055 | 0.0021 | Example |
| AH | 0.187 | 1.39 | 2.34 | 0.023 | 0.0015 | 0.050 | 0.0045 | 0.0016 | Example |
| AI | 0.159 | 1.73 | 1.97 | 0.014 | 0.0006 | 0.031 | 0.0055 | 0.0025 | Example |
| AJ | 0.098 | 1.92 | 2.78 | 0.009 | 0.0039 | 0.056 | 0.0030 | 0.0023 | Example |
| AK | 0.237 | 1.34 | 1.46 | 0.015 | 0.0015 | 0.045 | 0.0050 | 0.0015 | Example |
| AL | 0.172 | 0.36 | 2.38 | 0.009 | 0.0010 | 1.054 | 0.0016 | 0.0019 | Example |
| AM | 0.130 | 0.84 | 2.20 | 0.010 | 0.0013 | 0.012 | 0.0053 | 0.0023 | Example |
| AN | 0.275 | 1.60 | 1.96 | 0.013 | 0.0032 | 0.025 | 0.0010 | 0.0019 | Example |

TABLE 19-continued

| Experiment Example | C mass % | Si mass % | Mn mass % | P mass % | S mass % | Al mass % | N mass % | O mass % | |
|---|---|---|---|---|---|---|---|---|---|
| AO | 0.193 | 1.17 | 1.84 | 0.021 | 0.0090 | 0.021 | 0.0019 | 0.0019 | Example |
| AP | 0.257 | 0.73 | 1.31 | 0.011 | 0.0049 | 0.050 | 0.0053 | 0.0022 | Example |
| AQ | 0.205 | 0.17 | 2.58 | 0.004 | 0.0002 | 1.719 | 0.0044 | 0.0023 | Example |

TABLE 20

| Experiment Example | Ti mass % | Nb mass % | B mass % | Cr mass % | Ni mass % | Cu mass % | Mo mass % | V mass % | Ca mass % | Ce mass % | Mg mass % | REM mass % | |
|---|---|---|---|---|---|---|---|---|---|---|---|---|---|
| AA | | | | | | | | | | | | | Example |
| AB | | | | | | | | | | | | | Example |
| AC | 0.031 | | | | | | | | | | | | Example |
| AD | 0.053 | | | | | | | | | | | | Example |
| AE | | 0.028 | | | | | | | | | | | Example |
| AF | | | | | | | | | | | | | Example |
| AG | | | | | | | 0.14 | | | | | | Example |
| AH | | | 0.0041 | | | | | | | | | | Example |
| AI | | | | | | | | | 0.0022 | | | | Example |
| AJ | | | | 0.32 | | | | | | | | | Example |
| AK | | | | | 0.93 | | | | | | | | Example |
| AL | | | | | | 0.23 | | | | | | | Example |
| AM | | | | | | | | | | | | | Example |
| AN | | | | | | | | | | | | | Example |
| AO | | | | | | | | | | | | | Example |
| AP | 0.009 | | | | 1.23 | 0.12 | | | | | | | Example |
| AQ | | | | | | | | | | 0.0027 | | | Example |

TABLE 21

| Experiment Example | Chemical Constituent | Slab Heating Temperature ° C. | $Ar_3$ Transformation Point ° C. | Finish Rolling Temperature ° C. | Cooling Rate After Rolling ° C./second | Winding Temperature ° C. |
|---|---|---|---|---|---|---|
| ca | AA | 1245 | 707 | 941 | 23 | 627 |
| cb | AA | 1250 | 707 | 931 | 33 | 684 |
| cc | AA | 1205 | 707 | 892 | 6 | 654 |
| cd | AA | 1210 | 707 | 901 | 36 | 607 |
| ce | AB | 1225 | 648 | 882 | 26 | 617 |
| cf | AB | 1185 | 648 | 940 | 37 | 636 |
| cg | AB | 1230 | 648 | 894 | 36 | 466 |
| ch | AB | 1185 | 648 | 896 | 27 | 628 |
| ci | AC | 1180 | 669 | 927 | 35 | 684 |
| cj | AC | 1250 | 669 | 943 | 29 | 645 |
| ck | AC | 1240 | 669 | 883 | 36 | 615 |
| cl | AC | 1205 | 669 | 876 | 31 | 641 |
| cm | AD | 1205 | 734 | 914 | 37 | 620 |
| cn | AD | 1195 | 734 | 903 | 48 | 718 |
| co | AE | 1235 | 657 | 892 | 27 | 673 |
| cp | AE | 1235 | 657 | 971 | 39 | 644 |
| cq | AF | 1250 | 688 | 917 | 31 | 614 |
| cr | AF | 1215 | 688 | 900 | 35 | 620 |
| cs | AF | 1185 | 688 | 925 | 32 | 644 |
| ct | AF | 1205 | 688 | 920 | 3 | 637 |
| cu | AG | 1235 | 634 | 890 | 37 | 653 |
| cv | AG | 1215 | 634 | 926 | 49 | 614 |
| cw | AH | 1250 | 671 | 920 | 28 | 660 |
| cx | AH | 1250 | 671 | 937 | 29 | 638 |
| cy | AI | 1225 | 725 | 919 | 48 | 674 |
| cz | AI | 1235 | 725 | 898 | 51 | 640 |

| Experiment Example | Left Side of Equation (1) | Cooling Rate After Winding ° C./hour | Volume Fraction of Austenite volume % | Bs ° C. | Rolling Reduction % | Cold-rolled Sheet Thickness mm | |
|---|---|---|---|---|---|---|---|
| ca | 11.7 | 13 | 71 | 570 | 50 | 1.4 | Example |
| cb | 50.3 | 12 | 81 | 576 | 50 | 1.4 | Example |
| cc | 19.3 | 14 | 23 | 475 | 50 | 1.4 | Comparative Example |

TABLE 21-continued

| | | | | | | | |
|---|---|---|---|---|---|---|---|
| cd | 7.1 | 13 | 80 | 575 | 50 | 1.4 | Example |
| ce | 10.3 | 11 | 84 | 481 | 60 | 1.2 | Example |
| cf | 15.2 | 13 | 85 | 482 | 60 | 1.2 | Example |
| cg | 0.1 | 10 | 70 | 467 | 60 | 1.2 | Comparative Example |
| ch | 14.0 | 11 | 86 | 482 | 60 | 1.2 | Example |
| ci | 41.1 | 14 | 92 | 523 | 50 | 1.2 | Example |
| cj | 18.6 | 13 | 84 | 520 | 50 | 1.2 | Example |
| ck | 4.1 | 28 | 78 | 518 | 50 | 1.2 | Comparative Example |
| cl | 17.0 | 13 | 79 | 518 | 50 | 1.2 | Example |
| cm | 14.2 | 9 | 81 | 531 | 60 | 1.0 | Example |
| cn | 74.0 | 15 | 82 | 532 | 60 | 1.0 | Example |
| co | 39.4 | 11 | 92 | 522 | 50 | 2.0 | Example |
| cp | 25.2 | 10 | 100 | 527 | 50 | 2.0 | Example |
| cq | 9.7 | 12 | 76 | 547 | 60 | 1.2 | Example |
| cr | 10.7 | 13 | 90 | 561 | 60 | 1.2 | Example |
| cs | 26.9 | 8 | 80 | 551 | 60 | 1.2 | Example |
| ct | 14.8 | 14 | 11 | 17 | 60 | 1.2 | Comparative Example |
| cu | 29.0 | 10 | 84 | 541 | 50 | 1.6 | Example |
| cv | 14.1 | 8 | 87 | 545 | 50 | 1.6 | Example |
| cw | 32.0 | 10 | 100 | 507 | 45 | 1.1 | Example |
| cx | 25.2 | 8 | 92 | 502 | 45 | 1.1 | Example |
| cy | 42.6 | 11 | 82 | 525 | 50 | 1.6 | Example |
| cz | 13.8 | 15 | 81 | 524 | 50 | 1.6 | Example |

TABLE 22

| Experiment Example | Chemical Constituent | Slab Heating Temperature ° C. | $Ar_3$ Transformation Point ° C. | Finish Rolling Temperature ° C. | Cooling Rate After Rolling ° C./second | Winding Temperature ° C. |
|---|---|---|---|---|---|---|
| da | AJ | 1190 | 662 | 898 | 24 | 642 |
| db | AJ | 1200 | 662 | 966 | 26 | 653 |
| dc | AK | 1240 | 691 | 949 | 46 | 618 |
| dd | AK | 1245 | 691 | 910 | 53 | 605 |
| de | AL | 1225 | 627 | 890 | 51 | 667 |
| df | AL | 1215 | 627 | 922 | 45 | 620 |
| dg | AM | 1205 | 684 | 897 | 40 | 679 |
| dh | AM | 1230 | 684 | 943 | 40 | 703 |
| di | AM | 1245 | 684 | 919 | 42 | 677 |
| dj | AN | 1245 | 684 | 885 | 29 | 670 |
| dk | AN | 1200 | 684 | 914 | 35 | 615 |
| dl | AN | 1240 | 684 | 924 | 33 | 672 |
| dm | AO | 1215 | 708 | 886 | 25 | 664 |
| dn | AO | 1250 | 708 | 928 | 32 | 734 |
| do | AO | 1230 | 708 | 935 | 42 | 685 |
| dp | AP | 1220 | 659 | 892 | 32 | 630 |
| dq | AP | 1245 | 659 | 902 | 36 | 648 |
| dr | AQ | 1240 | 599 | 911 | 25 | 635 |
| ds | AQ | 1235 | 599 | 927 | 36 | 604 |

| Experiment Example | Left Side of Equation (1) | Cooling Rate After Winding ° C./hour | Volume Fraction of Austenite volume % | Bs ° C. | Rolling Reduction % | Cold-rolled Sheet Thickness mm | |
|---|---|---|---|---|---|---|---|
| da | 17.1 | 12 | 100 | 453 | 38 | 1.6 | Example |
| db | 21.3 | 14 | 89 | 450 | 50 | 1.2 | Example |
| dc | 16.0 | 8 | 94 | 523 | 50 | 1.2 | Example |
| dd | 5.9 | 15 | 86 | 516 | 38 | 1.6 | Example |
| de | 44.1 | 9 | 85 | 608 | 50 | 1.2 | Example |
| df | 8.6 | 15 | 79 | 603 | 50 | 1.2 | Example |
| dg | 38.7 | 14 | 91 | 550 | 43 | 1.2 | Example |
| dh | 78.6 | 11 | 80 | 545 | 43 | 1.2 | Example |
| di | 46.3 | 10 | 88 | 549 | 43 | 1.2 | Example |
| dj | 29.3 | 14 | 80 | 486 | 50 | 1.2 | Example |
| dk | 12.8 | 9 | 83 | 490 | 50 | 1.2 | Example |
| dl | 47.0 | 10 | 87 | 494 | 50 | 1.2 | Example |
| dm | 29.4 | 13 | 83 | 545 | 43 | 1.2 | Example |
| dn | 81.8 | 19 | 100 | 557 | 43 | 1.2 | Example |
| do | 58.4 | 10 | 92 | 552 | 43 | 1.2 | Example |
| dp | 16.5 | 10 | 83 | 527 | 50 | 1.6 | Example |

TABLE 22-continued

| | | | | | | | |
|---|---|---|---|---|---|---|---|
| dq | 26.9 | 9 | 90 | 534 | 50 | 1.6 | Example |
| dr | 17.3 | 11 | 75 | 623 | 50 | 1.6 | Example |
| ds | 6.1 | 14 | 67 | 613 | 50 | 1.6 | Example |

TABLE 23

| | | | | | First Cooling Process | Second Cooling Process | | | |
|---|---|---|---|---|---|---|---|---|---|
| Experiment Example | Cold-rolled Steel Sheet | Chemical Constituent | Type of Steel | Maximum Heating Temperature (T1) ° C. | Maintaining Time in Ferrite Transformation Temperature Range second | Average Cooling Rate in Bainite Transformation Temperature Range ° C./second | Cooling Termination Temperature (T2) ° C. | Cooling Termination Temperature - Ms ° C. | |
| 83 | ca | AA | CR | 786 | 27 | 118 | 355 | −45 | Example |
| 84 | cb | AA | CR | 793 | 61 | 46 | 332 | −49 | Example |
| 85 | cc | AA | CR | 787 | 33 | 79 | 286 | −104 | Comparative Example |
| 86 | cd | AA | CR | 795 | 30 | 57 | 385 | −5 | Comparative Example |
| 87 | ce | AB | CR | 816 | 64 | 19 | 231 | −58 | Example |
| 88 | cf | AB | CR | 790 | 102 | 56 | 209 | −44 | Example |
| 89 | cg | AB | CR | 823 | 67 | 59 | 263 | −32 | Comparative Example |
| 90 | ch | AB | CR | 782 | 35 | 50 | 273 | −45 | Comparative Example |
| 91 | ci | AC | CR | 778 | 46 | 34 | 351 | −33 | Example |
| 92 | cj | AC | CR | 840 | 72 | 61 | 360 | −23 | Example |
| 93 | ck | AC | CR | 845 | 82 | 60 | 267 | −56 | Comparative Examplele |
| 94 | cl | AC | CR | 801 | 40 | 59 | 344 | −35 | Comparative Example |
| 95 | cm | AD | CR | 776 | 93 | 52 | 310 | −38 | Example |
| 96 | cn | AD | CR | 784 | 47 | 37 | 307 | −54 | Example |
| 97 | co | AE | CR | 854 | 156 | 67 | 253 | −43 | Example |
| 98 | cp | AE | CR | 800 | 79 | 33 | 230 | −72 | Example |
| 99 | cq | AF | CR | 827 | 79 | 53 | 294 | −33 | Example |
| 100 | cr | AF | CR | 778 | 80 | 28 | 214 | −66 | Example |
| 101 | cs | AF | CR | 800 | 61 | 58 | 248 | −45 | Comparative Example |
| 102 | ct | AF | CR | 858 | 54 | 58 | 302 | −26 | Comparative Example |
| 103 | cu | AG | CR | 774 | 58 | 38 | 130 | −30 | Example |
| 104 | cv | AG | CR | 819 | 41 | 50 | 264 | −35 | Example |
| 105 | cw | AH | CR | 834 | 85 | 82 | 277 | −41 | Example |
| 106 | cx | AH | CR | 800 | 203 | 65 | 239 | −51 | Example |
| 107 | cy | AI | CR | 818 | 75 | 53 | 302 | −49 | Example |
| 108 | cz | AI | CR | 877 | 61 | 52 | 300 | −47 | Example |
| 109 | da | AJ | CR | 852 | 349 | 23 | 279 | −70 | Example |
| 110 | db | AJ | CR | 783 | 159 | 60 | 300 | −46 | Example |
| 111 | dc | AK | CR | 762 | 84 | 18 | 229 | −46 | Example |
| 112 | dd | AK | CR | 791 | 107 | 66 | 292 | −21 | Example |
| 113 | de | AL | CR | 905 | 95 | 75 | 340 | −24 | Example |
| 114 | df | AL | CR | 869 | 41 | 31 | 328 | −35 | Example |
| 115 | dg | AM | CR | 783 | 129 | 106 | 278 | −73 | Example |
| 116 | dh | AM | CR | 840 | 186 | 62 | 299 | −39 | Example |
| 117 | di | AM | CR | 1052 | 47 | 37 | 343 | −47 | Comparative Example |
| 118 | dj | AN | CR | 814 | 67 | 57 | 231 | −39 | Example |
| 119 | dk | AN | CR | 796 | 30 | 69 | 234 | −53 | Example |
| 120 | dl | AN | CR | 703 | 35 | 24 | 340 | 484 | Comparative Example |
| 121 | dm | AO | CR | 800 | 26 | 57 | 315 | −37 | Example |
| 122 | dn | AO | CR | 855 | 66 | 46 | 311 | −45 | Example |
| 123 | do | AO | CR | 830 | 130 | 28 | 380 | 93 | Comparative Example |
| 124 | dp | AP | CR | 803 | 46 | 33 | 257 | −31 | Example |
| 125 | dq | AP | CR | 821 | 86 | 64 | 253 | −27 | Example |
| 126 | dr | AQ | CR | 785 | 115 | 33 | 277 | −59 | Example |
| 127 | ds | AQ | CR | 851 | 264 | 56 | 249 | −54 | Example |

TABLE 24

| Experiment Example | Maintaining Process Maintaining Time in Martensite Transformation Temperature Range Second | Reheating Process: Average Rate of Temperature Increase in Bainite Transformation Temperature Range ° C./second | Reheating Stop Temperature (T3) ° C. | Reheating Stop Temperature - Bs ° C. | Total Maintaining Time in Bainite Transformation Temperature Range Second | |
|---|---|---|---|---|---|---|
| 83 | 16 | 25 | 544 | −35 | 7 | Example |
| 84 | 33 | 21 | 511 | −56 | 13 | Example |
| 85 | 15 | 31 | 537 | −37 | 8 | Comparative Example |
| 86 | 1 | 31 | 532 | −40 | 9 | Comparative Example |
| 87 | 16 | 25 | 425 | −30 | 15 | Example |
| 88 | 28 | 55 | 478 | 28 | 7 | Example |
| 89 | 31 | 20 | 448 | −19 | 12 | Comparative Example |
| 90 | 19 | 15 | 349 | −129 | 14 | Comparative Example |
| 91 | 24 | 43 | 493 | −26 | 7 | Example |
| 92 | 25 | 21 | 528 | 10 | 9 | Example |
| 93 | 16 | 37 | 459 | −23 | 7 | Comparative Example |
| 94 | 23 | 3 | 467 | −50 | 43 | Comparative Example |
| 95 | 22 | 29 | 493 | −27 | 9 | Example |
| 96 | 26 | 32 | 482 | −48 | 10 | Example |
| 97 | 20 | 18 | 504 | 10 | 14 | Example |
| 98 | 63 | 26 | 451 | −50 | 14 | Example |
| 99 | 27 | 23 | 534 | −11 | 14 | Example |
| 100 | 11 | 18 | 514 | −5 | 22 | Example |
| 101 | 2031 | 24 | 491 | −24 | 13 | Comparative Example |
| 102 | 26 | 25 | 493 | −58 | 13 | Comparative Example |
| 103 | 34 | 17 | 457 | −17 | 27 | Example |
| 104 | 42 | 77 | 470 | −72 | 8 | Example |
| 105 | 29 | 25 | 488 | 2 | 9 | Example |
| 106 | 30 | 45 | 418 | −52 | 7 | Example |
| 107 | 21 | 30 | 509 | −14 | 9 | Example |
| 108 | 8 | 37 | 526 | 6 | 8 | Example |
| 109 | 52 | 36 | 378 | −67 | 7 | Example |
| 110 | 24 | 19 | 442 | 0 | 7 | Example |
| 111 | 21 | 31 | 419 | −67 | 18 | Example |
| 112 | 21 | 29 | 476 | −32 | 10 | Example |
| 113 | 29 | 24 | 573 | −24 | 13 | Example |
| 114 | 24 | 18 | 509 | −89 | 20 | Example |
| 115 | 41 | 50 | 540 | 18 | 5 | Example |
| 116 | 26 | 39 | 482 | −49 | 8 | Example |
| 117 | 19 | 14 | 572 | 18 | 16 | Comparative Example |
| 118 | 76 | 41 | 437 | −38 | 9 | Example |
| 119 | 34 | 29 | 498 | 8 | 10 | Example |
| 120 | 0 | 32 | 471 | 193 | 0 | Comparative Example |
| 121 | 23 | 14 | 500 | −47 | 17 | Example |
| 122 | 8 | 46 | 520 | −28 | 8 | Example |
| 123 | 0 | 30 | 478 | −28 | 39 | Comparative Example |
| 124 | 31 | 26 | 487 | −30 | 16 | Example |
| 125 | 23 | 30 | 465 | −41 | 11 | Example |
| 126 | 21 | 41 | 544 | −71 | 15 | Example |
| 127 | 9 | 20 | 533 | −51 | 19 | Example |

TABLE 25

| Experiment Example | Third Cooling Process Maintaining Time in Bainite Transformation Second | Fourth Cooling Process Average Cooling Rate ° C./second | Bainite Transformation Start Temperature (Bs) ° C. | Martensite Transformation Start Temperature (Ms) ° C. | |
|---|---|---|---|---|---|
| 83 | 135 | 3 | 579 | 400 | Example |
| 84 | 149 | 9 | 567 | 381 | Example |
| 85 | 236 | 4 | 574 | 390 | Comparative Example |
| 86 | 130 | 11 | 572 | 390 | Comparative Example |
| 87 | 461 | 9 | 455 | 289 | Example |
| 88 | 524 | 8 | 450 | 253 | Example |
| 89 | 411 | 12 | 467 | 295 | Comparative Example |
| 90 | 590 | 4 | 478 | 318 | Comparative Example |
| 91 | 403 | 7 | 519 | 384 | Example |
| 92 | 65 | 5 | 518 | 383 | Example |
| 93 | 577 | 13 | 482 | 323 | Comparative Example |
| 94 | 558 | 6 | 517 | 379 | Comparative Example |
| 95 | 193 | 6 | 520 | 348 | Example |
| 96 | 232 | 4 | 530 | 361 | Example |
| 97 | 130 | 11 | 494 | 296 | Example |
| 98 | 218 | 12 | 501 | 302 | Example |
| 99 | 173 | 4 | 545 | 327 | Example |
| 100 | 295 | 5 | 519 | 280 | Example |
| 101 | 156 | 13 | 515 | 293 | Comparative Example |
| 102 | 146 | 12 | 551 | 328 | Comparative Example |
| 103 | 218 | 6 | 474 | 160 | Example |
| 104 | 275 | 9 | 542 | 299 | Example |
| 105 | 50 | 6 | 486 | 318 | Example |
| 106 | 171 | 9 | 470 | 290 | Example |
| 107 | 463 | 11 | 523 | 351 | Example |
| 108 | 484 | 4 | 520 | 347 | Example |
| 109 | 606 | 8 | 445 | 349 | Example |
| 110 | 535 | 7 | 442 | 346 | Example |
| 111 | 233 | 13 | 486 | 275 | Example |
| 112 | 264 | 13 | 508 | 313 | Example |
| 113 | 115 | 3 | 597 | 364 | Example |
| 114 | 241 | 8 | 598 | 363 | Example |
| 115 | 236 | 12 | 522 | 351 | Example |
| 116 | 92 | 7 | 531 | 338 | Example |
| 117 | 163 | 11 | 554 | 390 | Comparative Example |
| 118 | 136 | 8 | 475 | 270 | Example |
| 119 | 152 | 10 | 490 | 287 | Example |
| 120 | 163 | — | 278 | −144 | Comparative Example |
| 121 | 164 | 9 | 547 | 352 | Example |
| 122 | 75 | 6 | 548 | 356 | Example |
| 123 | 244 | 3 | 506 | 287 | Comparative Example |
| 124 | 399 | 6 | 517 | 288 | Example |
| 125 | 382 | 11 | 506 | 280 | Example |
| 126 | 276 | 5 | 615 | 336 | Example |
| 127 | 205 | 9 | 584 | 303 | Example |

TABLE 26

| | | | | Micro Structure Observation Results | | | | | | | | | |
|---|---|---|---|---|---|---|---|---|---|---|---|---|---|
| | | | | Volume Fraction | | | | | | | | Average Crystal | |
| Experiment Example | Cold-rolled Steel Sheet | Chemical Constituent | Type of Steel | F % | B % | BF % | B + BF % | TM % | M % | Retained γ % | Others % | Grain μn | |
| 83 | ca | AA | CR | 12 | 19 | 24 | 43 | 40 | 0 | 3 | 2 | 3.5 | Example |
| 84 | cb | AA | CR | 31 | 26 | 14 | 40 | 27 | 0 | 2 | 0 | 5.5 | Example |

TABLE 26-continued

| | | | | Micro Structure Observation Results | | | | | | | | | |
|---|---|---|---|---|---|---|---|---|---|---|---|---|---|
| | | | | Volume Fraction | | | | | | | | Average Crystal | |
| Experiment Example | Cold-rolled Steel Sheet | Chemical Constituent | Type of Steel | F % | B % | BF % | B + BF % | TM % | M % | Retained γ % | Others % | Grain μn | |
| 85 | cc | AA | CR | 23 | 18 | 2 | 20 | 56 | 1 | 0 | 0 | 4.8 | Comparative Example |
| 86 | cd | AA | CR | 26 | 32 | 34 | 66 | 4 | 0 | 4 | 0 | 5.1 | Comparative Example |
| 87 | ce | AB | CR | 36 | 10 | 13 | 23 | 30 | 3 | 7 | 1 | 4.9 | Example |
| 88 | cf | AB | CR | 45 | 24 | 8 | 32 | 19 | 0 | 3 | 1 | 6.1 | Example |
| 89 | cg | AB | CR | 33 | 27 | 5 | 32 | 19 | 13 | 3 | 0 | 4.8 | Comparative Example |
| 90 | ch | AB | CR | 21 | 28 | 8 | 36 | 34 | 3 | 5 | 1 | 3.4 | Comparative Example |
| 91 | ci | AC | CR | 19 | 13 | 31 | 44 | 28 | 2 | 4 | 3 | 4.2 | Example |
| 92 | cj | AC | CR | 25 | 37 | 6 | 43 | 31 | 0 | 0 | 1 | 5.1 | Example |
| 93 | ck | AC | CR | 68 | 7 | 8 | 15 | 15 | 0 | 1 | 1 | 7.1 | Comparative Example |
| 94 | cl | AC | CR | 27 | 35 | 2 | 37 | 33 | 3 | 0 | 0 | 5.7 | Comparative Example |
| 95 | cm | AD | CR | 31 | 33 | 0 | 33 | 32 | 2 | 0 | 2 | 4.2 | Example |
| 96 | cn | AD | CR | 22 | 27 | 13 | 40 | 34 | 0 | 3 | 1 | 4.0 | Example |
| 97 | co | AE | CR | 38 | 17 | 10 | 27 | 30 | 0 | 5 | 0 | 7.1 | Example |
| 98 | cp | AE | CR | 32 | 26 | 2 | 28 | 40 | 0 | 0 | 0 | 7.2 | Example |
| 99 | cq | AF | CR | 26 | 36 | 8 | 44 | 23 | 3 | 4 | 0 | 3.7 | Example |
| 100 | cr | AF | CR | 42 | 4 | 9 | 13 | 33 | 0 | 11 | 1 | 8.0 | Example |
| 101 | cs | AF | CR | 40 | 0 | 0 | 0 | 27 | 0 | 0 | 33 | 5.3 | Comparative Example |
| 102 | ct | AF | CR | 12 | 33 | 36 | 69 | 17 | 1 | 2 | 0 | 3.1 | Comparative Example |
| 103 | cu | AG | CR | 48 | 0 | 25 | 25 | 13 | 0 | 14 | 0 | 6.0 | Example |
| 104 | cv | AG | CR | 16 | 11 | 33 | 44 | 20 | 2 | 17 | 1 | 4.4 | Example |
| 105 | cw | AH | CR | 27 | 11 | 12 | 23 | 43 | 1 | 6 | 0 | 6.3 | Example |
| 106 | cx | AH | CR | 41 | 7 | 13 | 20 | 31 | 0 | 7 | 1 | 6.5 | Example |
| 107 | cy | AI | CR | 22 | 34 | 9 | 43 | 29 | 1 | 3 | 2 | 4.7 | Example |
| 108 | cz | AI | CR | 23 | 11 | 25 | 36 | 33 | 1 | 6 | 1 | 6.7 | Example |
| 109 | da | AJ | CR | 23 | 22 | 7 | 29 | 47 | 0 | 1 | 0 | 5.6 | Example |
| 110 | db | AJ | CR | 26 | 17 | 21 | 38 | 31 | 0 | 4 | 1 | 6.4 | Example |
| 111 | dc | AK | CR | 37 | 10 | 23 | 33 | 19 | 0 | 11 | 0 | 7.0 | Example |
| 112 | dd | AK | CR | 21 | 2 | 41 | 43 | 18 | 3 | 15 | 0 | 7.5 | Example |
| 113 | de | AL | CR | 25 | 42 | 0 | 42 | 30 | 0 | 2 | 1 | 5.4 | Example |
| 114 | df | AL | CR | 26 | 8 | 33 | 41 | 24 | 1 | 8 | 0 | 4.8 | Example |
| 115 | dg | AM | CR | 43 | 19 | 0 | 19 | 38 | 0 | 0 | 0 | 6.7 | Example |
| 116 | dh | AM | CR | 42 | 7 | 28 | 35 | 17 | 0 | 5 | 1 | 7.5 | Example |
| 117 | di | AM | CR | 1 | 26 | 18 | 44 | 45 | 4 | 4 | 2 | 1.3 | Comparative Example |
| 118 | dj | AN | CR | 28 | 30 | 0 | 30 | 37 | 0 | 2 | 3 | 5.5 | Example |
| 119 | dk | AN | CR | 18 | 35 | 3 | 38 | 43 | 0 | 0 | 1 | 3.2 | Example |
| 120 | dl | AN | CR | 78 | 0 | 0 | 0 | 0 | 3 | 3 | 16 | 16.9 | Comparative Example |
| 121 | dm | AO | CR | 15 | 0 | 44 | 44 | 29 | 3 | 8 | 1 | 6.7 | Example |
| 122 | dn | AO | CR | 12 | 9 | 33 | 42 | 37 | 0 | 9 | 0 | 4.4 | Example |
| 123 | do | AO | CR | 45 | 27 | 16 | 43 | 2 | 3 | 5 | 2 | 9.8 | Comparative Example |
| 124 | dp | AP | CR | 28 | 12 | 30 | 42 | 19 | 1 | 9 | 1 | 4.4 | Example |
| 125 | dq | AP | CR | 32 | 5 | 36 | 41 | 15 | 0 | 11 | 1 | 6.8 | Example |
| 126 | dr | AQ | CR | 32 | 27 | 8 | 35 | 33 | 0 | 0 | 0 | 5.9 | Example |
| 127 | ds | AQ | CR | 45 | 5 | 16 | 21 | 23 | 1 | 10 | 0 | 6.1 | Example |

TABLE 27

| | Hardness Measurement Results | | | | | | Mn Segregation | | | Material Quality Measurement Results | | | |
|---|---|---|---|---|---|---|---|---|---|---|---|---|---|
| Experiment Example | H2 Hv | H98 Hv | H98/H2 | K* | f (Maximum) % | f (Minimum) % | Maximum Concentration mass % | Minimum Concentration mass % | Difference between Maximum Value and Minimum Value mass % | TS MPa | EL % | λ % | |
| 83 | 121 | 513 | 4.23 | −0.89 | 18 | 7 | 2.42 | 1.53 | 0.89 | 952 | 23 | 67 | Example |
| 84 | 120 | 541 | 4.51 | −0.60 | 21 | 3 | 2.49 | 1.46 | 1.03 | 1080 | 23 | 61 | Example |
| 85 | 117 | 524 | 4.50 | −0.05 | 33 | 1 | 2.10 | 1.89 | 0.21 | 1144 | 11 | 23 | Comparative Example |
| 86 | 123 | 542 | 4.39 | −0.21 | 28 | 0 | 2.40 | 1.77 | 0.63 | 944 | 16 | 17 | Comparative Example |
| 87 | 137 | 534 | 3.91 | −0.57 | 16 | 5 | 3.18 | 2.16 | 1.02 | 1527 | 13 | 35 | Example |
| 88 | 128 | 459 | 3.58 | −0.44 | 19 | 4 | 3.00 | 2.12 | 0.88 | 1349 | 15 | 48 | Example |
| 89 | 125 | 602 | 4.81 | −0.34 | 23 | 3 | 2.71 | 2.44 | 0.27 | 1427 | 13 | 22 | Comparative Example |
| 90 | 131 | 566 | 4.34 | −0.30 | 17 | 0 | 3.15 | 2.04 | 1.11 | 1260 | 18 | 28 | Comparative Example |
| 91 | 121 | 584 | 4.82 | −0.91 | 17 | 7 | 3.24 | 1.88 | 1.36 | 1090 | 22 | 65 | Example |
| 92 | 136 | 372 | 2.74 | −0.78 | 21 | 3 | 3.16 | 1.95 | 1.21 | 1085 | 16 | 66 | Example |
| 93 | 121 | 430 | 3.55 | 0.13 | 35 | 0 | 2.74 | 2.51 | 0.23 | 917 | 22 | 15 | Comparative Example |
| 94 | 121 | 581 | 4.79 | −0.26 | 19 | 0 | 3.09 | 2.25 | 0.84 | 1027 | 22 | 25 | Comparative Example |
| 95 | 132 | 680 | 5.15 | −0.56 | 18 | 5 | 2.52 | 1.60 | 0.92 | 1066 | 26 | 65 | Example |
| 96 | 139 | 721 | 5.20 | −0.64 | 19 | 4 | 2.97 | 1.48 | 1.49 | 1091 | 24 | 57 | Example |
| 97 | 123 | 646 | 5.25 | −0.58 | 23 | 5 | 3.27 | 1.59 | 1.68 | 1129 | 22 | 63 | Example |
| 98 | 129 | 484 | 3.76 | −0.68 | 18 | 8 | 3.05 | 1.94 | 1.11 | 1403 | 15 | 52 | Example |
| 99 | 124 | 613 | 4.94 | −0.72 | 20 | 4 | 2.03 | 1.49 | 0.54 | 1124 | 21 | 47 | Example |
| 100 | 111 | 438 | 3.94 | −0.46 | 18 | 7 | 2.20 | 1.43 | 0.77 | 1376 | 16 | 37 | Example |

TABLE

| | Hardness Measurement Results | | | | | | Mn Segregation | | | Material Quality Measurement Results | | | |
|---|---|---|---|---|---|---|---|---|---|---|---|---|---|
| Experiment Example | H2 Hv | H98 Hv | H98/H2 | K* | f (Maximum) % | f (Minimum) % | Maximum Concentration mass % | Minimum Concentration mass % | Difference between Maximum Value and Minimum Value mass % | TS MPa | EL % | λ % | |
| 101 | 112 | 456 | 4.06 | −0.14 | 27 | 0 | 2.37 | 1.51 | 0.86 | 1228 | 18 | 17 | Comparative Example |
| 102 | 121 | 510 | 4.21 | −0.29 | 30 | 1 | 1.86 | 1.68 | 0.18 | 1306 | 9 | 22 | Comparative Example |
| 103 | 108 | 476 | 4.40 | −0.44 | 23 | 4 | 2.69 | 1.31 | 1.38 | 1398 | 18 | 44 | Example |
| 104 | 114 | 465 | 4.08 | −0.57 | 18 | 7 | 2.58 | 1.56 | 1.02 | 1532 | 15 | 42 | Example |
| 105 | 136 | 518 | 3.82 | −0.65 | 16 | 5 | 2.98 | 1.76 | 1.22 | 1081 | 20 | 53 | Example |
| 106 | 131 | 655 | 5.00 | −0.58 | 22 | 2 | 3.05 | 1.93 | 1.12 | 1135 | 23 | 48 | Example |
| 107 | 139 | 569 | 4.11 | −0.86 | 18 | 7 | 2.83 | 1.41 | 1.42 | 1098 | 20 | 77 | Example |
| 108 | 140 | 725 | 5.17 | −0.79 | 20 | 6 | 2.53 | 1.60 | 0.93 | 1404 | 18 | 48 | Example |
| 109 | 153 | 572 | 3.74 | −0.63 | 18 | 7 | 3.65 | 2.36 | 1.29 | 1131 | 16 | 51 | Example |
| 110 | 153 | 773 | 5.04 | −0.95 | 19 | 6 | 3.49 | 2.38 | 1.11 | 1250 | 21 | 64 | Example |
| 111 | 129 | 661 | 5.11 | −0.45 | 21 | 2 | 1.90 | 1.23 | 0.67 | 1332 | 22 | 44 | Example |
| 112 | 130 | 491 | 3.77 | −0.66 | 21 | 3 | 1.71 | 1.15 | 0.56 | 1450 | 15 | 35 | Example |
| 113 | 106 | 465 | 4.37 | −0.59 | 17 | 4 | 3.50 | 1.80 | 1.70 | 1280 | 18 | 48 | Example |
| 114 | 112 | 515 | 4.59 | −0.84 | 17 | 7 | 2.92 | 2.15 | 0.77 | 1237 | 19 | 59 | Example |
| 115 | 120 | 624 | 5.19 | −0.45 | 22 | 5 | 2.84 | 1.69 | 1.15 | 1194 | 22 | 55 | Example |
| 116 | 115 | 422 | 3.66 | −0.50 | 18 | 4 | 2.74 | 1.51 | 1.23 | 1011 | 20 | 55 | Example |
| 117 | 304 | 419 | 1.38 | −0.32 | 23 | 3 | 2.86 | 1.76 | 1.10 | 1056 | 11 | 26 | Comparative Example |
| 118 | 138 | 648 | 4.68 | −0.61 | 20 | 3 | 2.44 | 1.43 | 1.01 | 1319 | 18 | 43 | Example |
| 119 | 136 | 491 | 3.61 | −1.01 | 21 | 6 | 2.58 | 1.71 | 0.87 | 1455 | 14 | 49 | Example |
| 120 | 129 | 615 | 4.77 | 0.21 | 32 | 0 | 2.50 | 1.65 | 0.85 | 733 | 13 | 16 | Comparative Example |
| 121 | 126 | 507 | 4.03 | −0.46 | 23 | 2 | 2.59 | 1.39 | 1.20 | 1113 | 19 | 44 | Example |

TABLE-continued

| Experiment Example | Hardness Measurement Results: H2 Hv | H98 Hv | H98/H2 | K* | f (Maximum) % | f (Minimum) % | Mn Segregation: Maximum Concentration mass % | Minimum Concentration mass % | Difference between Maximum Value and Minimum Value mass % | Material Quality Measurement Results: TS MPa | EL % | λ % | |
|---|---|---|---|---|---|---|---|---|---|---|---|---|---|
| 122 | 125 | 459 | 3.66 | −0.58 | 18 | 8 | 2.50 | 1.21 | 1.29 | 1311 | 15 | 52 | Example |
| 123 | 127 | 522 | 4.11 | −0.24 | 29 | 0 | 2.36 | 1.33 | 1.03 | 1005 | 18 | 31 | Comparative Example |
| 124 | 109 | 408 | 3.74 | −0.62 | 19 | 8 | 1.78 | 1.11 | 0.67 | 1129 | 18 | 65 | Example |
| 125 | 112 | 552 | 4.95 | −0.72 | 17 | 7 | 1.73 | 1.12 | 0.61 | 1380 | 18 | 57 | Example |
| 126 | 89 | 375 | 4.20 | −0.57 | 18 | 6 | 3.29 | 2.13 | 1.16 | 1278 | 16 | 46 | Example |
| 127 | 95 | 517 | 5.42 | −0.49 | 24 | 1 | 2.83 | 2.27 | 0.56 | 1351 | 20 | 36 | Example |

TABLE 29

| Experiment Example | Chemical Constituent | Slab Heating Temperature ° C. | $Ar_3$ Transformation Point ° C. | Finish Rolling Temperature ° C. | Cooling Rate After Rolling ° C./second | Winding Temperature ° C. |
|---|---|---|---|---|---|---|
| dt | AA | 1205 | 707 | 903 | 35 | 642 |
| du | AA | 1200 | 707 | 918 | 30 | 635 |
| dv | AA | 1220 | 707 | 897 | 31 | 628 |
| dw | AB | 1210 | 648 | 915 | 29 | 626 |
| dx | AB | 1215 | 648 | 907 | 36 | 618 |
| dy | AC | 1230 | 669 | 926 | 29 | 623 |
| dz | AC | 1235 | 669 | 890 | 31 | 646 |

| Experiment Example | Left Side of Equation (1) | Cooling Rate After Winding ° C./hour | Volume Fraction of Austenite % by volume | Bs ° C. | Rolling Reduction % | Cold-rolled Sheet Thickness mm | |
|---|---|---|---|---|---|---|---|
| dt | 22.6 | 15 | 81 | 576 | 0 | 3.0 | Example |
| du | 19.7 | 12 | 83 | 574 | 0 | 3.0 | Example |
| dv | 20.4 | 13 | 88 | 572 | 0 | 3.0 | Example |
| dw | 18.9 | 13 | 85 | 482 | 0 | 2.3 | Example |
| dx | 15.9 | 14 | 86 | 483 | 0 | 2.3 | Example |
| dy | 17.9 | 13 | 77 | 518 | 0 | 4.0 | Example |
| dz | 28.2 | 15 | 86 | 521 | 0 | 4.0 | Example |

TABLE 30

| Experiment Example | Hot-rolled Steel Sheet | Chemical Constituent | Type of Steel | Maximum Heating Temperature (T1) ° C. | First Cooling: Process Maintaining Time in Ferrite Transformation Temperature Range Second | Second Cooling Process: Average Cooling Rate in Bainite Transformation Temperature Range ° C./second | Cooling Termination Temperature (T2) ° C. | Cooling Termination Temperature - Ms ° C. |
|---|---|---|---|---|---|---|---|---|
| 128 | dt | AA | HR | 838 | 32 | 58 | 339 | −49 |
| 129 | du | AA | HR | 843 | 52 | 55 | 343 | −29 |
| 130 | dv | AA | HR-GA | 837 | 38 | 44 | 332 | −60 |
| 131 | dw | AB | HR | 873 | 49 | 52 | 249 | −76 |
| 132 | dx | AB | HR-GA | 863 | 45 | 48 | 280 | −39 |
| 133 | dy | AC | HR | 840 | 53 | 62 | 344 | −28 |
| 134 | dz | AC | HR-GI | 822 | 46 | 50 | 320 | −51 |

TABLE 30-continued

| Experiment Example | Maintaining Process: Maintaining Time in Martensite Transformation Temperature Range Second | Reheating Process: Average Rate of Temperature Increase in Bainite Transformation Temperature Range ° C./second | Reheating Stop Temperature (T3) ° C. | Reheating Stop Temperature - Bs ° C. | Total Maintaining Time in Bainite Transformation Temperature Range Second | |
|---|---|---|---|---|---|---|
| 128 | 17 | 49 | 480 | −90 | 5 | Example |
| 129 | 8 | 35 | 498 | −65 | 7 | Example |
| 130 | 10 | 37 | 478 | −96 | 6 | Example |
| 131 | 14 | 45 | 501 | 24 | 6 | Example |
| 132 | 10 | 40 | 493 | 20 | 7 | Example |
| 133 | 14 | 40 | 499 | −12 | 5 | Example |
| 134 | 15 | 25 | 479 | −31 | 7 | Example |

TABLE 31

| Experiment Example | Third Cooling Process Maintaining Time in Bainite Transformation Temperature Range Second | Fourth Cooling Process Average Cooling Rate ° C./second | Bainite Transformation Start Rate (Bs) ° C. | Martensite Transformation Start Temperature (Ms) ° C. | Plating Bath Position | Alloying Conditions: Alloying Temperature (Tg) ° C. | Alloying Conditions: Maintaining Time Second | |
|---|---|---|---|---|---|---|---|---|
| 128 | 432 | 12 | 570 | 388 | — | — | — | Example |
| 129 | 330 | 11 | 563 | 372 | — | — | — | Example |
| 130 | 350 | 10 | 574 | 392 | After Annealing | 505 | 25 | Example |
| 131 | 252 | 11 | 477 | 325 | — | — | — | Example |
| 132 | 143 | 10 | 473 | 319 | Reheating Process | 493 | 21 | Example |
| 133 | 338 | 8 | 511 | 372 | — | — | — | Example |
| 134 | 433 | 11 | 510 | 371 | After Annealing | — | — | Example |

TABLE 32

| Experiment Example | Hot-Rolled Steel Sheet | Chemical Constituent | Type of Steel | Micro Structure Observation Results: Volume Fraction: F % | B % | BF % | B + BF % | TM % | M % | Retained γ % | Others % | Average Crystal Grain μm | |
|---|---|---|---|---|---|---|---|---|---|---|---|---|---|
| 128 | dt | AA | HR | 27 | 25 | 15 | 40 | 29 | 1 | 3 | 0 | 7.5 | Example |
| 129 | du | AA | HR | 38 | 13 | 28 | 41 | 16 | 0 | 5 | 0 | 8.7 | Example |
| 130 | dv | AA | HR-GA | 20 | 36 | 0 | 36 | 42 | 0 | 2 | 0 | 6.4 | Example |
| 131 | dw | AB | HR | 15 | 15 | 22 | 37 | 43 | 0 | 5 | 0 | 6.3 | Example |
| 132 | dx | AB | HR-GA | 19 | 37 | 6 | 43 | 33 | 2 | 3 | 0 | 5.7 | Example |
| 133 | dy | AC | HR | 33 | 28 | 12 | 40 | 25 | 1 | 0 | 1 | 6.3 | Example |
| 134 | dz | AC | HR-GI | 34 | 25 | 13 | 38 | 23 | 0 | 4 | 1 | 5.7 | Example |

TABLE 33

| | Hardness Measurement Results | | | | | | Mn Segregation | | | Material Quality Measurement Results | | | |
|---|---|---|---|---|---|---|---|---|---|---|---|---|---|
| Experiment Example | H2 Hv | H98 Hv | H98/H2 | K* | f (Maximum) % | f (Minimum) % | Maximum Concentration mass % | Minimum Concentration mass % | Difference between Maximum Value and Minimum Value mass % | TS MPa | EL % | λ % | |
| 128 | 108 | 441 | 4.08 | −0.62 | 13 | 2 | 2.39 | 1.71 | 0.68 | 980 | 19 | 56 | Example |
| 129 | 103 | 442 | 4.29 | −0.57 | 15 | 2 | 2.41 | 1.79 | 0.62 | 924 | 24 | 59 | Example |
| 130 | 105 | 412 | 3.92 | −0.67 | 12 | 3 | 2.41 | 1.65 | 0.76 | 963 | 21 | 52 | Example |
| 131 | 115 | 510 | 4.43 | −0.64 | 17 | 2 | 2.97 | 2.15 | 0.82 | 1418 | 13 | 34 | Example |
| 132 | 122 | 495 | 4.06 | −0.58 | 13 | 4 | 3.00 | 2.16 | 0.84 | 1305 | 15 | 39 | Example |
| 133 | 101 | 396 | 3.92 | −0.48 | 15 | 2 | 3.06 | 2.12 | 0.94 | 1019 | 18 | 44 | Example |
| 134 | 104 | 426 | 4.10 | −0.66 | 15 | 2 | 2.98 | 2.18 | 0.80 | 1107 | 18 | 45 | Example |

The invention claimed is:

1. A high-strength steel sheet comprising by mass percentage:

0.05 to 0.4% of C;

0.1 to 2.5% of Si;

1.0 to 3.5% of Mn;

0.001 to 0.03% of P;

0.0001 to 0.01% of S;

0.001 to 2.5% of Al;

0.0001 to 0.01% of N;

0.0001 to 0.008% of 0; and a remainder composed of iron and inevitable impurities, wherein a steel sheet structure contains by volume fraction 10 to 45% of a ferrite phase, 10 to 50% of a tempered martensite phase, and a remaining hard phase which is selected from the group consisting of a bainitic ferrite phase, a bainite phase, a fresh martensite phase, and a mixture thereof, wherein when a plurality of measurement regions with diameters of 1 μm or less are set in a range from ⅛ to ⅜ of a thickness of the steel sheet, hardness measurement values in the plurality of measurement regions are arranged in ascending order to obtain a hardness distribution, an integer N0.02 which is a number obtained by multiplying a total number of the hardness measurement values by 0.02 and, if present, by rounding up a decimal number, is obtained, a hardness of a measurement value which is an N0.02-th largest value from a smallest hardness measurement value is regarded as a 2% hardness, an integer N0.98 which is a number obtained by multiplying the total number of the hardness measurement values by 0.98 and, if present, by rounding down the decimal number is obtained, and a hardness of a measurement value which is an N0.98-th largest value from the smallest hardness measurement value is regarded as a 98% hardness, the 98% hardness is 1.5 or more times as high as the 2% hardness, wherein a kurtosis K* of the hardness distribution between the 2% hardness and the 98% hardness is equal to or more than −1.2 and equal to or less than −0.4, wherein an average crystal grain size in the steel sheet structure is 10 μm or less, wherein a tensile strength is 900 MPa or more, wherein a difference between a maximum value and a minimum value of Mn concentration in a base iron in a thickness range from ⅛ to ⅜ of the steel sheet is equal to or more than 0.4% and equal to or less than 3.5% when converted into the mass percentage, and wherein the hard phase includes a fresh martensite phase of 10% or less.

2. The high-strength steel sheet according to claim 1, wherein when a section from the 2% hardness to the 98% hardness is equally divided into 10 parts, and 10/10-sections are set, a number of the hardness measurement values in each 1/10-section is 2 to 30% of a number of all measurement values.

3. The high-strength steel sheet according to claim 1, wherein the hard phase includes any one of or both a bainitic ferrite phase and a bainite phase of 10 to 45% by a volume fraction.

4. The high-strength steel sheet according to claim 1, wherein the steel sheet structure further includes 2 to 25% of a retained austenite.

5. The high-strength steel sheet according to claim 1, further comprising by mass percentage one or more of:

0.005 to 0.09% of Ti; and 0.005 to 0.09% of Nb.

6. The high-strength steel sheet according to claim 1, further comprising by mass percentage one or more of:

0.0001 to 0.01% of B;

0.01 to 2.0% of Cr;

0.01 to 2.0% of Ni;

0.01 to 2.0% of Cu; and 0.01 to 0.8% of Mo.

7. The high-strength steel sheet according to claim 1, further comprising by mass percentage:

0.005 to 0.09% of V.

8. The high-strength steel sheet according to claim 1, further comprising one or more of Ca, Ce, Mg, and REM excluding the Ce at 0.0001 to 0.5% by mass percentage in total.

9. A high-strength zinc-coated steel sheet, wherein the high-strength zinc-coated steel sheet is produced by forming a zinc-plated layer on a surface of the high-strength steel sheet according to claim 1.

10. A manufacturing method of a high-strength steel sheet according to claim 1, the method comprising:

a hot rolling process in which a slab containing chemical constitutents according to claim 1 is heated up to 1050° C. or higher directly or after cooling once, a hot rolling is performed thereon at a higher temperature of one of 800° C. and an $Ar_a$ transformation point, and a winding is performed in a temperature range of 750° C. or lower such that an austenite phase in a structure of a rolled material after rolling occupies 50% by volume or more;

a cooling process in which the steel sheet after the hot rolling is cooled from a winding temperature to (the winding temperature—100° C. at a rate of 20° C./hour or lower while a following Equation (1) is satisfied; and a process in which continuous annealing is performed on the steel sheet after the cooling, wherein in the process in which continuous annealing is performed, the steel sheet is annealed at a maximum heating temperature of 750 to 1000° C., a first cooling in which the steel sheet is cooled from the maximum heating temperature to a ferrite transformation temperature range or lower and maintained in the ferrite transformation temperature range for 20 to 1000 seconds is subsequently performed, a second cooling in which the steel sheet is cooled at a cooling rate of 10° C./second or higher on average in a bainite transformation temperature range and cooling is stopped within a range from a martensite transformation start temperature—98° C. to the martensite transformation start temperature is subsequently performed, the steel sheet after the second cooling is maintained in a range from a second cooling stop temperature to the martensite transformation start temperature for 2 to 1000 seconds, the steel sheet is subsequently reheated up to a reheating stop temperature, which is equal to or more than a bainite transformation start temperature—100° C., at a rate of temperature increase of 10° C./second or higher on average in the bainite transformation temperature range, and a third cooling in which the steel sheet after the reheating is cooled from the reheating stop temperature to a temperature which is lower than the bainite transformation temperature range and maintained in the bainite transformation temperature range for 30 seconds or more is performed:

[Equation 1]

$$\left[\int_{T_{c-100}}^{T_c} 9.47\times10^5\cdot\exp\left(-\frac{18480}{T+273}\right)\cdot t(T)\cdot dT\right]^{0.5} \geq 1.0 \quad (1)$$

[where, t(T) in Equation (1) represents maintaining time (seconds) of the steel sheet at a temperature T° C. in the cooling process after the winding], so that a steel sheet according to claim 1 is formed.

11. The manufacturing method of the high-strength steel sheet according to claim 10, wherein the winding temperature after the hot rolling is equal to or more than a Bs point and equal to or less than 750° C.

12. The manufacturing method of the high-strength steel sheet according to claim 10, further comprising between the cooling process and the continuous annealing process:

a cold rolling process in which the steel sheet is subjected to acid pickling and a cold rolling at rolling reduction from 35 to 80%.

13. The manufacturing method of the high-strength steel sheet according to claim 10, wherein a sum of a time during which the steel sheet is maintained in the bainite transformation temperature range in the second cooling and a time during which the steel sheet is maintained in the bainite transformation temperature range in the reheating is 25 seconds or less.

14. The manufacturing method of the high-strength steel sheet according to claim 10, wherein the steel sheet is dipped into a zinc plating bath in the reheating in manufacturing the high-strength steel sheet.

15. A manufacturing method of a high-strength zinc-coated steel sheet according to claim 10, wherein the steel sheet is dipped into a zinc plating bath in the bainite transformation temperature range in the third cooling in manufacturing the high-strength steel sheet.

16. A manufacturing method of a high-strength zinc-coated steel sheet according to claim 10, wherein a zinc electroplating is performed after manufacturing the high-strength steel sheet.

17. A manufacturing method of a high-strength zinc-coated steel sheet according to claim 10, wherein a hot-dip zinc-plating is performed after manufacturing the high-strength steel sheet.

* * * * *